US006571430B1

(12) United States Patent
Savicki et al.

(10) Patent No.: US 6,571,430 B1
(45) Date of Patent: Jun. 3, 2003

(54) CLOSURE DEVICE

(75) Inventors: Alan F. Savicki, Naperville, IL (US); Chih-Hung Chen, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 09/914,805

(22) PCT Filed: Jun. 10, 1999

(86) PCT No.: PCT/US99/13289

§ 371 (c)(1),
(2), (4) Date: Aug. 30, 2001

(87) PCT Pub. No.: WO00/76345

PCT Pub. Date: Dec. 21, 2000

(51) Int. Cl.[7] ..... A44B 19/16; B65D 33/24; A41H 37/06

(52) U.S. Cl. ..... 24/30.5 R; 24/399; 24/400; 24/585.12; 383/63; 383/64; 156/66; 156/308.4

(58) Field of Search ..... 24/585.12, 399, 24/400, 30.5 R, 30.5 P, 591.1, DIG. 39, DIG. 50; 383/63, 64; 156/66, 308.4

(56) References Cited

U.S. PATENT DOCUMENTS

| | | | | |
|---|---|---|---|---|
| 2,960,561 A | | 11/1960 | Plummer | |
| 3,054,434 A | | 9/1962 | Ausnit et al. | |
| 3,074,137 A | | 1/1963 | Hawley | |
| 3,106,941 A | | 10/1963 | Plummer | |
| 3,115,689 A | | 12/1963 | Jacobs | |
| 3,122,807 A | | 3/1964 | Ausnit | |
| 3,230,593 A | | 1/1966 | Herz | |
| 3,234,614 A | | 2/1966 | Plummer | |
| 3,343,233 A | | 9/1967 | Gould | |
| 3,426,396 A | | 2/1969 | Laguerre | |
| 3,713,923 A | | 1/1973 | Laguerre | |
| 3,806,998 A | | 4/1974 | Laguerre | |
| 3,959,856 A | * | 6/1976 | Ausnit | 24/585.12 |
| 4,186,786 A | | 2/1980 | Kirkpatrick | |
| 4,199,845 A | | 4/1980 | Ausnit | |

(List continued on next page.)

FOREIGN PATENT DOCUMENTS

| | | |
|---|---|---|
| EP | 0 510 797 | 10/1992 |
| FR | 1564039 | 4/1969 |
| JP | 52-112476 | 9/1977 |

*Primary Examiner*—Victor Sakran
(74) *Attorney, Agent, or Firm*—Thomas C. Feix

(57) ABSTRACT

The closure device includes first and second interlocking fastening strips (130, 131) arranged to be interlocked over a predetermined length. The fastening strips (130, 131) have a longitudinal X axis (160), a transverse Y axis (162) and a vertical Z axis (164). The fastening strips (130, 131) are occluded and deoccluded by moving the first fastening strip (130) relative to the second fastening strip (131) in substantially the vertical Z axis (164). The fastening strips (130, 131) may also move in the Y axis (162), rotate or deflect during occlusion. In addition, the fastening strips may include a locking feature (1244, 1245) to prevent unintentional deocclusion.

60 Claims, 35 Drawing Sheets

U.S. PATENT DOCUMENTS 4,262,395 A 4/1981 Kosky
4,268,938 A * 5/1981 Walchli ..... 24/585.12
4,285,105 A 8/1981 Kirkpatrick
4,660,259 A * 4/1987 Ausnit ..... 24/585.12
4,736,496 A 4/1988 Fisher et al.
4,829,641 A 5/1989 Williams
5,007,142 A 4/1991 Herrington
5,007,143 A 4/1991 Herrington
5,010,627 A 4/1991 Herrington et al.
5,020,194 A 6/1991 Herrington et al.
5,067,208 A 11/1991 Herrington et al.
5,070,583 A 12/1991 Herrington
5,088,971 A 2/1992 Herrington
5,131,121 A 7/1992 Herrington, Jr. et al.
5,138,750 A 8/1992 Gundlach et al.
5,140,727 A 8/1992 Dais et al.
5,161,286 A 11/1992 Herrington, Jr. et al.
5,189,764 A 3/1993 Herrington et al.
5,283,932 A 2/1994 Richardson et al.
5,301,394 A 4/1994 Richardson et al.
5,301,395 A 4/1994 Richardson et al.
5,403,094 A 4/1995 Tomic
5,405,478 A 4/1995 Richardson et al.
5,426,830 A 6/1995 Richardson et al.
5,431,760 A 7/1995 Donovan
5,442,837 A 8/1995 Morgan
5,442,838 A 8/1995 Richardson et al.
5,448,807 A 9/1995 Herrington, Jr.
5,448,808 A 9/1995 Gross
5,482,375 A 1/1996 Richardson et al.
5,664,299 A 9/1997 Porchia
5,722,128 A 3/1998 Toney et al.
5,809,621 A 9/1998 McCree et al.
5,836,056 A 11/1998 Porchia et al.
5,947,603 A * 9/1999 Tilman ..... 383/64
5,956,815 A * 9/1999 O'Connor et al. ..... 24/30.5 R
6,047,450 A * 4/2000 Machacek et al. ..... 24/399
6,220,754 B1 * 4/2001 Stiglic et al. ..... 383/64

* cited by examiner

CLOSURE DEVICE

FIELD OF THE INVENTION

The present invention pertains to an interlocking closure device, and, more particularly, to a closure device with a slider. The closure device of the present invention may be employed in traditional fastener areas, and is particularly suited for use as a fastener for storage containers, such as plastic bags.

BACKGROUND OF THE INVENTION

The use of fastening devices for the closure of containers, including plastic bag bodies, is generally known. Furthermore, the manufacture of fastening devices made of plastic materials is generally known to those skilled in the art relating to closure devices, as demonstrated by the numerous patents in this area.

A particularly well-known use for fastening devices is in connection with flexible containers, such as bag bodies. The closure device and the associated container may be formed from thermoplastic materials, and the closure device and sidewalls of the container can be integrally formed by extrusion as a single piece. Alternatively, the closure device and sidewalls may be formed as separate pieces and then connected by heat sealing or any other suitable connecting process. The closure devices when incorporated as fasteners on bag bodies have been particularly useful in providing a closure means for retaining the contents within the bag body.

Conventional closure devices utilize mating male and female closure elements which are occluded. When conventional closure devices are employed, it often is difficult to determine when the male and female closure elements are occluded. This problem is particularly acute when the closure devices are relatively narrow. Accordingly, when conventional closure devices are employed, there exists a reasonable likelihood that the closure device is at least partially open.

The occlusion problem arises from the inability of a user to perceive when the male and female closure are occluded to form a seal between the contents of the bag and the environment external to the bag. A number of solutions to this problem have been attempted. For example, U.S. Pat. Nos. 4,186,786, 4,285,105, and 4,829,641, as well as in Japanese patent application No. 51-27719, disclose fasteners that provide a visual indication that the male and female closure elements are properly occluded. Specifically, a color change means for verifying the occlusion of the male and female members of the closure is provided wherein male and female members having different colors are employed, and, upon occlusion, provide yet a different color. For example, the female member of the closure may be opaque yellow and the male member of the closure may be translucent blue. Upon occlusion of the male member and female member a composite color with a green hue results. This use of a color change greatly improves the ability of the user of the interlocking closure device to determine when the male and female members are occluded.

The change in color that is viewed when dissimilarly colored male and female members are occluded is demonstrated in a commercially available product sold under the trademark GLAD-LOCK (Glad-Lock is the registered trademark of First Brands Properties, Inc., Danbury, Conn. United States of America). This color change effect may be enhanced by the incorporation of a color change enhancement member in the closure device, as disclosed in U.S. Pat. No. 4,829,641.

Color-changing closure devices are not a universal solution to the aforementioned problem of assuring full closure, however. For example, the color-change effect is imperceptible in the dark, thus mooting the color-change advantage of the closure devices when they are used under such conditions. In addition, sight-impaired or color-blind people may not be able to perceive the color-change effect. Accordingly, it would be desirable to provide a closure device that affords other indications of occlusion.

The prior art has attempted to furnish a fastener that provides a tactile or audible indication of occlusion. For example, U.S. Pat. Nos. 4,736,496, 5,138,750, 5,140,727, 5,403,094, and 5,405,478, as well as EP 510,797, disclose closure devices that allegedly provide a tactually or audibly perceptive indication of proper interlocking of the closure elements. It is said that, upon occlusion of the disclosed closure devices, a user is able to feel or hear that full closure is accomplished. For example, U.S. Pat. No. 4,736,946 discloses the use of additional ribs on either side of the closure elements. These ribs are said to give an improved "feel" to the closure, thus aiding a user in aligning the closure elements.

Such devices are difficult to handle by individuals who have limited manual dexterity. Thus, in order to assist these individuals and for ease of use by individuals with normal dexterity, the prior art has attempted to furnish a fastener that provides a reclosable fastener and a slider for opening and closing the fastener. For example, several U.S. Patents disclose fasteners with sliders. However many of these fasteners use either: (1) a separator finger which extends between the closure elements, such as U.S. Pat. Nos. 3,054,434, 3,115,689, 3,122,807, 3,230,593, 3,426,396, 3,713,923, 4,199,845, 4,262,395, 5,007,142, and 5,010,627 (FIGS. 9 and 10); or (2) the separator finger runs along a track above the closure elements, such as, U.S. Pat. Nos. 5,007,143, 5,010,627 (FIGS. 3–8), 5,020,194, 5,067,208, 5,070,583, 5,088,971, 5,131,121, 5,161,286, 5,283,932, 5,301,395, 5,426,830, 5,442,837 and 5,448,808.

With respect to fasteners which use a separator finger which extends between the closure elements, these fasteners do not provide a leak proof seal because the separator finger extends between the closure elements. With respect to the fasteners which run along a track, the fastener typically include slits, notches or another means to accommodate the separator finger in the end position. These means are used to achieve occlusion of the closure elements at the end position and thus attempt to achieve a leak proof seal. For example, U.S. Pat. Nos. 5,020,194, 5,067,208, 5,088,971, 5,131,121, 5,161,286, 5,301,394, 5,301,395, and 5,442,837 use a slit, notch or other means to accommodate the separator finger in the end position. These means in the fasteners create additional steps in the manufacturing process and thus may increase the cost of these fasteners.

A reclosable fastener with a slider and without a separator finger nor the use of a track is described in U.S. Pat. Nos. 3,074,137 and 5,442,838. However, the fastener in the '137 patent would be too expensive to manufacture and may not seal when the slider is in the end position. With respect to the fastener in the '838 patent, the slider does not manipulate the interlocking elements directly. Rather, the slider engages the structure located below the interlocking elements to control the opening and closing of the interlocking elements. Difficulties and additional variables can arise when the slider does not act directly upon the interlocking elements. In addition, the fastener in the '838 patent may not operate properly if the tolerances are incorrect for the slider and/or the fastener. The structure below the interlocking elements and/or the slider may be difficult to extrude or manufacture. If the tolerances are incorrect, the slider may not move smoothly or fail to open or close the fastener elements. Thus, it would be difficult to achieve a properly functioning fastener.

In addition, the prior art closure devices are designed to deocclude if a sufficient force is applied laterally to the closure device. Thus, the closure device may unintentionally deocclude if a force is applied laterally. For example, when the closure device is used on a plastic bag and the contents of the bag exert a force on the bag sidewalls, then the closure device may unintentionally deocclude.

Furthermore, as noted above, several closure devices use a slider which includes: (1) a separator finger; or (2) a separator finger and a track. These sliders can be expensive to manufacture and assemble onto the fastening strips.

Thus, the prior art has failed to afford a closure device with a slider which occludes and deoccludes by using a shearing action. Specifically, the prior art has failed to show a closure device in which the first fastening strip is sheared relative to the second fastening strip. For example, if the longitudinal axis of the fastening strip is the X axis, the width is the Y axis and the height is the Z axis, then the prior art has failed to disclose a closure device which occludes in the Z axis.

OBJECTS OF THE INVENTION

It is a general object of the present invention to provide a closure device wherein the opening and closing force is applied in shear as opposed to lateral or rolling.

An additional object is to provide a closure device so that the opening and closing forces are applied only to one of the fastening strips while the other fastening strip is held stationary. This situation can simplify the design of a slider.

Another object is to provide a slider for use in conjunction with a shear closure which does not require a separator finger to open or close the fastening strips.

A further object is to provide a slider for use in conjunction with a shear closure which does not require special flanges designed into the fastening strips that are to be gripped by the slider to open the fastening strips.

Another object is to provide a slider which can be installed around the fastening strips without opening or closing the fastening strips.

An additional object of the invention is to provide fastening strips with profiles having a combination of pivoting forces and shearing forces that can take advantage of the attributes of the shearing action.

A further object is to provide a closure device wherein the force applied to the first fastening strip could also push the second fastening strip away and apart from the first fastening strip.

Another object is to provide a closure device wherein the closure device maintains a leak proof seal for a considerable amount of the distance during the opening and closing of the closure device.

It is a further general object of the present invention to provide a container that is closeable and sealable by means of such a closure device.

BRIEF SUMMARY OF THE INVENTION

The present invention satisfies these general objects by providing a closure device with interlocking fastening strips wherein the fastening strips occlude and deocclude in the Z axis by using a shearing action. The closure device comprises first and second interlocking fastening strips arranged to be interlocked over a predetermined length. The fastening strips have a longitudinal X axis and a transverse Y axis which is perpendicular to the longitudinal X axis. The fastening strips have a vertical Z axis which is perpendicular to the longitudinal X axis and which is perpendicular to the transverse Y axis. The fastening strips are occluded and deoccluded by moving one fastening strip relative to the other fastening strip in substantially the vertical Z axis.

During occlusion and deocclusion, portions of the fastening strips may rotate, deflect and/or move in the transverse Y axis. In addition, the fastening strips may include a locking feature which assists in preventing unintentional deocclusion of the closure device.

The closure device may also include a slider which slidably engages said first and second fastening strips. The slider facilitates the occlusion of the fastening strips when moved towards a first end of the fastening strips and deocclusion of the fastening strips when moved towards a second end of the fastening strips.

DESCRIPTION OF THE EMBODIMENTS

Figure 1:
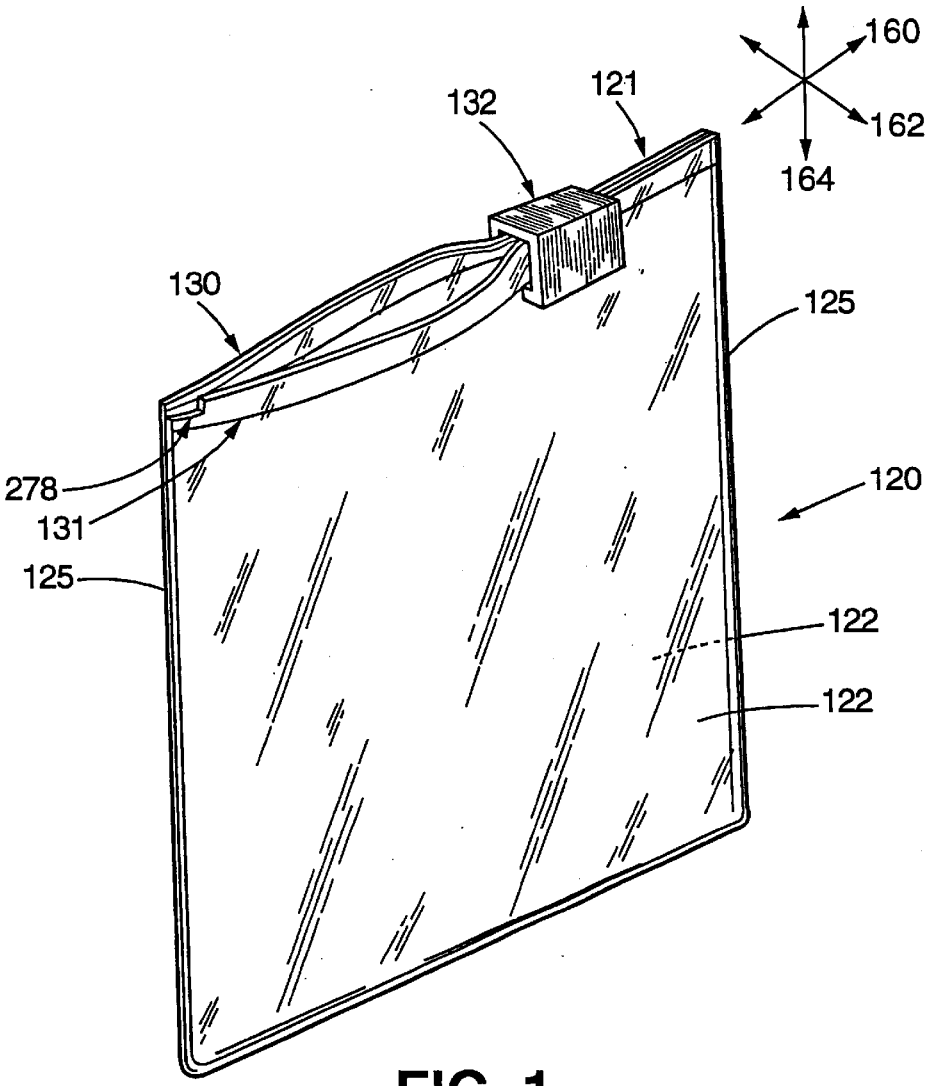
FIG. 1 is a perspective view of a container according to the present invention in the form of a plastic bag.

The present invention provides interlocking closure devices with a slider which occlude and deocclude in the Z axis using a shearing action. FIG. 1 illustrates a container according to the present invention in the form of a plastic bag 120 having a sealable closure device 121. The bag 120 includes side walls 122 joined at seams 125 to form a compartment sealable by means of the closure device 121.

Figure 3:
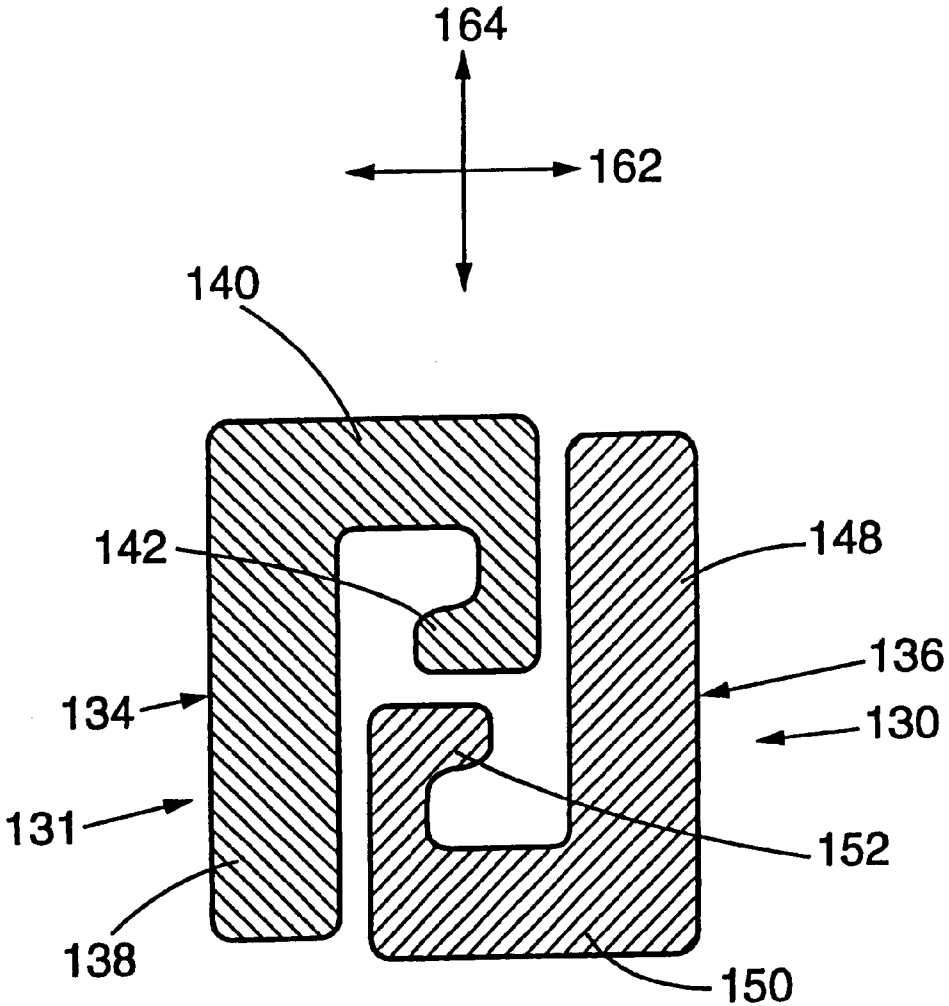
FIG. 3 is an enlarged partial cross-sectional view taken along line 3—3in FIG. 2 of the fastening strips and without the bag sidewalls.

The closure device comprises first and second fastening strips 130, 131 and a slider 132. As shown in FIG. 3, the first fastening strip 131 includes a first closure element 134. The second fastening strip 130 comprises a second closure element 136 for engaging the first closure element 134.

The first closure element 134 comprises a base portion 138 and a web 140 extending from the base portion 138. The web 140 includes a hook portion 142 extending from the web 140.

The second closure element 136 comprises a base portion 148 and a web 150 extending from the base portion 148. The web 150 includes a hook portion 152 extending from the web 150.

Figure 2:
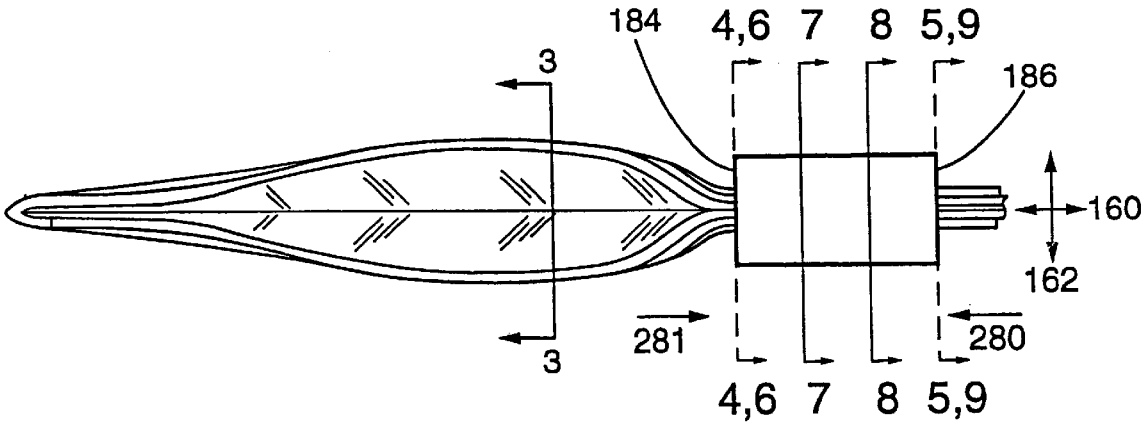
FIG. 2 is an enlarged partial top view of the container in FIG. 1.

Referring to FIGS. 1–3, the closure device and the fastening strips have an X axis 160, a Y axis 162 and a Z axis 164. The X axis 160 is the longitudinal axis of the closure device, the Y axis 162 is the lateral axis which is perpendicular to the X axis 160 and the Z axis 164 is the vertical axis which is perpendicular to the X axis 160 and the Y axis 162.

Figure 5:
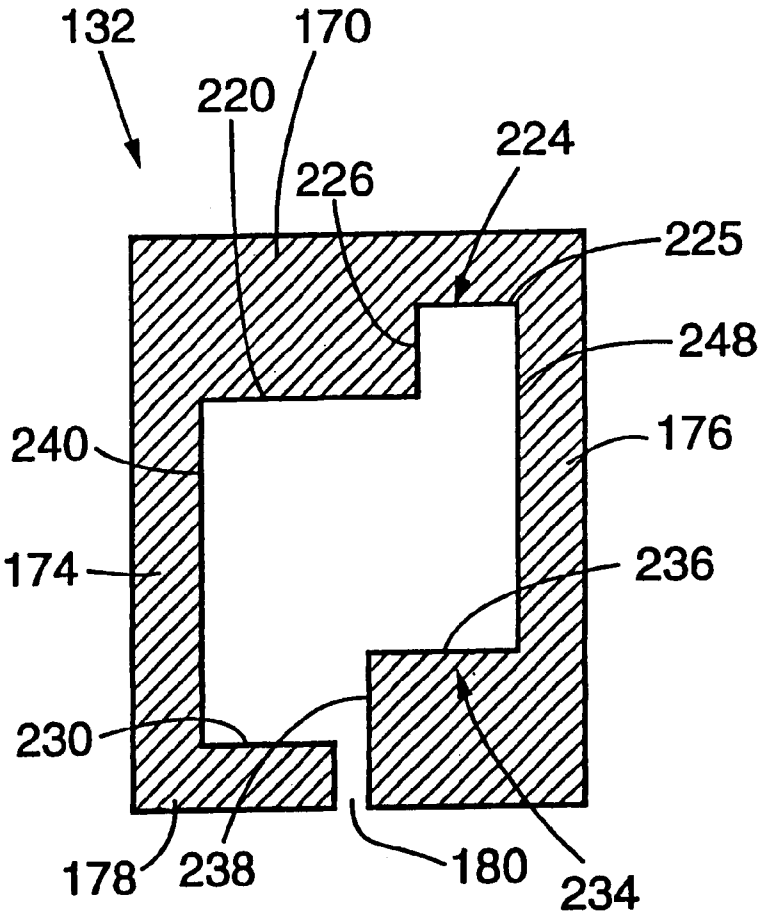
FIG. 5 is a cross-sectional view taken along line 5—5 in FIG. 2 of the slider without the fastening strips.
Figure 4:
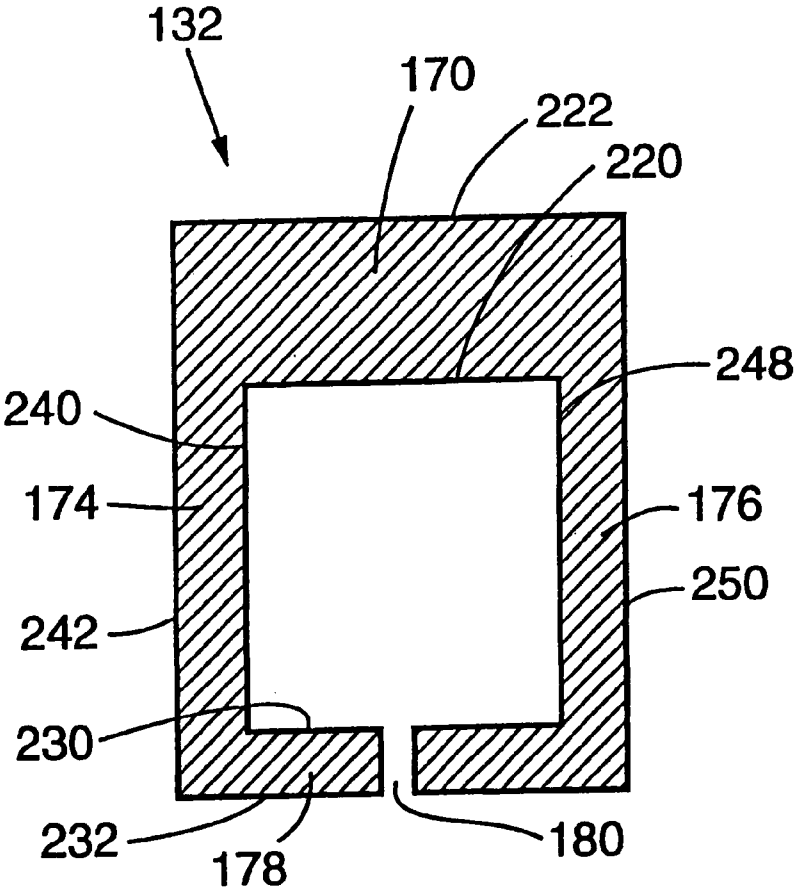
FIG. 4 is a cross-sectional view taken along line 4—4 in FIG. 2 of the slider without the fastening strips.

Referring to FIGS. 4–5, the slider 132 includes a top portion 170, a first side portion 174, a second side portion 176, a bottom portion 178 and a slot 180. Referring to FIG. 2, the slider 132 has a first end 184 and a second end 186.

Returning to FIGS. 4 and 5, the top portion 170 has an inner surface 220 and an outer surface 222. The inner surface 220 includes an offset portion 224 which includes an upper surface 225 and an offset side surface 226. The offset portion 224 begins at the second end 186 and slopes downward towards the first end 184.

The bottom portion 178 has an inner surface 230 and an outer surface 232. The inner surface 230 includes an offset portion 234 which includes an upper surface 236 and an offset side surface 238. The offset portion 234 begins at the second end 186 and slopes downward towards the first end 184.

The first side portion 174 has an inner surface 240 and an outer surface 242. The second side portion 176 has an inner surface 248 and an outer surface 250. The bottom portion 178 has a slot 180 which extends from the outer surface 232 to the inner surface 230. In addition, the slot extends from the first end 184 to the second end 186 of the slider. The slot has substantially the same width from the first end 184 to the second end 186 of the slider.

The slider may be a one piece construction or may include several separate pieces which are assembled in several different ways.

Figure 9:
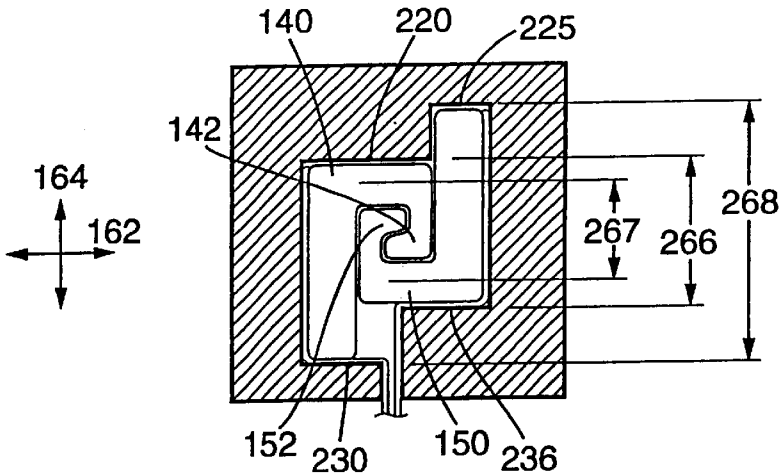
FIG. 9 is a cross-sectional view taken along line 9—9 in FIG. 2.
Figure 6:
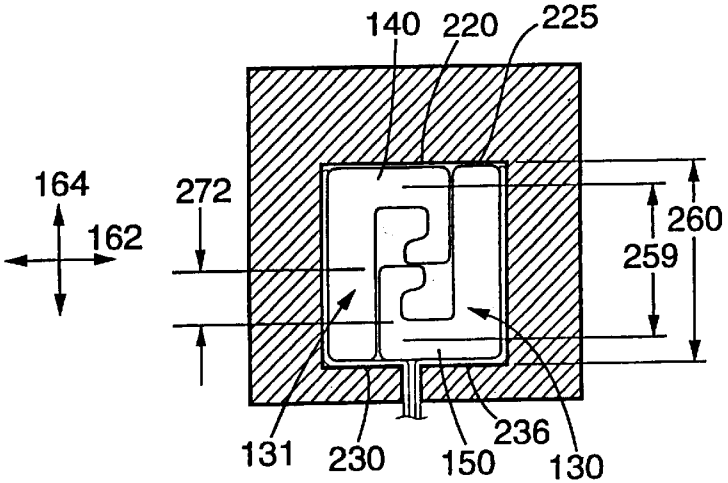
FIG. 6 is a cross-sectional view taken along line 6—6 in FIG. 2.

FIGS. 6–9 illustrate occlusion and deocclusion of the closure device. When FIGS. 6–9 are viewed in numerical sequence, FIGS. 6–9 illustrate occlusion of the fastening strips. When FIGS. 6–9 are viewed in reverse numerical sequence (i.e. viewed from FIG. 9 backwards to FIG. 6), FIGS. 9–6 illustrate deocclusion of the fastening strips.

The occlusion of the fastening strips will be described and then the deocclusion of the fastening strips will be described. The slider 132 facilitates the occlusion of the fastening strips 130, 131 by moving the fastening strips towards each other in a shear direction or Z axis direction and causing the webs to engage. Referring to FIG. 2, the slider 132 is moved in the occlusion direction 280 and the fastening strips 130, 131 enter the slider 132 as shown in FIG. 6. Referring to FIG. 6, the fastening strips 130, 131 are deoccluded and the web 140 and web 150 are separated by a distance 259. In addition, the upper surface 236 of the bottom portion and the inner surface 220 of the top portion are separated by a distance 260.

Figure 7:
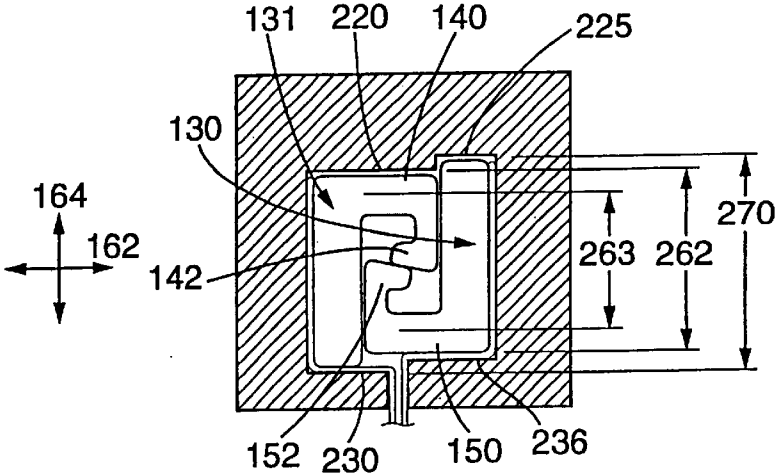
FIG. 7 is a cross-sectional view taken along line 7—7 in FIG. 2.

Referring to FIG. 7, as the slider is moved further along the fastening strips in the occlusion direction 280 as shown in FIG. 2, the slider causes the fastening strips to move closer together in a shear direction or Z axis 164 as shown in FIG. 7. In FIG. 7, the fastening strips 130, 131 are deoccluded. However, the upper surface 236 and the inner surface 220 are closer together than in FIG. 6 and are separated by a distance 262 which is less than distance 260 in FIG. 6. Due to the reduction in distance, the upper surface 236 and the inner surface 220 cause the fastening strips to move closer together in the Z axis 164. Thus, the webs 140, 150 are separated by a distance 263 which is less than the distance 259 in FIG. 6. In addition, the hooks 142, 152 begin to deflect in order to allow the hooks to pass each other and engage when the fastening strips are occluded.

With respect to FIGS. 6–9, the positions of the fastening strips are effected not only by the forces acting upon them by the slider at that location but are also effected by the position of the fastening strips at locations before and after that location. For example, the positions of the fastening strips in FIG. 7 are effected by the positions of the fastening strips in FIGS. 6 and 8.

The amount of effect that the position of fastening strips from one location has upon the position of the fastening strips in another location depends upon several factors, such as, the structure of the fastening strips and the material from which the fastening strips are made. For example, if the fastening strips are relatively thick, then the effect at other locations would be greater than if the fastening strips were relatively thin. As another example, if the material for the fastening strips is relatively rigid, then the effect at other locations would be greater than if the material was relatively flexible.

Figure 8:
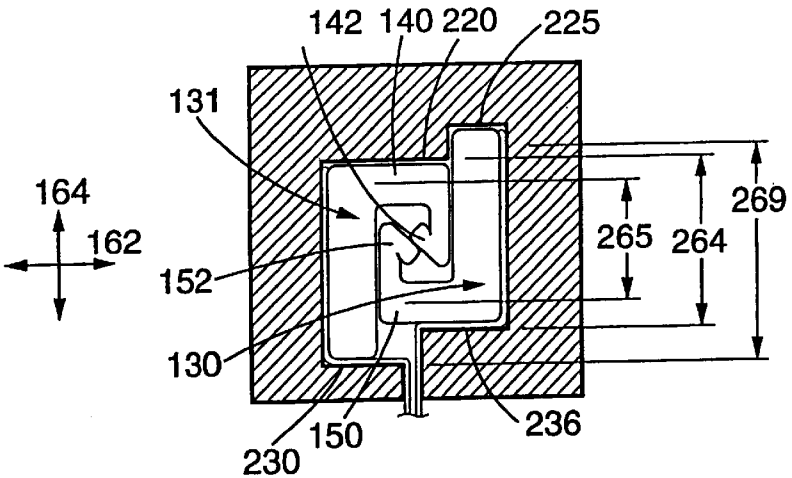
FIG. 8 is a cross-sectional view taken along line 8—8 in FIG. 2.

Referring to FIG. 8, as the slider continues to move along the fastening strips in the occlusion direction 280 as shown in FIG. 2, the slider continues to cause the fastening strips to move closer together in the Z axis 164 as shown in FIG. 8. In FIG. 8, the upper surface 236 and the inner surface 220 are closer together than in FIG. 7 and are separated by a distance 264 which is less than distance 262 in FIG. 7. The surfaces 220, 236 are applying forces to the fastening strips which causes the fastening strips to move closer together in the Z axis 164. The webs 140, 150 are separated by a distance 265 which is less than the distance 263 in FIG. 7. In addition, the hooks 142, 152 in FIG. 8 have deflected more in comparison to FIG. 7 in order to allow the hooks to pass each other and engage when the fastening strips are occluded.

With respect to FIG. 9, as the slider continues to move along the fastening strips in the occlusion direction 280, the slider continues to cause the fastening strips to move closer together in the Z axis 164 as shown in FIG. 9. Referring to FIG. 9, the fastening strips 130, 131 are occluded. Specifically, the webs 140, 150 are occluded and the hooks 142, 152 have engaged each other. The surfaces 220, 236 are closer together in FIG. 9 as compared to FIG. 8 and are separated by a distance 266 which is less than distance 264 in FIG. 8. The inner surfaces 240, 248 apply forces to the fastening strips which causes the fastening strips to move closer together in the Z axis 164. The webs 140, 150 are separated by a distance 267 which is less than the distance 265 in FIG. 8. Thus, as shown in FIG. 9, the fastening strips 130, 131 are occluded prior to exiting the slider.

The fastening strips 130, 131 are occluded by moving the fastening strips in the Z axis 164 toward each other. The distance of the movement in the Z axis is approximately equal to the Z axis dimension of the closure portion. For example, the fastening strips 130, 131 in FIGS. 6–9 moved a distance in the Z axis which is equal to the difference between distance 259 and distance 267. The distance 259 less the distance 267 will be referred to as the Z axis movement distance. The Z axis movement distance is approximately equal to or equal to the Z axis dimension 272 of the hook closure portion 152 in FIG. 6. Thus, in order to occlude the fastening strips 130, 131, the fastening strips are moved toward each other by a Z axis movement distance which is equal to the Z axis dimension of the closure portion.

The deocclusion of the fastening strips 130, 131 in FIGS. 6–9 would occur in the reverse order of these figures. Thus, deocclusion is illustrated by beginning at FIG. 9 and moving in reverse order toward FIG. 6. The slider 132 facilitates the deocclusion of the fastening strips 130, 131 by moving the fastening strips away from each other in the Z axis 164 and causing the webs to disengage. Referring to FIG. 2, the slider 132 is moved in the deocclusion direction 281 and the fastening strips 130, 131 enter the slider 132 as shown in FIG. 9. Referring to FIG. 9, the fastening strips 130, 131 are occluded as they enter the slider 132. The surfaces 225, 230 are separated by a distance 268 and the webs 140, 150 are separated by a distance 267.

With respect to FIG. 8, as the slider continues to move along the fastening strips in the deocclusion direction 291, the slider causes the fastening strips to move away from each other in the Z axis 164 as shown in FIG. 8. Referring to FIG. 8, the surfaces 225, 230 are separated by a distance 269 which is less than the distance 268 in FIG. 9. Due to the reduction in distance, the surfaces 225, 230 cause the fastening strips to move away from each other in the Z axis 164. In addition, the hooks 142, 152 begin to deflect in order to allow the hooks to pass each other and disengage when the fastening strips are deoccluded. During deocclusion the position of the hooks 142, 152 in FIG. 8 would be the opposite as shown in FIG. 8. Specifically, during deocclusion the position of hook 142 would be in a downward direction and the position of hook 152 would be in a upward direction.

Furthermore, as noted above, the positions of the fastening strips are effected not only by the forces acting upon them by the slider at that specific location, but are also effected by the position of the fastening strips at locations before and after that specific location. In this case, the fastening strips 130, 131 are being urged against the surfaces 225, 230 due to the shearing action of the surfaces 225, 230 as shown in FIGS. 6–7.

With respect to FIG. 7, as the slider continues to move along the fastening strips in the deocclusion direction 281 as shown in FIG. 2, the slider continues to cause the fastening strips to move away from each other in the Z axis 164 as shown in FIG. 7. Referring to FIG. 7, the surfaces 225, 230 are separated by a distance 270 which is less than the distance 269 in FIG. 8. The surfaces 225, 230 are applying shear forces to the fastening strips which causes the fastening strips to move away from each other in the Z axis 164. The fastening strips separate due to the shearing action between the fastening straps. Consequently, the webs 140, 150 are separated by a distance 263 which is greater than the distance 265 in FIG. 8. In addition, the hooks 142, 152 in FIG. 7 would deflect more in comparison to FIG. 8 in order to allow the hooks to pass each other and disengage. Also, as noted above, the position of the hooks in FIG. 7 would be in the opposite direction during deocclusion.

With respect to FIG. 6, as the slider continues to move along the fastening strips in the deocclusion direction 281, the slider continues to cause the fastening strips to move away from each other in the Z axis 164 as shown in FIG. 6. Referring to FIG. 6, the fastening strips 130, 131, and thus the webs 140, 150 have deoccluded. The surfaces 225, 230 are separated by a distance 260 which is less than the distance 270 in FIG. 7. The surfaces 225, 230 are applying shear forces to the fastening strips which causes the fastening strips to move away from each other in the Z axis 164. The fastening strips deocclude due to the shearing action between the fastening strips. Thus, the webs 140, 150 are separated by a distance 259 which is greater than the distance 263 in FIG. 7. Also, the hooks 142, 152 in FIG. 6 have disengaged. As shown in FIG. 6, the webs 140, 150 of the fastening strips 130, 131 are deoccluded when the fastening strips exit the slider 132.

Figure 10:
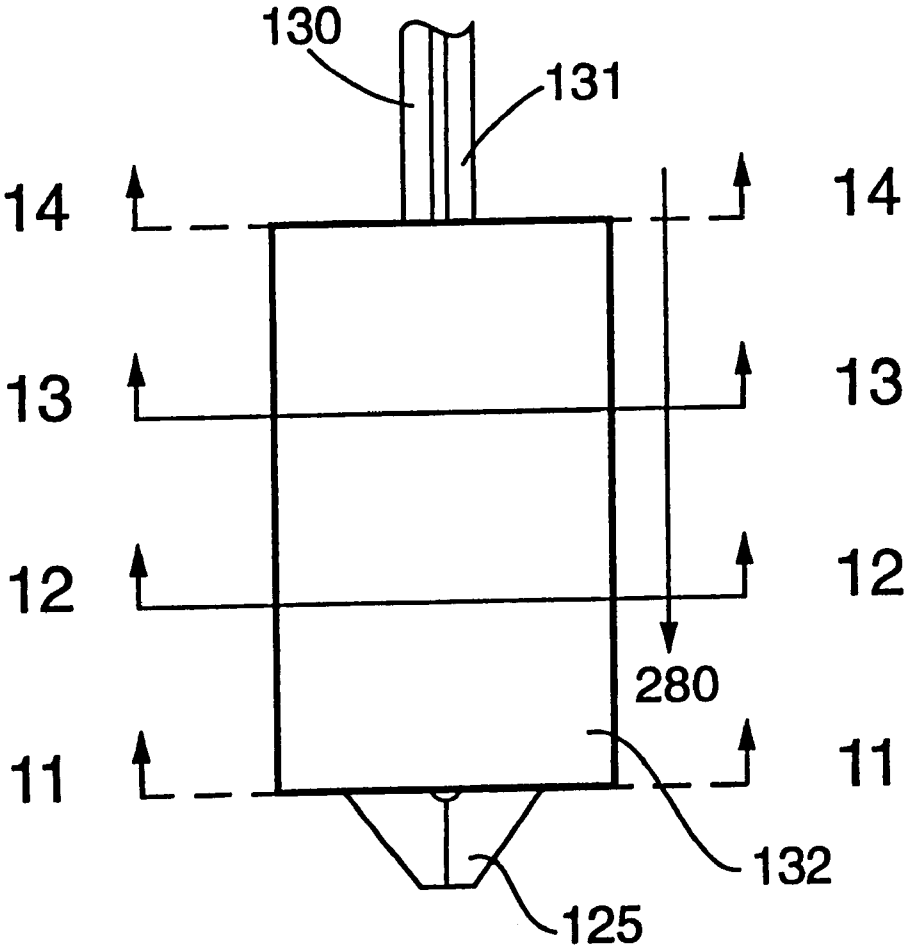
FIG. 10 is an enlarged partial top view of the container shown in FIG. 1 with the slider in the end position and the fastening strips in the occluded position.
Figure 12:
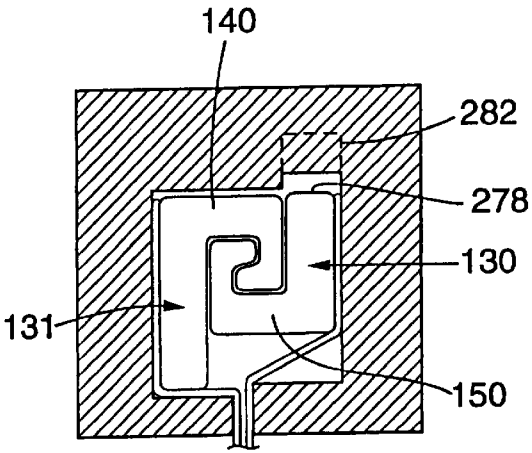
FIG. 12 is a cross-sectional view taken along line 12—12 in FIG. 10.

FIG. 10 shows the slider 132 in the end position of the fastening strips 130, 131 near the seam 125. FIGS. 11–14 illustrate occlusion of the fastening strips in the end position. In accordance with one feature of the invention, these figures demonstrate that the closure device will have a leak proof seal when the slider is in the end position. Referring to FIG. 1, the fastening strip 131 has a notch 278 near the seam 125. As shown in FIG. 1 and by the dashed lines in FIGS. 11–13, the notch 278 removes a portion 282 of fastening strip 131 to allow the hooks 142, 152, and thus the fastening strips, to occlude in the end position.

The movement of the fastening strips 130, 131 at the end position is shown in FIGS. 11–14. As noted above, the positions of the fastening strips are effected not only by the forces acting upon them by the slider at that location but are also effected by the position of the fastening strips at locations before and after that location. Specifically, with respect to the position of the webs 140, 150 in FIGS. 11–13, the position of the inner webs 140, 150 is effected by the seam 125 at the end of the fastening strips. At the seam 125, the fastening strips 130, 131 are melted together in the occluded position. This occlusion of the fastening strips 130, 131 at the seam 125 and the notch 278 prevent the shearing action of the slider from deoccluding the webs 140, 150. Thus, the webs 140, 150 remain occluded because the notch and the seam prevent the slider from deoccluding the webs 140, 150. Consequently, the webs 140, 150 remain occluded through the length of the fastening strips and establish a leak proof seal through the length of the fastening strips.

For example, as the user moves the slider 132 in the occlusion direction 280 as shown in FIG. 10, the slider would occlude the fastening strips 130, 131 in the sequence shown in FIGS. 11–14. When the slider is in the locations shown in FIGS. 11–13, the webs 140, 150 of the fastening strips would usually be deoccluded as shown in FIGS. 6–8. In addition, the slider would be prevented from further movement in the occlusion direction 280 due to the seam 125 or when the slider contacts an end stop or is prevented from further movement by some other device. However, as noted above, the seam 125 causes the webs 140, 150 to be occluded at the locations in FIGS. 11–13 even when the slider is not present. Therefore, when the slider moves to the locations shown in FIGS. 11–13, the webs 140, 150 are already occluded and the shearing action of the slider is not able to deocclude the fastening strips due to the notch 278 and the occlusion effect of the seam 125. Thus, the webs 140, 150 remain occluded through the length of the fastening strips and establish a leak proof seal.

Figure 11:
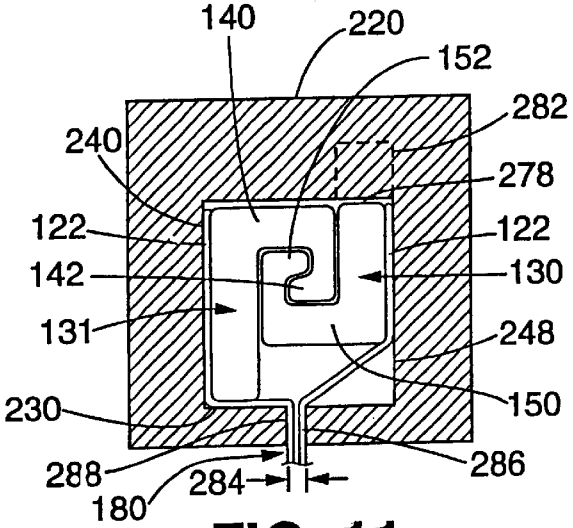
FIG. 11 is a cross-sectional view taken along line 11—11 in FIG. 10.
Figure 14:
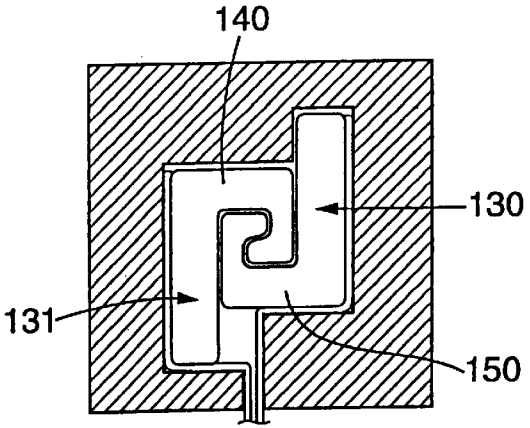
FIG. 14 is a cross-sectional view taken along line 14—14 in FIG. 10.
Figure 13:
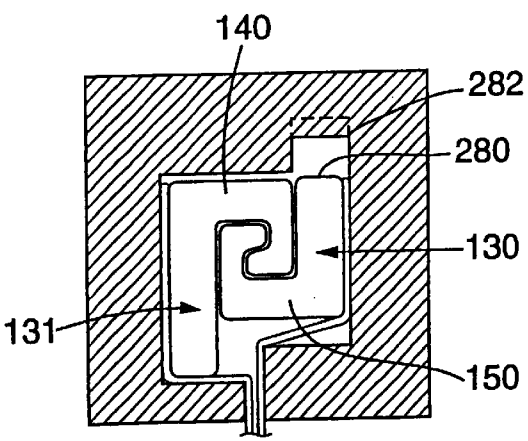
FIG. 13 is a cross-sectional view taken along line 13—13 in FIG. 10.

Another feature of the invention is that the slider may also provide an additional seal. Referring to FIG. 11, the slider 132 includes a slot 180 at the bottom of the slider and which extends along the length of the slider. The sidewalls 122 of the bag extend from the fastening strips 130, 131 and downward through the slot 180. The slot 180 includes a first face 286 and a second face 288 which are separated by a width 284. The width 284 is small enough to cause a seal between the sidewalls 122 near the location of the faces 286, 288 and large enough to allow the slider to move along the sidewalls 122 without making the slider too difficult to move. Thus, the slot 180 provides an additional seal along the length of the slider.

The slider is attached to the fastening strips so that the slider may move in the longitudinal X axis but not the transverse Y axis nor the vertical Z axis. Specifically, the slot 180 and the bottom portion 178 form shoulders which assist in retaining the slider 132 on the fastening strips 130, 131. Referring to FIG. 11, the inner surfaces 220, 230, 240, 248 enclose the fastening strips 130, 131. Furthermore, the width 284 of the slot 180 does not permit the passage of the fastening strips 130, 131. Therefore, a user should not be able to remove the slider 132 from the fastening strips 130, 131 by pulling in an upward direction with respect to FIG. 11. In addition, the sidewalls 122 and/or the fastening strips 130, 131 engage the inner surfaces 220, 230, 240, 248 and act as guides for the sliding movement of the slider 132 along the fastening strips.

Another feature of the invention is that the slider may be used without an additional end stop on the fastening strips. As noted above and as shown in FIGS. 11–13, the slider is prevented from further movement in the occlusion direction 280 if one of the fastening strips does not have a notch. Specifically, the occlusion of the fastening strips near the seam 125 prevents the freedom of movement in the fastening strips which the slider needs to move along the fastening strips. Thus, an interference fit occurs between the slider and the fastening strips. Consequently, the slider is prevented from further movement in the occlusion direction 280. A similar effect occurs at the other seam in the deocclusion direction 281. Therefore, the slider may be used without an additional end stop on the end of the fastening strips. However, the slider may be used with additional end stops, such as, the end stops shown in U.S. Pat. Nos. 5,067,208, 5,088,971, 5,131,121, 5,161,286, 5,189,764, 5,405,478, 5,442,837, 5,448,807 and 5,482,375, which are incorporated herein by reference.

The fastening strips and/or the slider may also include a structure to provide a home or parking position for the slider at the end of the fastening strips, such as, the structure shown in U.S. Pat. Nos. 5,067,208, 5,189,764, 5,301,394 and 5,301,395, which are incorporated herein by reference.

The fastening strips and the slider may also include other structure to accommodate the slider at the end of the fastening strips, such as, the slits and other means as shown in U.S. Pat. Nos. 5,020,194, 5,067,208, 5,088,971, 5,131, 121, 5,161,286, 5,301,394, 5,301,395 and 5,442,837, which are incorporated herein by reference. The structure may accommodate the separator finger and thus allow the webs 140, 150 to occlude near the end of the fastening strips.

The fastening strips and/or the sidewalls of the bag may also include flanges to allow the user to open the bag more easily and insert items in the bag. The flanges would extend above the webs and the slider would be increased in height to accommodate the flanges.

Figure 15B:
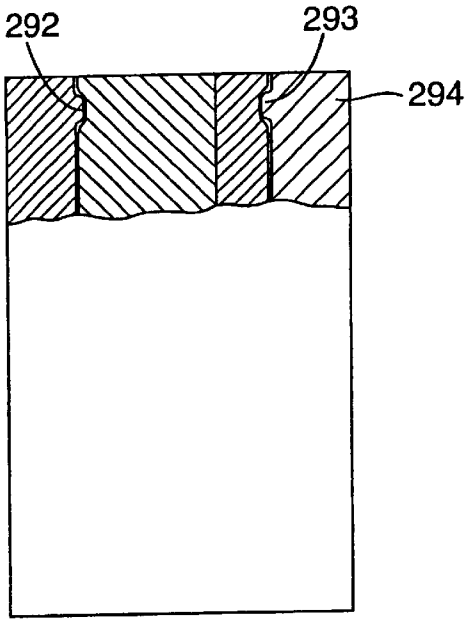
FIG. 15B is a cross-sectional view taken along line 15B—15B in FIG. 15A.
Figure 15A:
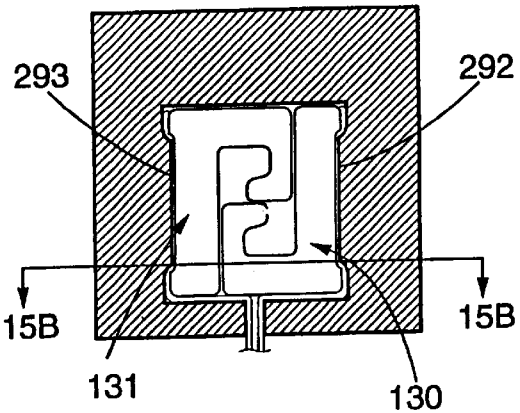
FIG. 15A is a cross-sectional view of another embodiment.

FIGS. 15A and 15B illustrate another embodiment of the slider. The slider includes one or two protrusions 292, 293 at or near the end 294 of the slider. The protrusions 292, 293 cause the fastening strips 130, 131 to move closer together and cause a seal between the contacting surfaces of the fastening strips. Thus, even though the fastening strips are deoccluded at the location in FIG. 15A, the protrusions 292, 293 cause a seal between the contacting surfaces of the fastening strips.

Figure 15C:
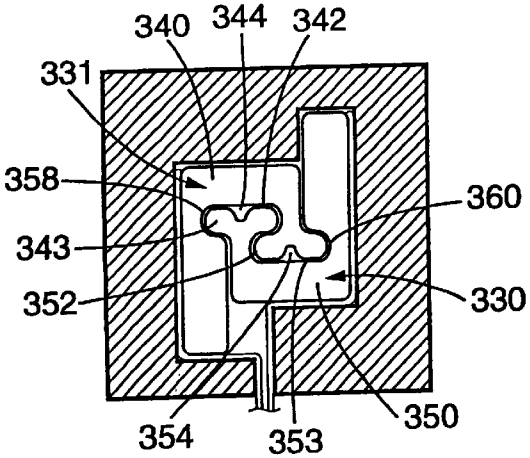
FIG. 15C is a cross-sectional view of another embodiment.

FIG. 15C illustrates another embodiment of the closure device of the present invention. In this embodiment, the closure device includes another type of closure portion. Referring to FIG. 15, the fastening strip 330 includes a web 350 similar to web 150 in FIG. 3 and the fastening strip 331 includes a web 340 similar to web 140 in FIG. 3. However, the closure portion 352 is different from the closure portion 152 in FIG. 3. Similarly, the closure portion 342 is different from the closure portion 142 in FIG. 3. The closure portions 342, 352 include an additional hook 343, 353 and a recess 344, 354 between the hooks, respectively. In addition, the base portions 338, 348 include an indentation 358, 360 to receive a portion of the hooks 343, 353 when the fastening strips are in the occluded position.

FIG. 15 shows the fastening strips 330, 331 in an occluded position. The occlusion and deocclusion of the fastening strips 330, 331 is similar to the occlusion and deocclusion of the fastening strips 130, 131 noted above.

FIGS. 16–24 illustrate another embodiment of the invention. This embodiment occludes and deoccludes in the Z axis by using a shearing action similar to other embodiments. In addition, this embodiment rotates one of the fastening strips and the webs deflect during occlusion and deocclusion. The fastening strips may be occluded and deoccluded manually or a slider may be used to facilitate occlusion and deocclusion.

Figure 16:
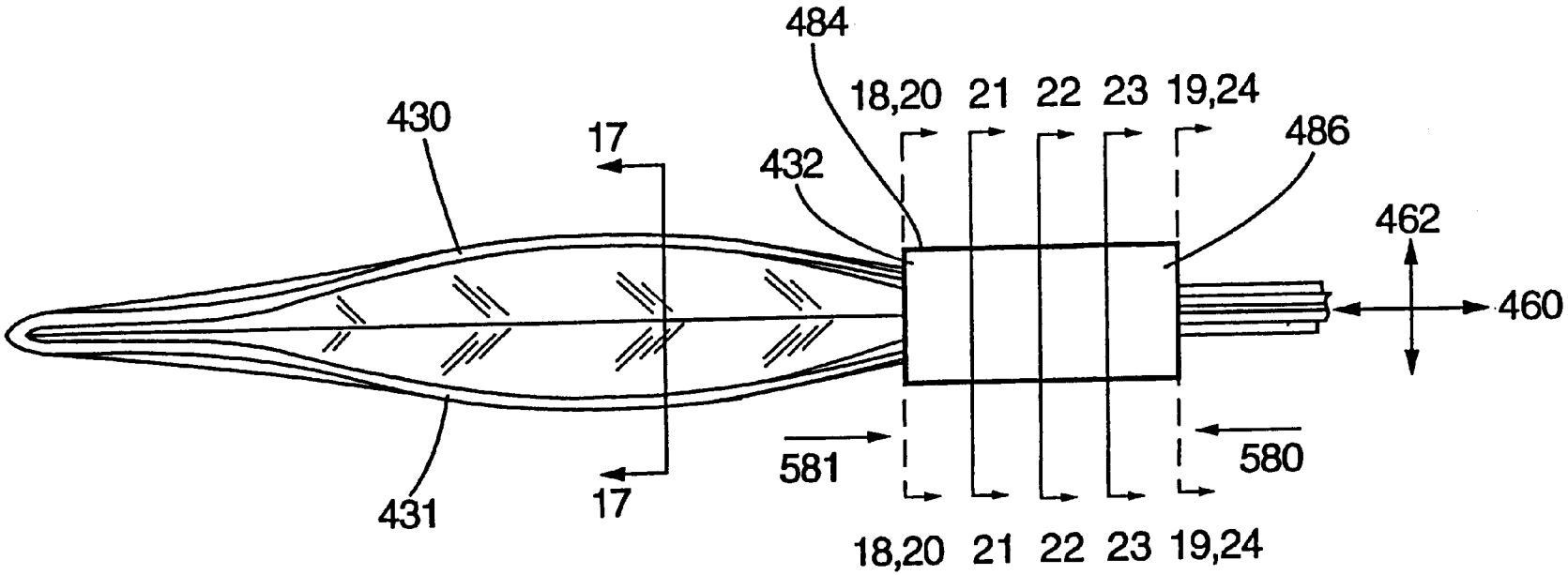
FIG. 16 is a top view of another embodiment of the invention.
Figure 17:
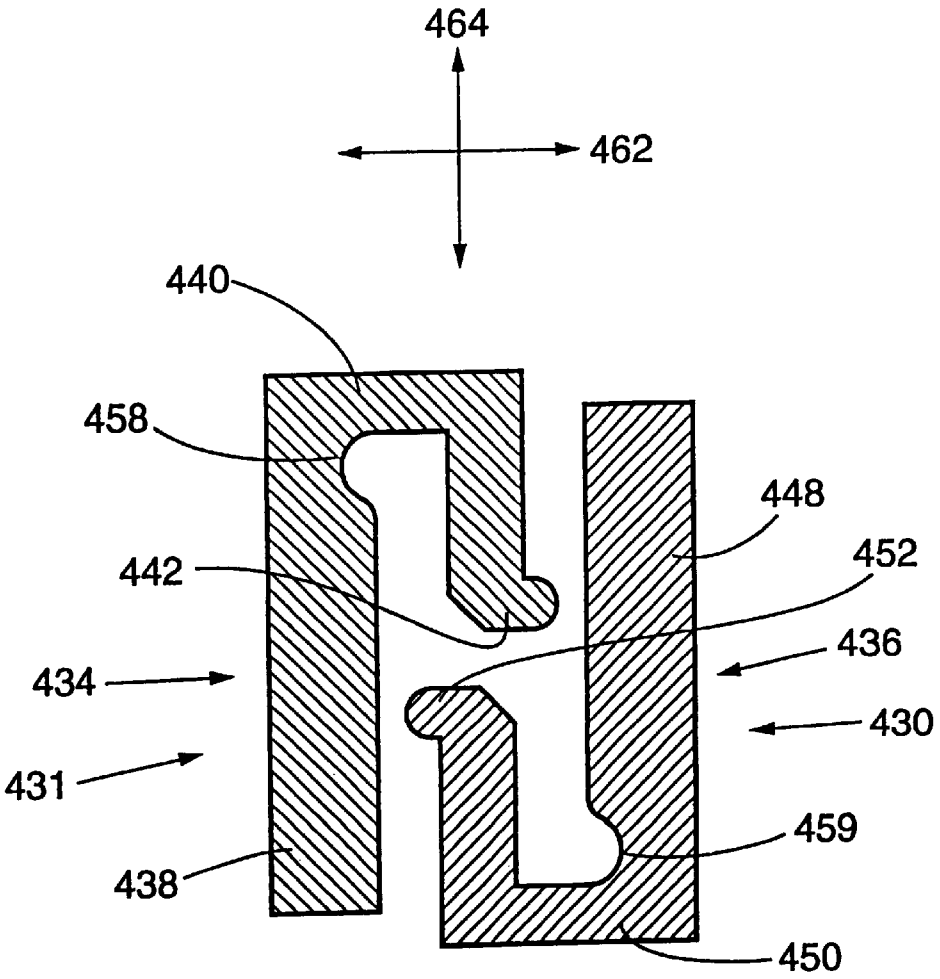
FIG. 17 is an enlarged partial cross-sectional view taken along line 17—17 in FIG. 16 of the fastening strips and without the bag sidewalls.

FIG. 16 shows a top view of the closure device. The closure device comprises first and second fastening strips 430, 431 and a slider 432. As shown in FIG. 17, the first fastening strip 431 includes a first closure element 434. The second fastening strip 430 comprises a second closure element 436 for engaging the first closure element 434.

The first closure element 434 comprises a base portion 438 and a web 440 extending from the base portion 438. The web 440 includes a hook portion 442 extending from the web 440. The base portion 438 includes an indentation 458.

The second closure element 436 comprises a base portion 448 and a web 450 extending from the base portion 448. The web 450 includes a hook portion 452 extending from the web 450. The base portion 448 includes an indentation 459.

Referring to FIGS. 16–17, the closure device and the fastening strips have an X axis 460, a Y axis 462 and a Z axis 464. The X axis 460 is the longitudinal axis of the closure device, the Y axis 462 is the lateral axis which is perpendicular to the X axis 460 and the Z axis 464 is the vertical axis which is perpendicular to the X axis 460 and the Y axis 462.

Figure 19:
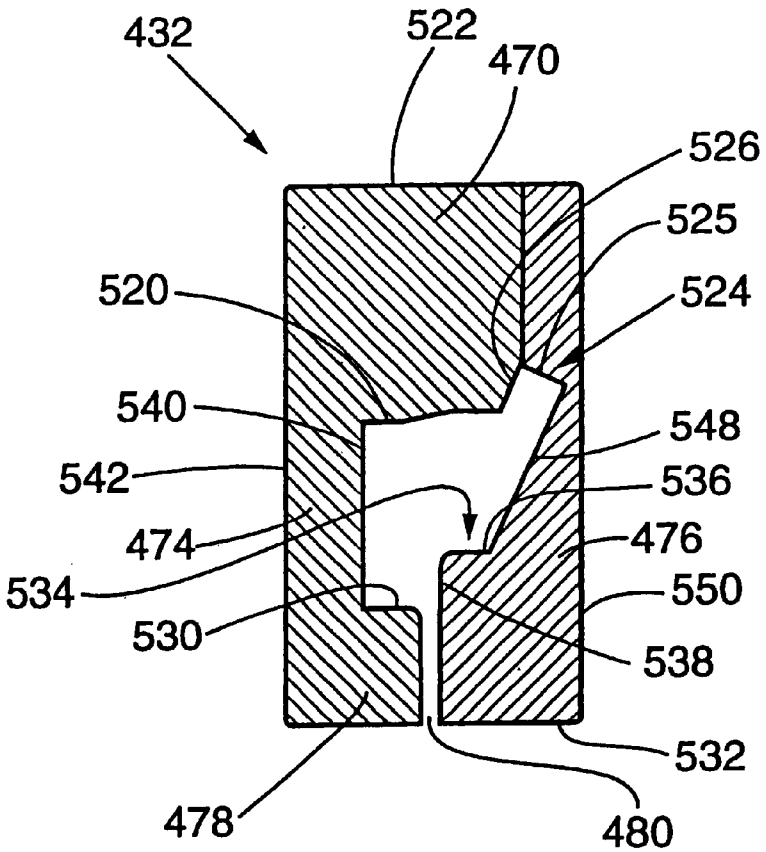
FIG. 19 is a cross-sectional view taken along line 19—19 in FIG. 16 of the slider and without the fastening strips.
Figure 18:
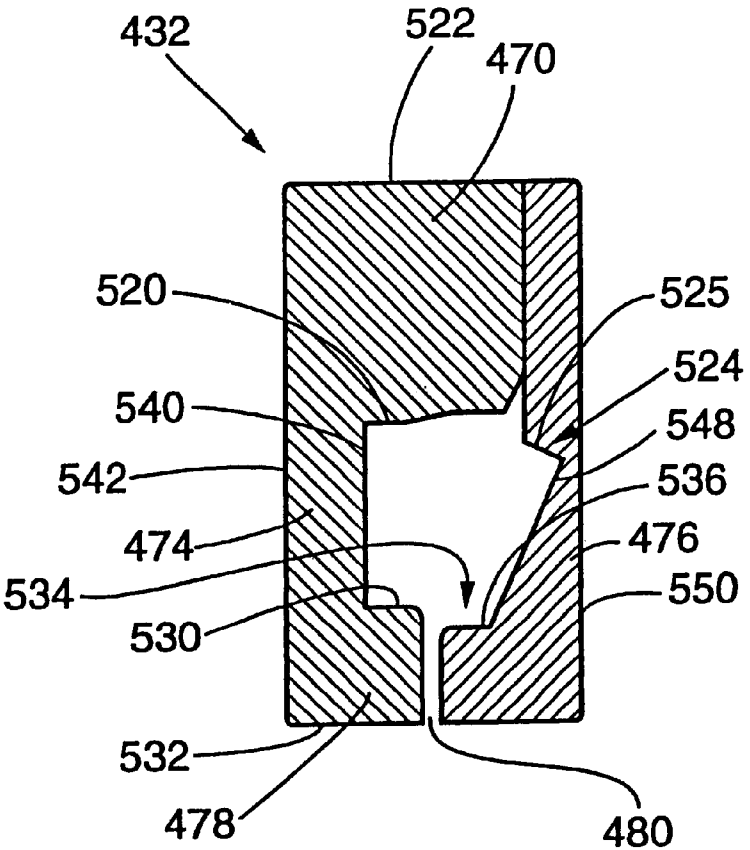
FIG. 18 is a cross-sectional view taken along line 18—18 in FIG. 16 of the slider and without the fastening strips.

Referring to FIGS. 18–19, the slider 432 includes a top portion 470, a first side portion 474, a second side portion 476, a bottom portion 478 and a slot 480. Referring to FIG. 16, the slider 432 has a first end 484 and a second end 486.

Returning to FIGS. 18 and 19, the top portion 470 has an inner surface 520 and an outer surface 522. The inner surface 520 includes an offset portion 524 which includes an upper surface 525 and an offset side surface 526. The offset portion 524 begins at the second end 486 and slopes downwards towards the first end 484.

The bottom portion 478 has an inner surface 530 and an outer surface 532. The inner surface 530 includes an offset portion 534 which includes an upper surface 536 and an offset side surface 538. The offset portion 534 begins at the second end 486 and slopes downward towards the first end 484.

The first side portion 474 has an inner surface 540 and an outer surface 542. The second side portion 476 has an inner surface 548 and an outer surface 550. The bottom portion 478 has a slot 480 which extends from the outer surface 532 to the inner surface 530. In addition, the slot extends from the first end 484 to the second end 486 of the slider. The slot has substantially the same width from the first end 484 to the second end 486 of the slider.

The slider may be a one piece construction or may include several separate pieces which are assembled in several different ways.

FIGS. 20–24 illustrate occlusion and deocclusion of the closure device. When FIGS. 20–24 are viewed in numerical sequence, FIGS. 20–24 illustrate occlusion of the fastening strips. When FIGS. 20–24 are viewed in reverse numerical sequence (i.e. viewed from FIG. 24 backwards to FIG. 20), FIGS. 20–24 illustrate deocclusion of the fastening strips.

Figure 20:
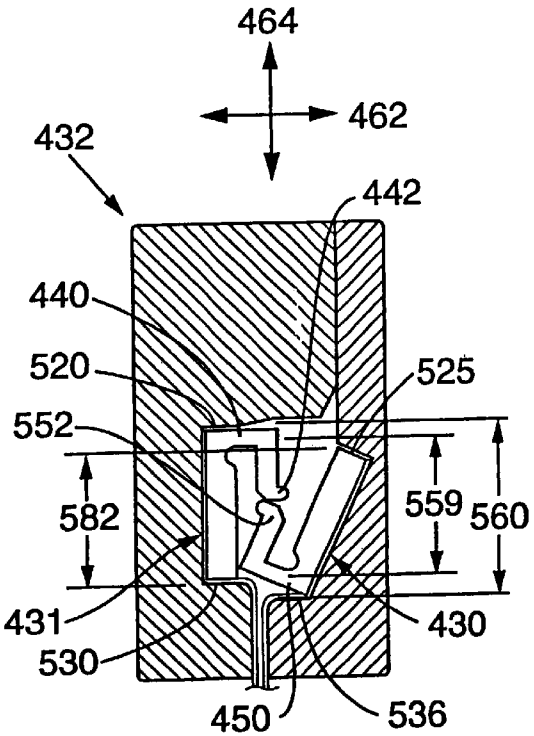
FIG. 20 is a cross-sectional view taken along line 20—20 in FIG. 16.

The occlusion of the fastening strips will be described and then the deocclusion of the fastening strips will be described. The slider 432 facilitates the occlusion of the fastening strips 430, 431 by moving the fastening strips towards each other in a shear direction or Z axis direction and causing the webs to engage. Referring to FIG. 16, the slider 432 is moved in the occlusion direction 580 and the fastening strips 430, 431 enter the slider 432 as shown in FIG. 20. Referring to FIG. 20, the fastening strips 430, 431 are deoccluded and the web 440 and web 450 are separated by a distance 559. In addition, the upper surface 536 of the bottom portion and inner surface 520 of the top portion are separated by a distance 560. Furthermore, the fastening strip 430 has been rotated at an angle to the Z axis 464.

Figure 21:
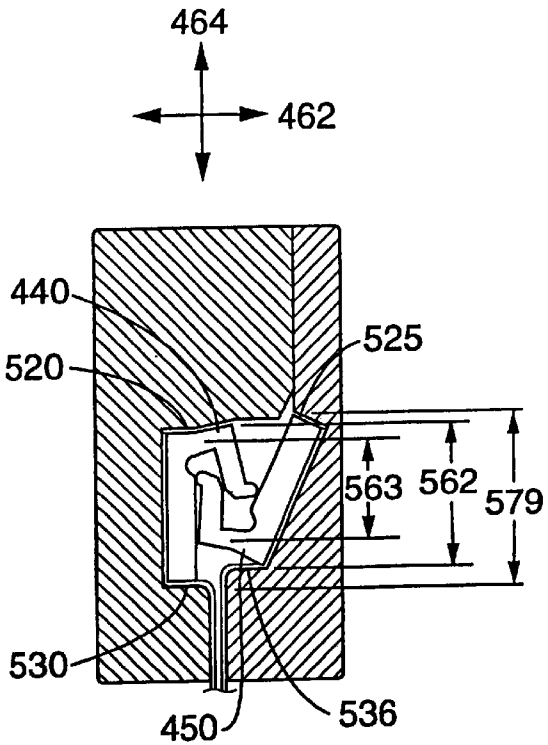
FIG. 21 is a cross-sectional view taken along line 21—21 in FIG. 16.

With respect to FIG. 21, as the slider is moved further along the fastening strips in the occlusion direction 580 as shown in FIG. 16, the slider causes the fastening strips to move closer together in a shear direction or Z axis 464 as shown in FIG. 21. Referring to FIG. 21, the fastening strips 430, 431 are deoccluded. However, the upper surface 536 and the inner surface 520 are closer together than in FIG. 20 and are separated by a distance 562 which is less than distance 560 in FIG. 20. Due to the reduction in distance, the upper surface 536 and the inner surface 520 cause the fastening strips to move closer together in the Z axis 464. Thus, the webs 440, 450 are separated by a distance 563 which is less than the distance 559 in FIG. 20. In addition, the webs 440, 450 begin to deflect in order to allow the hooks to pass each other and engage when the fastening strips are occluded.

Figure 22:
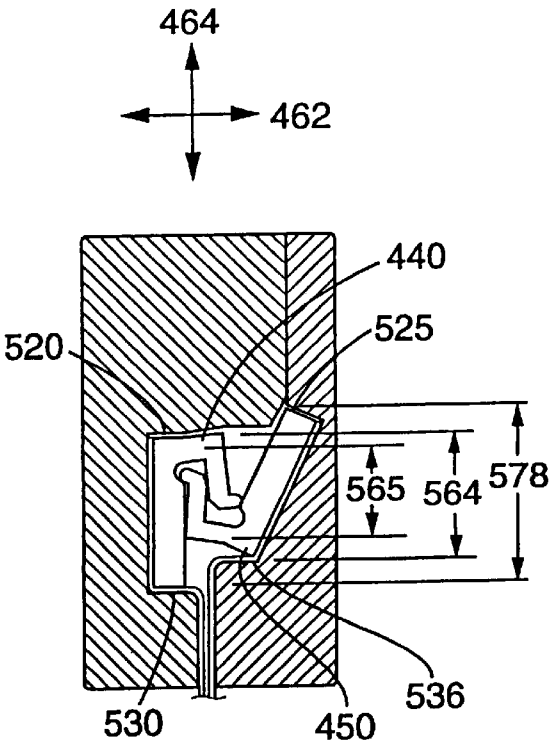
FIG. 22 is a cross-sectional view taken along line 22—22 in FIG. 16.
Figure 24:
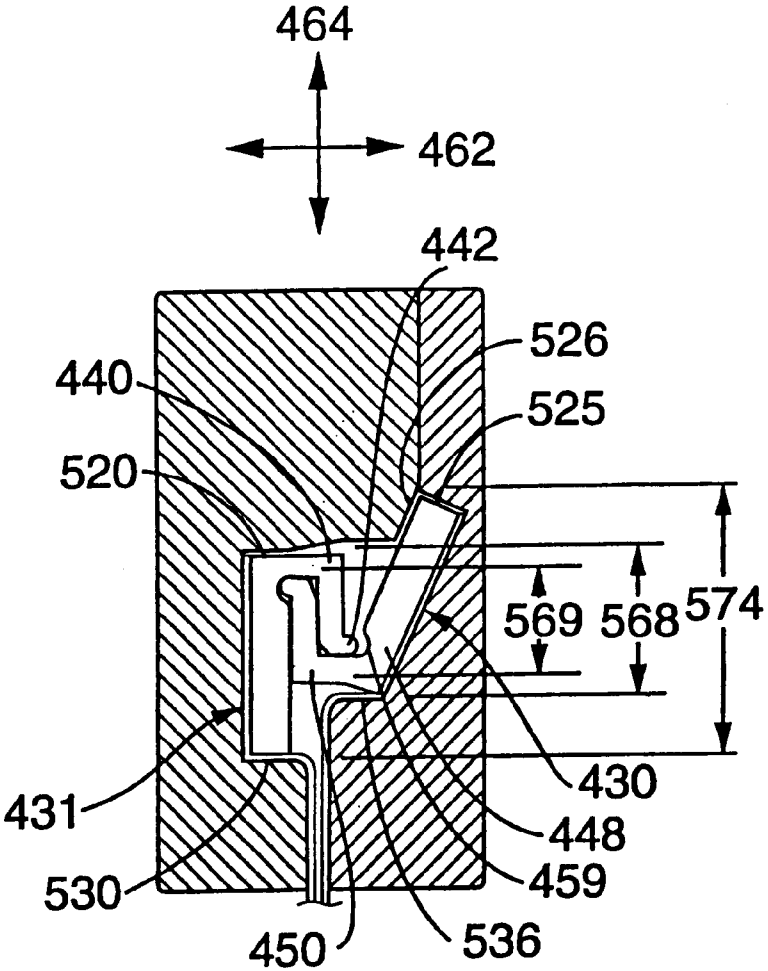
FIG. 24 is a cross-sectional view taken along line 24—24 in FIG. 16.
Figure 23:
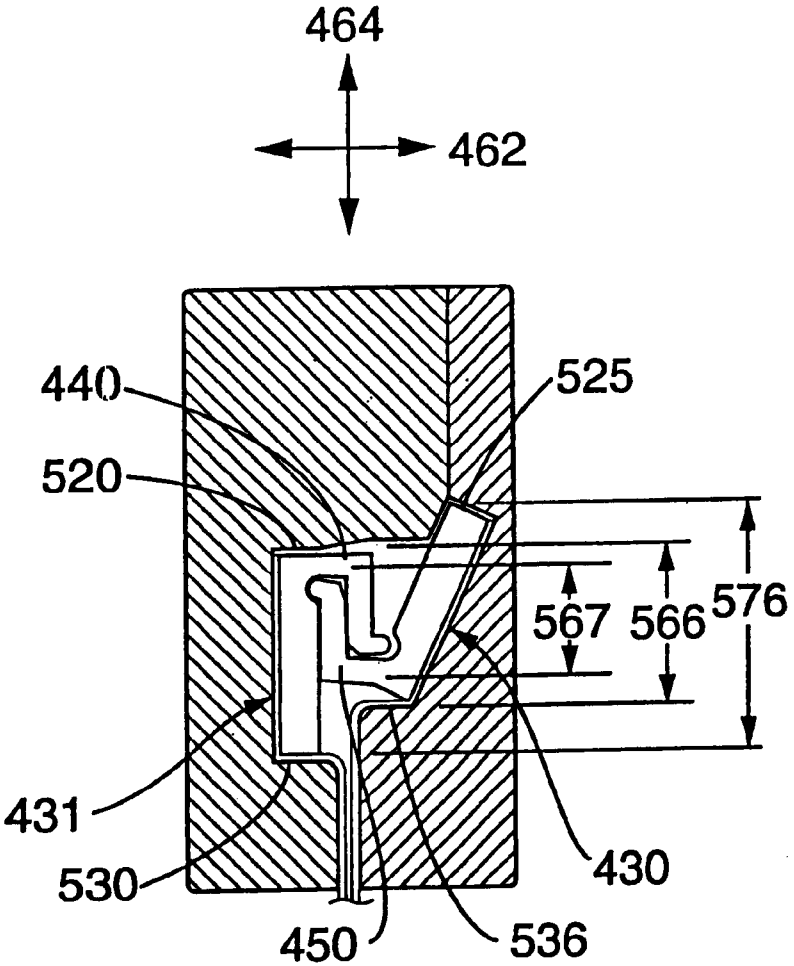
FIG. 23 is a cross-sectional view taken along line 23—23 in FIG. 16.

With respect to FIGS. 20–24, the positions of the fastening strips are effected not only by the forces acting upon them by the slider at that location but are also effected by the position of the fastening strips at locations before and after that location. For example, the positions of the fastening strips in FIG. 21 are effected by the positions of the fastening strips in FIGS. 20 and 22. Referring to FIG. 21, the fastening strip 430 is at an angle to the Z axis 464. However, at this location the slider 432 is not applying forces to the fastening strip 430 to cause the angular position of the fastening strip 430 at this location. The fastening strip 430 is at this angle because the fastening strip is continuous and the portions of the fastening strip 430 in FIGS. 22–24 are acting upon the portion of the fastening strip 430 in FIG. 21.

The amount of effect that the position of fastening strips from one location has upon the position of the fastening strips in another location depends upon several factors, such as, the structure of the fastening strips and the material from which the fastening strips are made. For example, if the fastening strips are relatively thick, then the effect at other locations would be greater than if the fastening strips were relatively thin. As another example, if the material for the fastening strips is relatively rigid, then the effect at other locations would be greater than if the material was relatively flexible.

With respect to FIG. 22, as the slider continues to move along the fastening strips in the occlusion direction 580 as shown in FIG. 16, the slider continues to cause the fastening strips to move closer together in the Z axis 464 as shown in FIG. 22. In FIG. 22, the upper surface 536 and the inner surface 520 are closer together than in FIG. 21 and are separated by a distance 564 which is less than distance 562 in FIG. 21. The surfaces 520, 536 are applying forces to the fastening strips which causes the fastening strips to move closer together in the Z axis 464. The webs 440, 450 are separated by a distance 565 which is less than the distance 563 in FIG. 21. In addition, the webs 440, 450 in FIG. 22 have deflected more in comparison to FIG. 21 in order to allow the hooks to pass each other and engage when the fastening strips are occluded.

With respect to FIG. 23, as the slider continues to move along the fastening strips in the occlusion direction 580 as shown in FIG. 16, the slider continues to cause the fastening strips to move closer together in the Z axis 464 as shown in FIG. 23. In FIG. 23, the upper surface 536 and the inner surface 520 are closer together than in FIG. 22 and are separated by a distance 566 which is less than distance 564 in FIG. 22. The surfaces 520, 536 are applying forces to the fastening strips which causes the fastening strips to move closer together in the Z axis. 464. The webs 440, 450 are separated by a distance 567 which is less than the distance 565 in FIG. 22. In addition, the web 450 in FIG. 23 has deflected more in comparison to FIG. 22. However, the web. 440 is no longer deflected and returned to its previous relaxed position as in FIG. 20.

With respect to FIG. 24, as the slider continues to move along the fastening strips in the occlusion direction 580, the slider continues to cause the fastening strips to move closer together in the Z axis 464 as shown in FIG. 24. Referring to FIG. 24, the fastening strips 430, 431 are occluded. Specifically, the webs 440, 450 are occluded and the hooks 442, 452 have engaged each other. In addition, the hooks have engaged the indentations 458, 459. The surfaces 520, 536 are closer together in FIG. 24 as compared to FIG. 23 and are separated by a distance 568 which is less than distance 566 in FIG. 23. The surfaces 520, 536 apply forces to the fastening strips which causes the fastening strips to move closer together in the Z axis 464. The webs 440, 450 are separated by a distance 569 which is less than the distance 567 in FIG. 23. Thus, as shown in FIG. 24, the fastening strips 430, 431 are occluded prior to exiting the slider.

The deocclusion of the fastening strips 430, 431 in FIGS. 20–24 would occur in the reverse order of these figures. Thus, deocclusion is illustrated by beginning at FIG. 24 and moving n reverse order toward FIG. 20. The slider 432 facilitates the deocclusion of the fastening strips 430, 431 by moving the fastening strips away from each other in the Z axis 464 and causing the webs to disengage. Referring to the FIG. 16, the slider 432 is moved in the deocclusion direction 581 and the fastening strips 430, 431 enter the slider 432 as shown in FIG. 24. Referring to FIG. 24, the fastening strips 430, 431 are occluded as they enter the slider 432. The surfaces 525, 530 are separated by a distance 574 and the webs 440, 450 are separated by a distance 569.

In addition, the slider causes the fastening strip 430 to rotate at an angle to the Z axis 464. Specifically, the fastening strip 430 engages the side surface 526 which applies a force to the fastening strip 430 and causes the fastening strip 430 to rotate. The rotation of the fastening strip facilitates the deocclusion of the fastening strips. Specifically, the rotation assists the hook 442 to disengage the indentation 459. As shown in FIG. 24, the web 450 deflects or flexes and allows the base 448 to rotate at an angle to the Z axis 464.

With respect to FIG. 23, as the slider continues to move along the fastening strips in the deocclusion direction 581, the slider causes the fastening strips to move away from each other in the Z axis 464 as shown in FIG. 23. Referring to FIG. 23, the surfaces 525, 530 are separated by a distance 576 which is less than the distance 574 in FIG. 24. Due to the reduction in distance, the surfaces 525, 530 cause the fastening strips to move away from each other in the Z axis 464. In addition, the web 450 continues to deflect in order to allow the hooks to pass each other and disengage when the fastening strips are deoccluded.

Furthermore, as noted above; the positions of the fastening strips are effected not only by the forces acting upon them by the slider at that specific location, but are also effected by the position of the fastening strips at locations before and after that specific location. In this case, the fastening strips 430, 431 are being urged against the surfaces 525, 530 due to the shearing action of the surfaces 525, 530 as shown in FIGS. 20–22.

With respect to FIG. 22, as the slider continues to move along the fastening strips in the deocclusion direction 581 as shown in FIG. 16, the slider continues to cause the fastening strips to move away from each other in the Z axis 464 as shown in FIG. 22. Referring to FIG. 22, the surfaces 525, 530 are separated by a distance 578 which is less than the distance 576 in FIG. 23. The surfaces 525, 530 are applying shear forces to the fastening strips which causes the fastening strips to move away from each other in the Z axis 464. The fastening strips separate due to the shearing action between the fastening strips. Consequently, the webs 440, 450 are separated by a distance 565 which is greater than the distance 567 in FIG. 23. In addition, the web 450 in FIG. 22 deflects more in comparison to FIG. 23. Also, the web 440 begins to deflect in order to allow the hooks to pass each other and disengage.

With respect to ° FIG. 21, as the slider continues to move along the fastening strips in the deocclusion direction 581 as shown in FIG. 16, the slider continues to cause the fastening strips to move away from each other in the Z axis 464 as shown in FIG. 21. Referring to FIG. 21, the surfaces 525, 530 are separated by a distance 579 which is less than the distance 578 in FIG. 22. The surfaces 525, 530 are applying shear forces to the fastening strips which causes the fastening strips to move away from each other in the Z axis 464. The fastening strips separate due to the shearing action between the fastening strips. Consequently, the webs 440, 450 are separated by a distance 563 which is greater than the distance 565 in FIG. 22. In addition, the webs 440, 450 continue to deflect in order to allow the hooks to pass each other.

With respect to FIG. 20, as the slider continues to move along the fastening strips in the deocclusion direction 581, the slider continues to cause the fastening strips to move away from each other in the Z axis 464 as shown in FIG. 20. Referring to FIG. 20, the fastening strips 430, 431, and thus the webs 440, 450 have deoccluded. The surfaces 525, 530 are separated by a distance 582 which is less than the distance 579 in FIG. 21. The surfaces 525, 530 are applying shear forces to the fastening strips which causes the fastening strips to move away from each other in the Z axis 464. The fastening strips deocclude due to the shearing action between the fastening strips. Thus, the webs 440, 450 are separated by a distance 559 which is greater than the distance 563 in FIG. 21. Also, the hooks 442, 452 in FIG. 20 have disengaged. As shown in FIG. 20, the webs 440, 450 of the fastening strips 430, 431 are deoccluded when the fastening strips exit the slider 432.

As noted above, the closure device may include other features. For example, the closure device may include a notch near the seam to assist the leakproof seal. The slider may also include an additional seal at the slot. The closure device may also have an end stop. Furthermore, the closure device may have a structure for a home or parking position. In addition, the closure device may include other structures to accommodate the slider at the end of the fastening strips, such as, slits or other means.

FIGS. 25–36 illustrate another embodiment of the invention. This embodiment occludes and deoccludes in the Z axis by using a shearing action similar to other embodiments. In addition, this embodiment moves the fastening strips in the Y axis and the webs deflect during occlusion and deocclusion. The fastening strips may be occluded and deoccluded manually or a slider may be used to facilitate occlusion and deocclusion.

Figure 25:
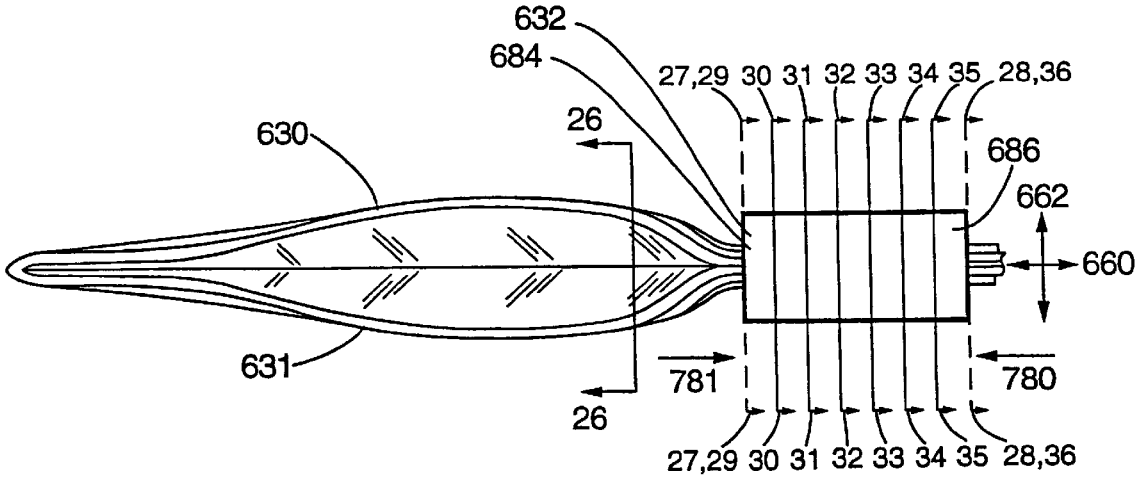
FIG. 25 is a partial top view of another embodiment of the invention.
Figure 26:
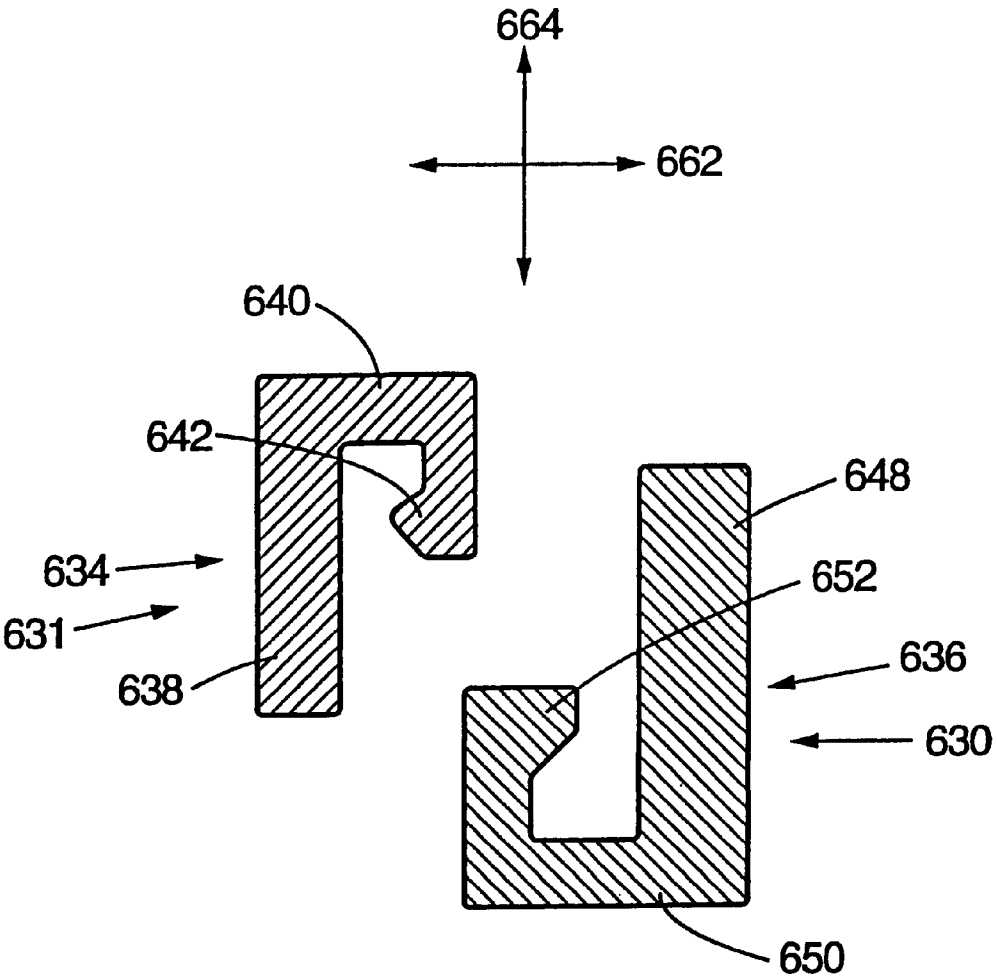
FIG. 26 is an enlarged cross-sectional view taken along line 26—26 in FIG. 25 of the fastening strips and without the bag sidewalls.

FIG. 25 shows a top view of the closure device. The closure device comprises first and second fastening strips 630, 631 and a slider 632. As shown in FIG. 26, the first fastening strip 631 includes a first closure element 634. The second fastening strip 630 comprises a second closure element 636 for engaging the first closure element 634.

The first closure element 634 comprises a base portion 638 and a web 640 extending from the base portion 638. The web 640 includes a hook portion 642 extending from the web 640.

The second closure element 636 comprises a base portion 648 and a web 650 extending from the base portion 648. The web 650 includes hook portion 652 extending from the web 650.

Referring to FIGS. 25–26 the closure device and the fastening strips have an X axis 660, a Y axis 662 and a Z axis 664. The X axis 660 is the longitudinal axis of the closure device, the Y axis 662 is the lateral axis which is perpendicular to the X axis 660 and the Z axis 664 is the vertical axis which is perpendicular to the X axis 660 and the Y axis 662.

Figure 28:
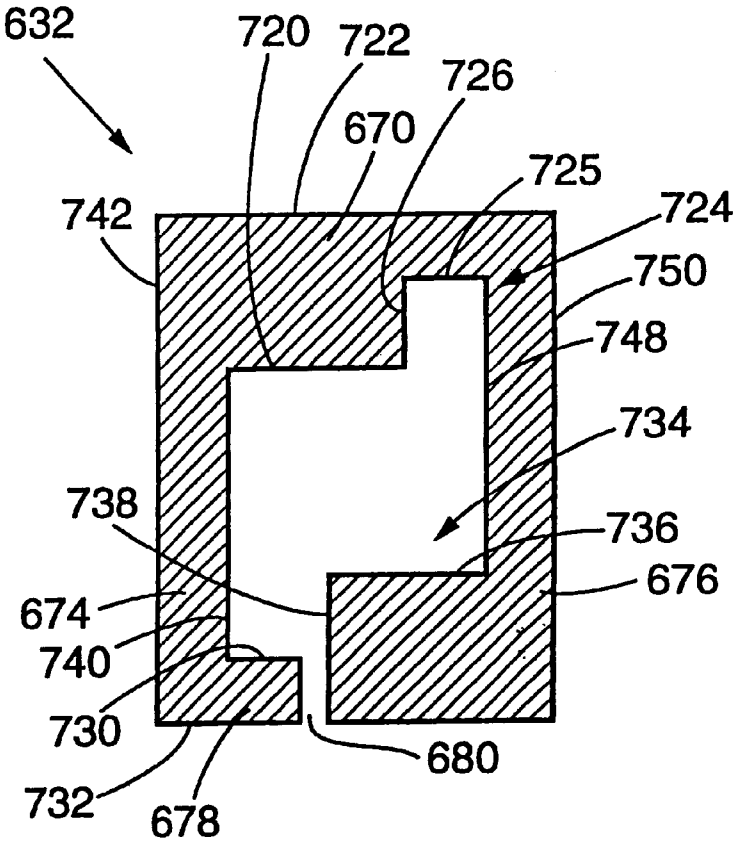
FIG. 28 is a cross-sectional view taken along line 28—28 in FIG. 25 of the slider and without the fastening strips.
Figure 27:
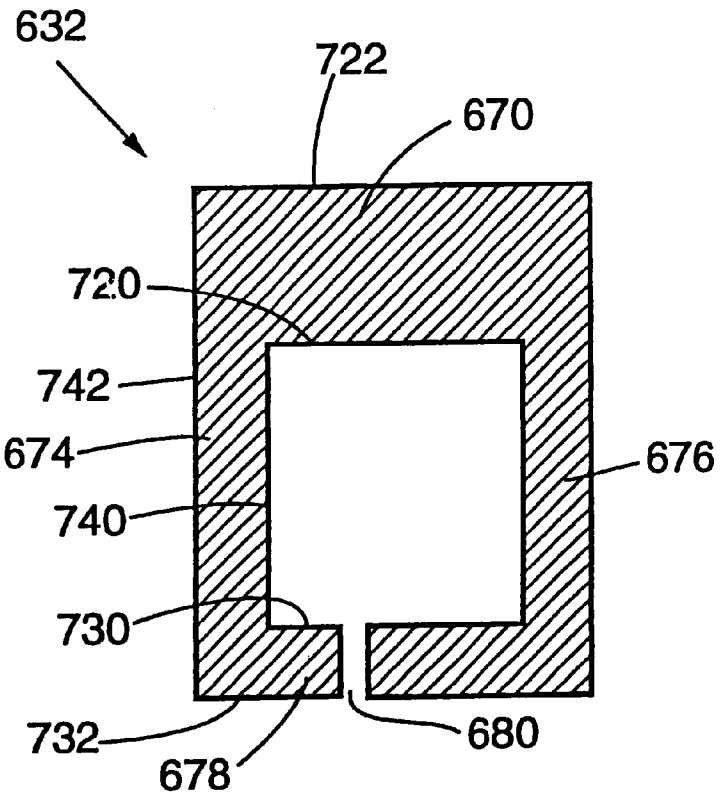
FIG. 27 is a cross-sectional view taken along line 27—27 in FIG. 25 of the slider and without the fastening strips.

Referring to FIGS. 27–28, the slider 632 includes a top portion 670, a first side portion 674, a second side portion 676, a bottom portion 678 and a slot 680. Referring to FIG. 25, the slider 632 has a first end 684 and a second end 686.

Returning to FIGS. 27 and 28, the top portion 670 has an inner surface 720 and an outer surface 722. The inner surface 720 includes an offset portion 724 which includes an upper surface 725 and an offset side surface 726. The offset portion 724 begins at the second end 686 and slopes downwards towards the first end 684.

The bottom portion 678 has an inner surface 730 and an outer surface 732. The inner surface 730 includes an offset portion 734 which includes an upper surface 736 and an offset side surface 738. The offset portion 734 begins at the second end 686 and slopes downward towards the first end 684.

The first side portion 674 has an inner surface 740 and an outer surface 742. The second side portion 676 has an inner surface 748 and an outer surface 750. The bottom portion 678 has a slot 680 which extends from the outer surface 732 to the inner surface 730. In addition, the slot extends from the first end 684 to the second end 686 of the slider. The slot has substantially the same width from the first end 684 to the second end 686 of the slider.

The slider may be a one piece construction or may include several separate pieces which are assembled in several different ways.

FIGS. 29–36 illustrate occlusion and deocclusion of the closure device. When FIGS. 29–36 are viewed in numerical sequence, FIGS. 29–36 illustrate occlusion of the fastening strips. When FIGS. 29–36 are viewed in reverse numerical sequence (i.e. viewed from FIG. 36 backwards to FIG. 29), FIGS. 29–36 illustrate deocclusion of the fastening strips.

Figure 29:
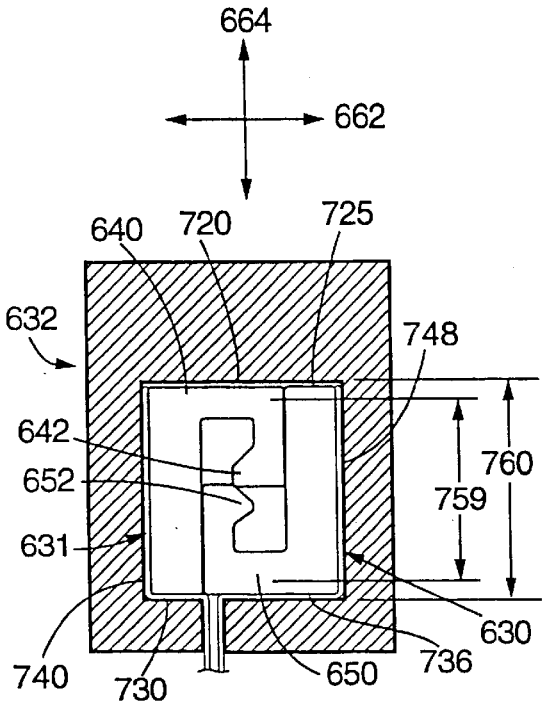
FIG. 29 is a cross-sectional view taken along line 29—29 in FIG. 25.

The occlusion of the fastening strips will be described and then the deocclusion of the fastening strips will be described. The slider 632 facilitates the occlusion of the fastening strips 630, 631 by moving the fastening strips towards each other in a shear direction or Z axis direction and causing the webs to engage. Referring to FIG. 25, the slider 632 is moved in the occlusion direction 780 and the fastening strips 630, 631 enter the slider 632 as shown in FIG. 29. Referring to FIG. 29, the fastening strips 630, 631 are deoccluded and the web 640 and web 650 are separated by a distance 759. In addition, the upper surface 736 of the bottom portion and inner surface 720 of the top portion are separated by a distance 760.

Figure 30:
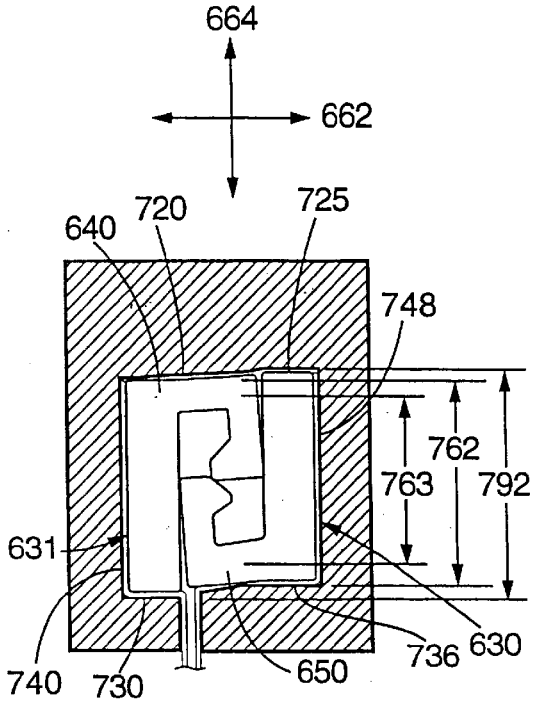
FIG. 30 is a cross-sectional view taken along line 30—30 in FIG. 25.

As the slider is moved further along the fastening strips in the occlusion direction 780 as shown in FIG. 25, the slider causes the fastening strips to move closer together in a shear direction or Z axis 664 as shown in FIG. 30. Referring to FIG. 30, the fastening strips 630, 631 are deoccluded. However, the upper surface 736 and the inner surface 720 are closer together than in FIG. 29 and are separated by a distance 762 which is less than distance 760 in FIG. 29. Due to the reduction in distance, the upper surface 736 and the inner surface 720 cause the fastening strips to move closer together in the Z axis 664. Thus, the webs 640, 650 are separated by a distance 763 which is less than the distance 759 in FIG. 29. In addition, the webs 640, 650 begin to deflect in order to allow the hooks to pass each other and engage when the fastening strips are occluded. The distance between the surfaces 740, 748 in the Y axis 662 is greater than the distance in FIG. 29 to accommodate the deflection of the webs 640, 650.

With respect to FIGS. 29–36, the positions of the fastening strips are effected not only by the forces acting upon them by the slider at that location but are also effected by the position of the fastening strips at locations before and after that location. For example, the positions of the fastening strips in FIG. 30 are effected by the positions of the fastening strips in FIGS. 29 and 31.

The amount of effect that the position of fastening strips from one location has upon the position of the fastening strips in another location depends upon several factors, such as, the structure of the fastening strips and the material from which the fastening strips are made. For example, if the fastening strips are relatively thick, then the effect at other locations would be greater than if the fastening strips were relatively thin. As another example, if the material for the fastening strips is relatively rigid, then the effect at other locations would be greater than if the material was relatively flexible.

Figure 31:
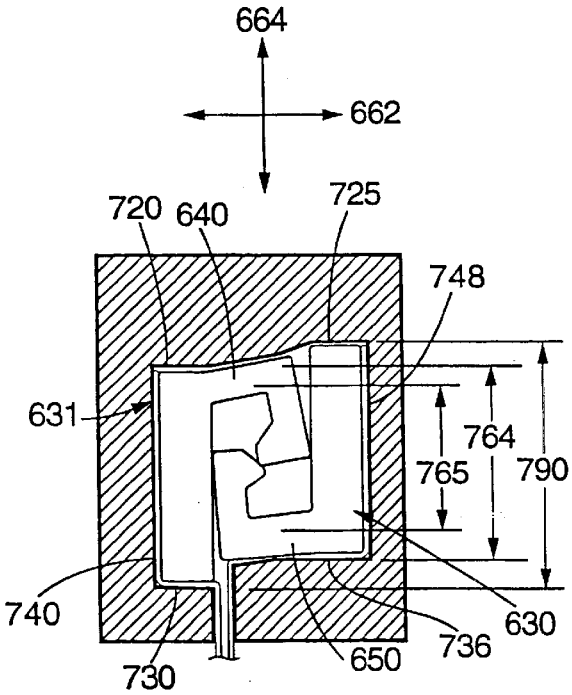
FIG. 31 is a cross-sectional view taken along line 31—31 in FIG. 25.

With respect to FIG. 31, as the slider continues to move along the fastening strips in the occlusion direction 780 as shown in FIG. 25, the slider continues to cause the fastening strips to move closer together in the Z axis 664 as shown in FIG. 31. In FIG. 31, the upper surface 756 and the inner surface 720 are closer together than in FIG. 30 and are separated by a distance 764 which is less than distance 762 in FIG. 30. The surfaces 720, 736 are applying forces to the fastening strips which causes the fastening strips to move closer together in the Z axis 664. The webs 640, 650 are closer together than in FIG. 30 and are separated by a distance 765 which is less than the distance 763 in FIG. 30. In addition, the webs 640, 650 in FIG. 31 have deflected more in comparison to FIG. 30 in order to allow the hooks to pass each other and engage when the fastening strips are occluded. The distance between the surfaces 740, 748 in the Y axis 662 is greater than the distance in FIG. 30 to accommodate the deflection of the webs 640, 650.

Figure 32:
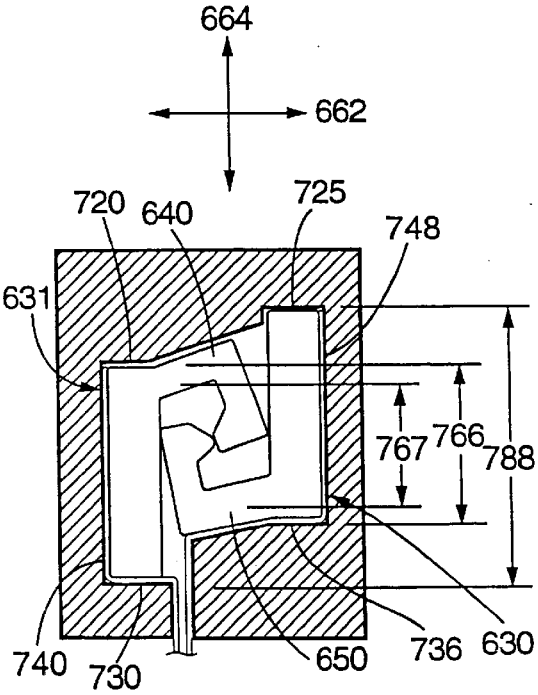
FIG. 32 is a cross-sectional view taken along line 32—32 in FIG. 25.

With respect to FIG. 32, as the slider continues to move along the fastening strips in the occlusion direction 780 as shown in FIG. 25, the slider continues to cause the fastening strips to move closer together in the Z axis 664 as shown in FIG. 32. In FIG. 32, the upper surface 736 and the inner surface 720 are closer together than in FIG. 31 and are separated by a distance 766 which is less than distance 764 in FIG. 31. The surfaces 720, 736 are applying forces to the fastening strips which causes the fastening strips to move closer together in the Z axis 664. The webs 640, 650 are closer together than in FIG. 31 and are separated by a distance 767 which is less than the distance 765 in FIG. 31. In addition, the webs 640, 650 in FIG. 32 have deflected more in comparison to FIG. 31 in order to allow the hooks to pass each other and engage when the fastening strips are occluded. The distance between the surfaces 740, 748 in the Y axis 662 is greater than the distance in FIG. 31 to accommodate the deflection of the webs 640, 650.

Figure 33:
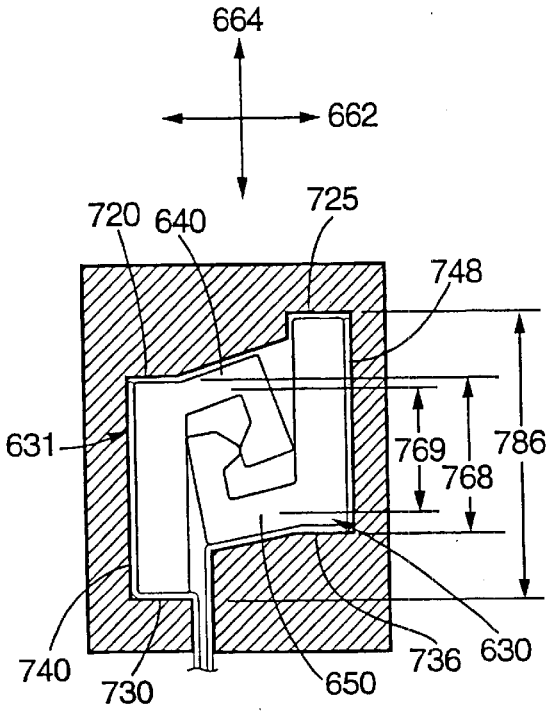
FIG. 33 is a cross-sectional view taken along line 33—33 in FIG. 25.

With respect to FIG. 33, as the slider continues to move along the fastening strips in the occlusion direction 780 as shown in FIG. 25, the slider continues to cause the fastening strips to move closer together in the Z axis 664 as shown in FIG. 33. In FIG. 33, the upper surface 736 and the inner surface 720 are closer together than in FIG. 32 and are separated by a distance 768 which is less than distance 766 in FIG. 32. The surfaces 720, 736 are applying forces to the fastening strips which causes the fastening strips to move closer together in the Z axis 664. The webs 640, 650 are closer together than in FIG. 32 and are separated by a distance 769 which is less than the distance 767 in FIG. 32. In addition, the webs 640, 650 in FIG. 33 have deflected more in comparison to FIG. 32 in order to allow the hooks to pass each other and engage when the fastening strips are occluded. The distance between the surfaces 740, 748 in the Y axis 662 is greater than or equal to the distance in FIG. 32 to accommodate the deflection of the webs 640, 650.

Figure 34:
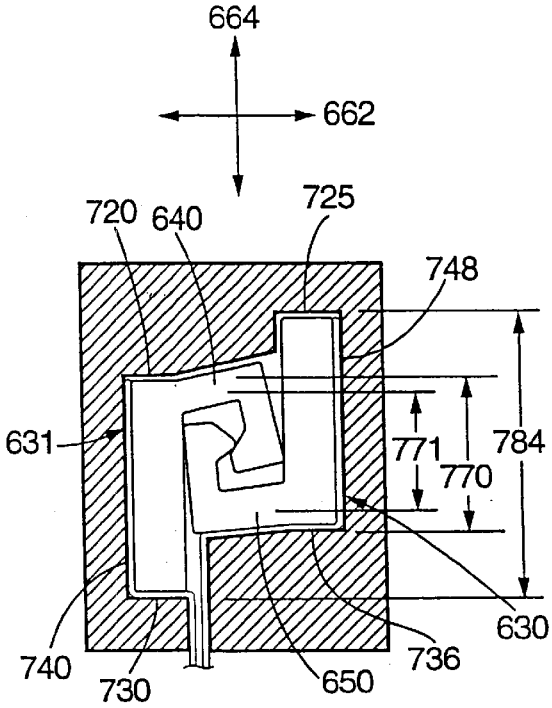
FIG. 34 is a cross-sectional view taken along line 34—34 in FIG. 25.

With respect to FIG. 34, as the slider continues to move along the fastening strips in the occlusion direction 780 as shown in FIG. 25, the slider continues to cause the fastening strips to move closer together in the Z axis 664 as shown in FIG. 34. In FIG. 34, the upper surface 736 and the inner surface 720 are closer together than in FIG. 33 and are separated by a distance 770 which is less than distance 768 in FIG. 33. The surfaces 720, 736 are applying forces to the fastening strips which causes the fastening strips to move closer together in the Z axis 664. The webs 640, 650 are separated by a distance 771 which is less than the distance 769 in FIG. 33. In addition, the webs 640, 650 in FIG. 34 have deflected approximately the same amount in comparison to FIG. 33 in order to allow the hooks to pass each other and engage when the fastening strips are occluded. The distance between the surfaces 740, 748 in the Y axis is less than previous figure and accommodates the deflection of the webs.

Figure 35:
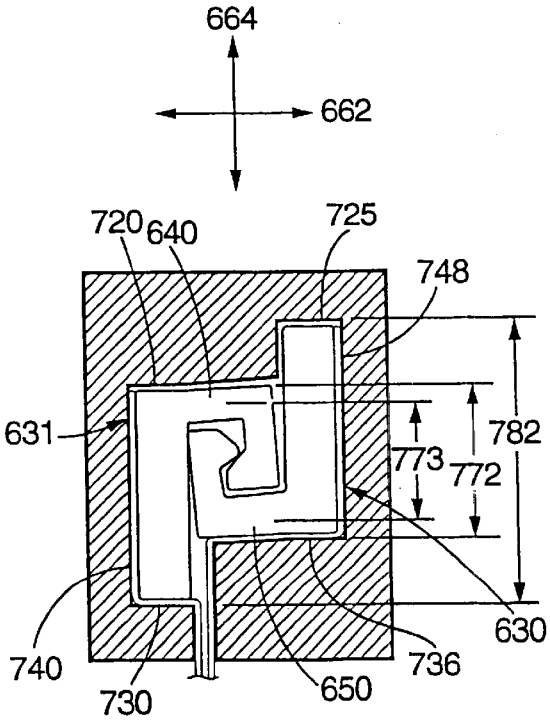
FIG. 35 is a cross-sectional view taken along line 35—35 in FIG. 25.

With respect to FIG. 35, as the slider continues to move along the fastening strips in the occlusion direction 780 as shown in FIG. 25, the slider continues to cause the fastening strips to move closer together in the Z axis 664 as shown in FIG. 35. In FIG. 35, the upper surface 736 and the inner surface 720 are closer together than in FIG. 34 and are separated by a distance 772 which is less than distance 770 in FIG. 34. The surfaces 720, 736 are applying forces to the fastening strips which causes the fastening strips to move closer together in the Z axis 664. The webs 640, 650 are closer together than in FIG. 34 and are separated by a distance 773 which is less than the distance 771 in FIG. 34. In addition, the webs 640, 650 in FIG. 35 have deflected less in comparison to FIG. 34. The distance between the surfaces 740, 748 in the Y axis is less than the previous figure and accommodates the deflection of the web.

Figure 36:
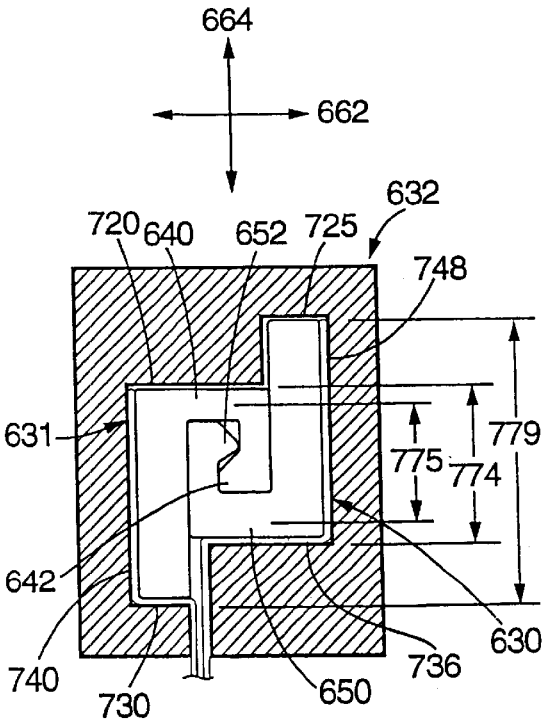
FIG. 36 is a cross-sectional view taken along line 36—36 in FIG. 25.

With respect to FIG. 36, as the slider continues to move along the fastening strips in the occlusion direction 780, the slider continues to cause the fastening strips to move closer together in the Z axis 664 as shown in FIG. 36. Referring to FIG. 36, the fastening strips 630, 631 are occluded. Specifically, the webs 640, 650 are occluded and the hooks 642, 652 have engaged each other. The surfaces 720, 736 are closer together in FIG. 36 as compared to FIG. 35 and are separated by a distance 774 which is less than distance 772 in FIG. 35. The surfaces 720, 736 apply forces to the fastening strips which causes the fastening strips to move closer together in the Z axis 664. The webs 640, 650 are closer together than in FIG. 35 and are separated by a distance 775 which is less than the distance 773 in FIG. 35. In addition, webs 640, 650 are no longer deflected and returned to their previous relaxed position as in FIG. 29. Furthermore, the distance between surfaces 740, 748 in the Y axis is substantially the same as the distance in FIG. 29. Thus, as shown in FIG. 36, the fastening strips 630, 631 are occluded prior to exiting the slider.

The deocclusion of the fastening strips 630, 631 in FIGS. 29–36 would occur in the reverse order of these figures. Thus, deocclusion is illustrated by beginning at FIG. 36 and moving in reverse order toward FIG. 29. The slider 632 facilitates the deocclusion of the fastening strips 630, 631 by moving the fastening strips away from each other in the Z axis 664 and causing the webs to disengage. Referring to the FIG. 25, the slider 632 is moved in the deocclusion direction 781 and the fastening strips 630, 631 enter the slider 632 as shown in FIG. 36. Referring to FIG. 36, the fastening strips 630, 631 are occluded as they enter the slider 632. The surfaces 725, 730 are separated by a distance 779 and the webs 640, 650 are separated by a distance 775.

With respect to FIG. 35, as the slider continues to move along the fastening strips in the deocclusion direction 781, the slider causes the fastening strips to move away from each other in the Z axis 664 as shown in FIG. 35. Referring to FIG. 35, the surfaces 725, 730 are separated by a distance 782 which is less than the distance 779 in FIG. 36. Due to the reduction in distance, the surfaces 725, 730 cause the fastening strips to move away from each other in the Z axis 664. In addition, the webs 640, 650 begin to deflect in order to allow the hooks to pass each other and disengage when the fastening strips are deoccluded. The distance between the surfaces 740, 748 in the Y axis 662 is greater than the distance in FIG. 36 to accommodate the deflection of the webs 640, 650.

Furthermore, as noted above, the positions of the fastening strips are effected not only by the forces acting upon them by the slider at that specific location, but are also effected by the position of the fastening strips at locations before and after that specific location. In this case, the fastening strips 630, 631 are being urged against the surfaces 725, 730 due to the shearing action of the surfaces 725, 730 as shown in FIGS. 29–34.

With respect to FIG. 34, as the slider continues to move along the fastening strips in the deocclusion direction 781 as shown in FIG. 25, the slider continues to cause the fastening strips to move away from each other in the Z axis 664 as shown in FIG. 34. Referring to FIG. 34, the surfaces 725, 730 are separated by a distance 784 which is less than the distance 782 in FIG. 35. The surfaces 725, 730 are applying shear forces to the fastening strips which causes the fastening strips to move away from each other in the Z axis 664. The fastening strips separate due to the shearing action between the fastening strips. Consequently, the webs 640, 650 are separated by a distance 771 which is greater than the distance 773 in FIG. 35. In addition, the webs 640, 650 in FIG. 34 deflect more in comparison to FIG. 35 in order to allow the hooks to pass each other and disengage. The distance between the surfaces 740, 748 in the Y axis 662 is greater than the distance in FIG. 35 to accommodate the deflection of the webs 640, 650.

With respect to FIG. 33, as the slider continues to move along the fastening strips in the deocclusion direction 781 as shown in FIG. 25, the slider continues to cause the fastening strips to move away from each other in the Z axis 664 as shown in FIG. 33. Referring to FIG. 33, the surfaces 725, 730 are separated by a distance 786 which is less than the distance 784 in FIG. 34. The surfaces 725, 730 are applying shear forces to the fastening strips which causes the fastening strips to move away from each other in the Z axis 664. The fastening strips separate due to the shearing action between the fastening strips. Consequently, the webs 640, 650 are separated by a distance 769 which is greater than the distance 771 in FIG. 34. In addition, the webs 640, 650 in FIG. 33 deflect more in comparison to FIG. 34 in order to allow the hooks to pass each other and disengage. The distance between the surfaces 740, 748 in the Y axis 662 is greater than the distance in FIG. 34 to accommodate the deflection of the webs 640, 650.

With respect to FIG. 32, as the slider continues to move along the fastening strips in the deocclusion direction 781 as shown in FIG. 25, the slider continues to cause the fastening strips to move away from each other in the Z axis 664 as shown in FIG. 32. Referring to 32, the surfaces 725, 730 are separated by a distance 788 which is less than the distance 786 in FIG. 33. The surfaces 725, 730 are applying shear forces to the fastening strips which causes the fastening strips to move away from each other in the Z axis 664. The fastening strips separate due to the shearing action between the fastening strips. Consequently, the webs 640, 650 are separated by a distance 767 which is greater than the distance 769 in FIG. 33. In addition, the webs 640, 650 in FIG. 32 continue to deflect in order to allow the hooks to pass each other and disengage. The distance between the surfaces 740, 748 in the Y axis 662 is less than or equal to the distance in FIG. 33 to accommodate the deflection of the webs 640, 650.

With respect to FIG. 31, as the slider continues to move along the fastening strips in the deocclusion direction 781 as shown in FIG. 25, the slider continues to cause the fastening strips to move away from each other in the Z axis 664 as shown in FIG. 31. Referring to FIG. 31, the surfaces 725, 730 are separated by a distance 790 which is less than the distance 788 in FIG. 32. The surfaces 725, 730 are applying shear forces to the fastening strips which causes the fastening strips to move away from each other in the Z axis 664. The fastening strips separate due to the shearing action between the fastening strips. Consequently, the webs 640, 650 are separated by a distance 765 which is greater than the distance 767 in FIG. 32. In addition, the webs 640, 650 in FIG. 31 continue to deflect in order to allow the hooks to pass each other and disengage. The distance between the surfaces 740, 748 in the Y axis 662 is less than the distance in FIG. 32 to accommodate the deflection of the webs 640, 650.

With respect to FIG. 30, as the slider continues to move along the fastening strips in the deocclusion direction 781 as shown in FIG. 25, the slider continues to cause the fastening strips to move away from each other in the Z axis 664 as shown in FIG. 30. Referring to FIG. 30, the surfaces 725, 730 are separated by a distance 792 which is less than the distance 790 in FIG. 31. The surfaces 725, 730 are applying shear forces to the fastening strips which causes the fastening strips to move away from each other in the Z axis 664. The fastening strips separate due to the shearing action between the fastening strips. Consequently, the webs 640, 650 are separated by a distance 763 which is greater than the distance 765 in FIG. 31. In addition, the webs 640, 650 continue to deflect in order to allow the hooks to pass each other. The distance between the surfaces 740, 748 in the Y axis 662 is less than the distance in FIG. 31 to accommodate the deflection of the webs 640, 650.

With respect to FIG. 29, as the slider continues to move along the fastening strips in the deocclusion direction 781, the slider continues to cause the fastening strips to move away from each other in the Z axis 664 as shown in FIG. 29. Referring to FIG. 29, the fastening strips 630, 631, and thus the webs 640, 650 have deoccluded. The surfaces 725, 730 are separated by a distance 760 which is less than the distance 792 in FIG. 30. The surfaces 725, 730 are applying shear forces to the fastening strips which causes the fastening strips to move away from each other in the Z axis 664. The fastening strips deocclude due to the shearing action between the fastening strips. Thus, the webs 640, 650 are separated by a distance 759 which is greater than the distance 763 in FIG. 30. In addition, the webs 640, 650 are no longer deflected and have returned to their previous relaxed position as in FIG. 36. Also, the hooks 642, 652 in FIG. 29 have disengaged. Furthermore, the distance between the surfaces 740, 748 is substantially the same as the distance in FIG. 36. As shown in FIG. 29, the fastening strips 630, 631 are deoccluded when the fastening strips exit the slider 632.

As noted above, the closure device may include other features. For example, the closure device may include a notch near the seam to assist the leak proof seal. The slider may also include an additional seal at the slot. The closure device may also have an end stop. Furthermore, the closure device may have a structure for a home or parking position. In addition, the closure device may include other structures to accommodate the slider at the end of the fastening strips, such as, slits or other means.

FIGS. 37–49 illustrate another embodiment of the invention. This embodiment occludes and deoccludes in the Z axis by using a shearing action similar to other embodiments. In addition, the fastening strips move in the Y axis and the bases deflect during occlusion and deocclusion. The fastening strips may be occluded and deoccluded manually or a slider may be used to facilitate occlusion and deocclusion.

Figure 37:
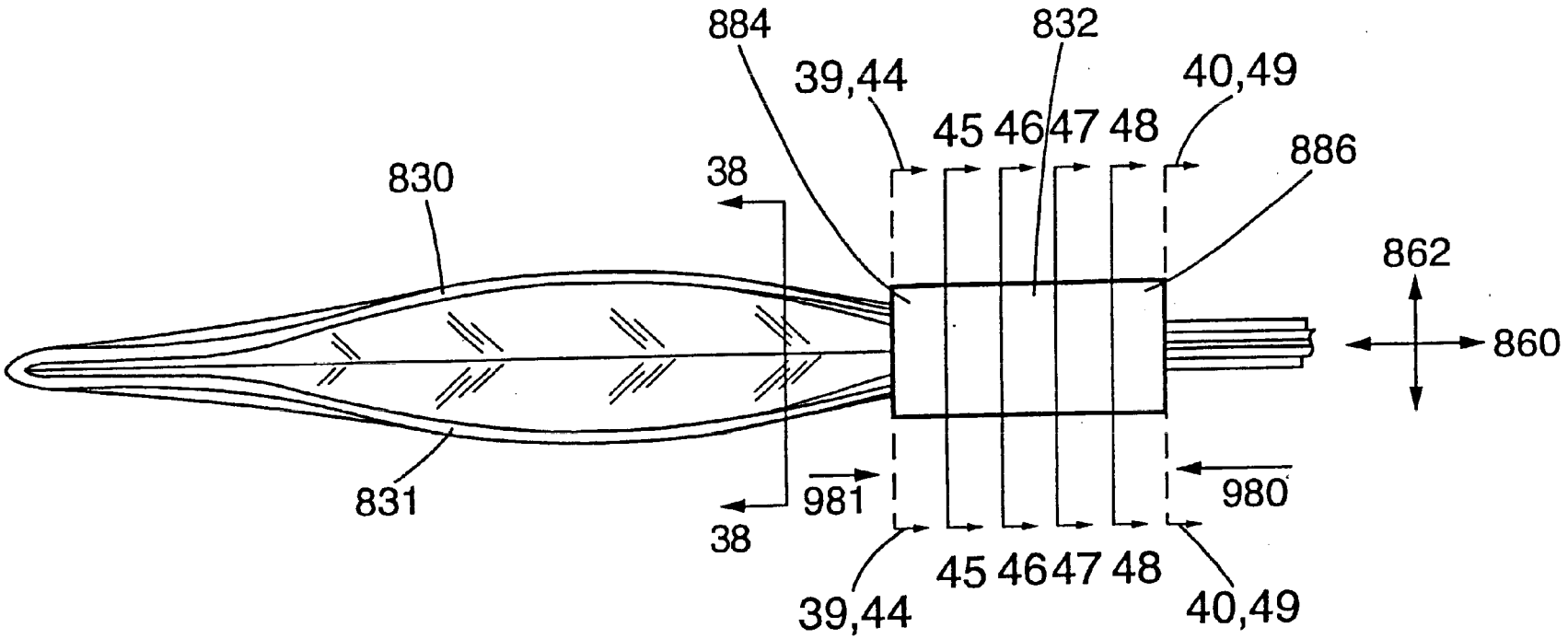
FIG. 37 is a partial top view of another embodiment of the invention.
Figure 38:
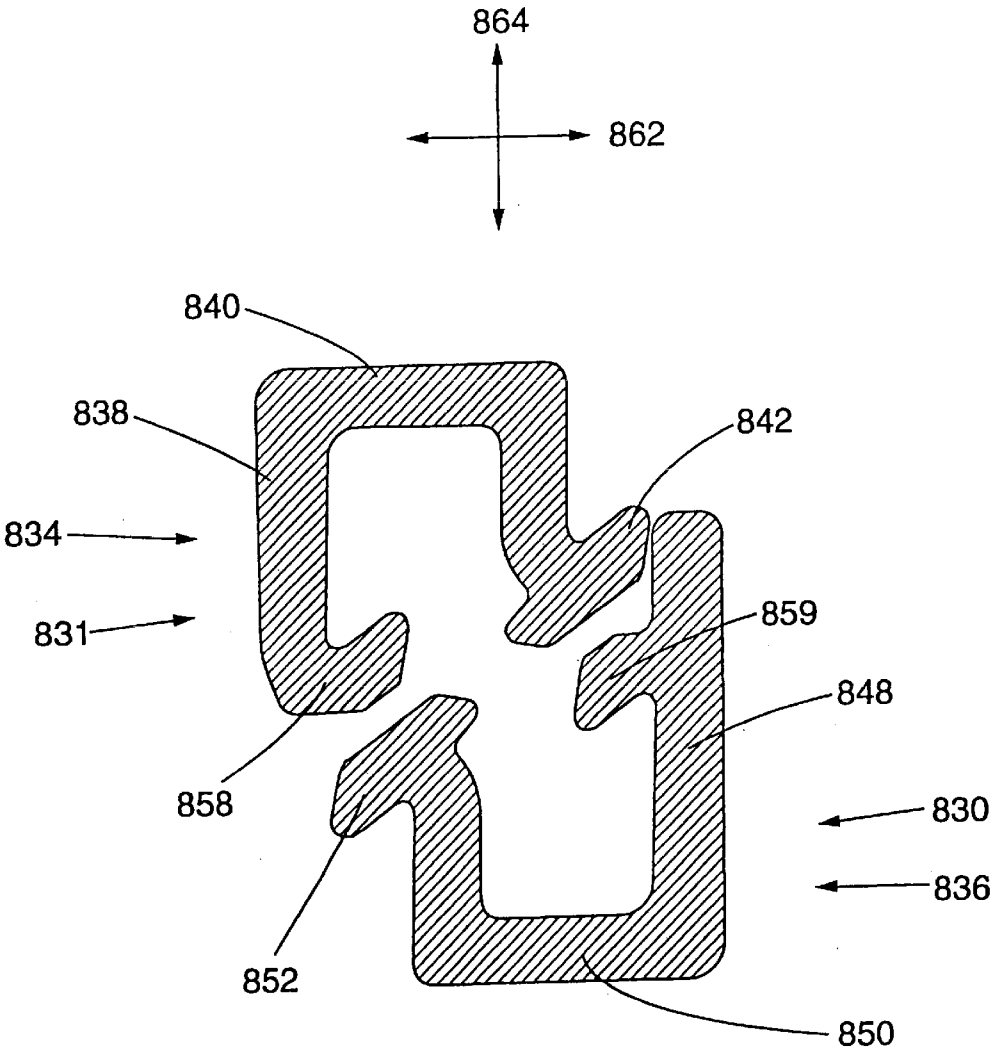
FIG. 38 is an enlarged cross-sectional view taken along line 38—38 in FIG. 37 of the fastening strips and without the bag sidewalls.

FIG. 37 shows a top view of the closure device. The closure device comprises first and second fastening strips 830, 831 and a slider 832. As shown in FIG. 38, the first fastening strip 831 includes a first closure element 834. The second fastening strip 830 comprises a second closure element 836 for engaging the first closure element 834.

The first closure element 834 comprises a base portion 838 and a web 840 extending from the base portion 838. The web 840 includes a hook portion 842 extending from the web 840. The base portion 838 includes a third hook portion 858.

The second closure element 836 comprises a base portion 848 and a web 850 extending from the base portion 848. The web 850 includes a hook portion 852 extending from the web 850. The base portion 848 includes a fourth hook portion 859.

Referring to FIGS. 37–38, the closure device and the fastening strips have an X axis 860, a Y axis 862 and a Z axis 864. The X axis 860 is the longitudinal axis of the closure device, the Y axis 862 is the lateral axis which is perpendicular to the X axis 860 and the Z axis 864 is the vertical axis which is perpendicular to the X axis 860 and the Y axis 862.

Figure 40:
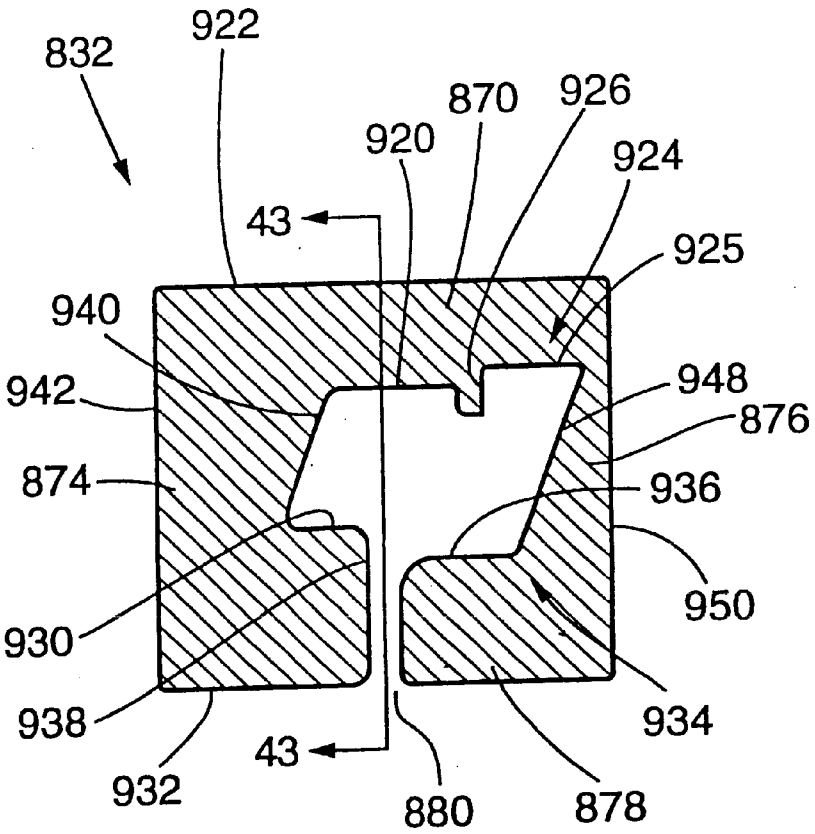
FIG. 40 is a cross sectional view taken along line 40—40 in FIG. 37 of the slider and without the fastening strips.
Figure 39:
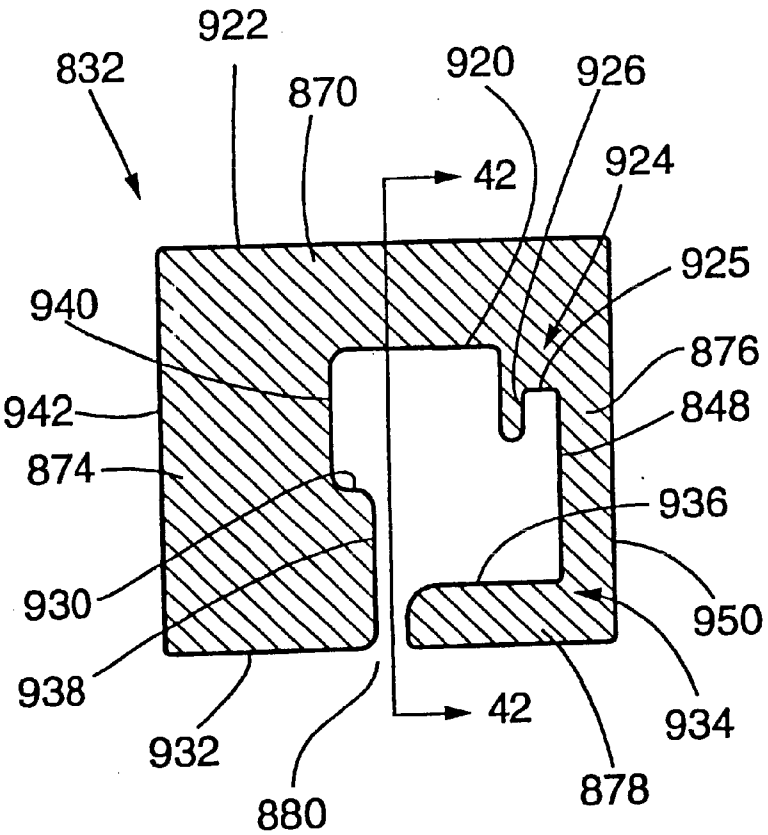
FIG. 39 is a cross-sectional view taken along line 39—39 in FIG. 37 of the slider and without the fastening strips.
Figure 41:
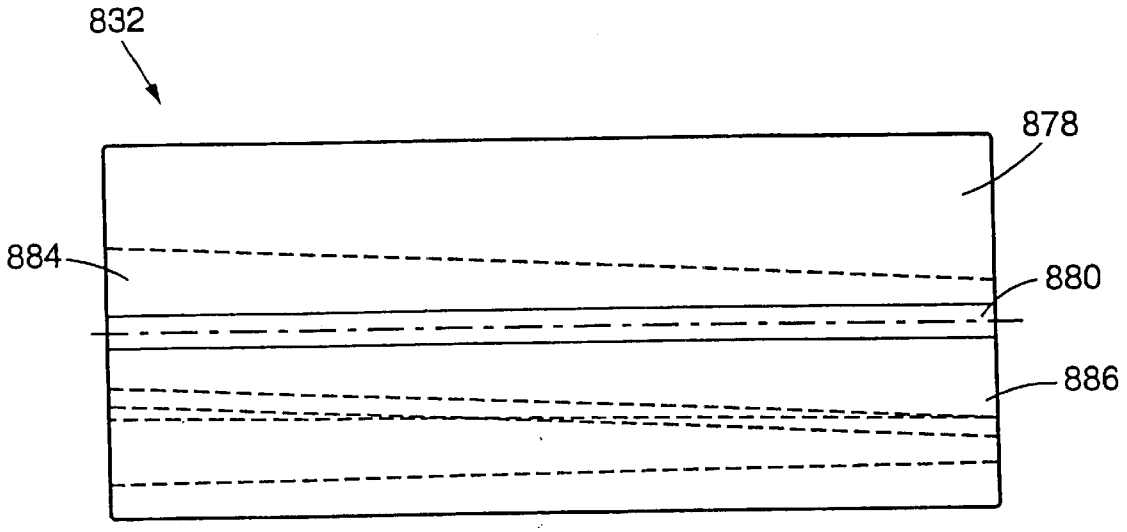
FIG. 41 is a bottom view of the slider in FIGS. 39 and 40.
Figure 42:
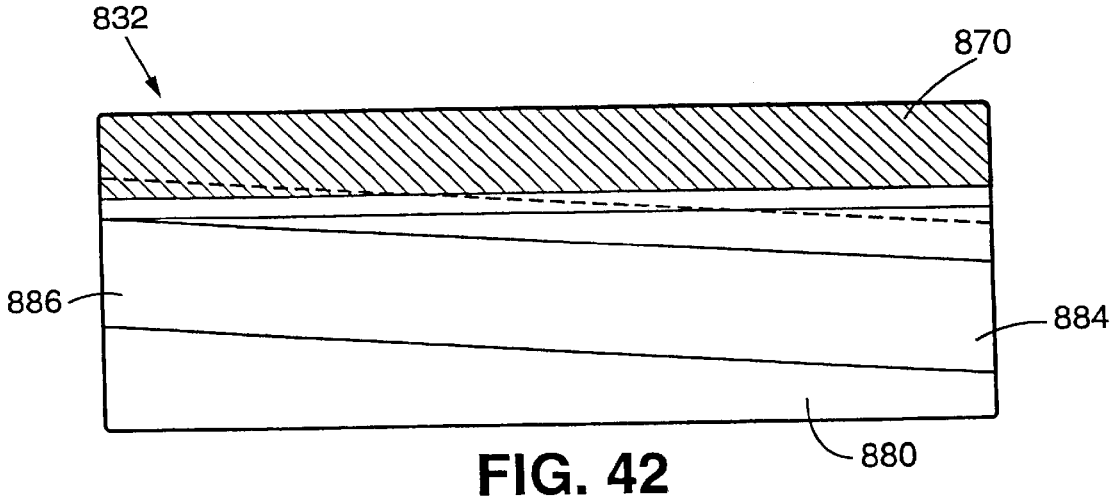
FIG. 42 is a cross-sectional view taken along line 42—42 in FIG. 39.
Figure 43:
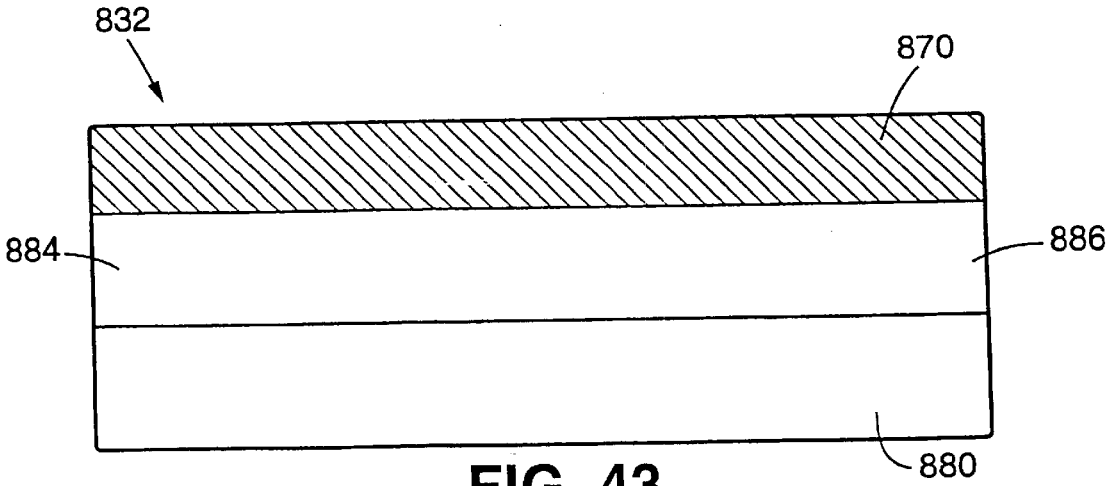
FIG. 43 is a cross-sectional view taken along line 43—43 in FIG. 40.

Referring to FIGS. 39–40, the slider 832 includes a top portion 870, a first side portion 874, a second side portion 876, a bottom portion 878 and a slot 880. Referring to FIG. 37, the slider 832 has a first end 884 and a second end 886.

Returning to FIGS. 39 and 40, the top portion 870 has an inner surface 920 and an outer surface 922. The inner surface 920 includes an offset portion 924 which includes an upper surface 925 and an offset side surface 926. The offset portion 924 begins at the second end 886 and slopes downwards towards the first end 884.

The bottom portion 878 has an inner surface 930 and an outer surface 932. The inner surface 930 includes an offset portion 934 which includes an upper surface 936 and an offset side surface 938. The offset portion 934 begins at the second end 886 and slopes downward towards the first end 884.

The first side portion 874 has an inner surface 940 and an outer surface 942. The second side portion 876 has an inner surface 948 and an outer surface 950. The bottom portion 878 has a slot 880 which extends from the outer surface 932 to the inner surface 930. In addition, the slot extends from the first end 884 to the second end 886 of the slider. The slot has substantially the same width from the first end 884 to the second end 886 of the slider.

The slider may be a one piece construction or may include several separate pieces which are assembled in several different ways.

FIGS. 44–49 illustrate occlusion and deocclusion of the closure device. When FIGS. 44–49 are viewed in numerical sequence, FIGS. 44–49 illustrate occlusion of the fastening strips. When FIGS. 44–49 are viewed in reverse numerical sequence (i.e. viewed from FIG. 49 backwards to FIG. 44), FIGS. 44–49 illustrate deocclusion of the fastening strips.

Figure 44:
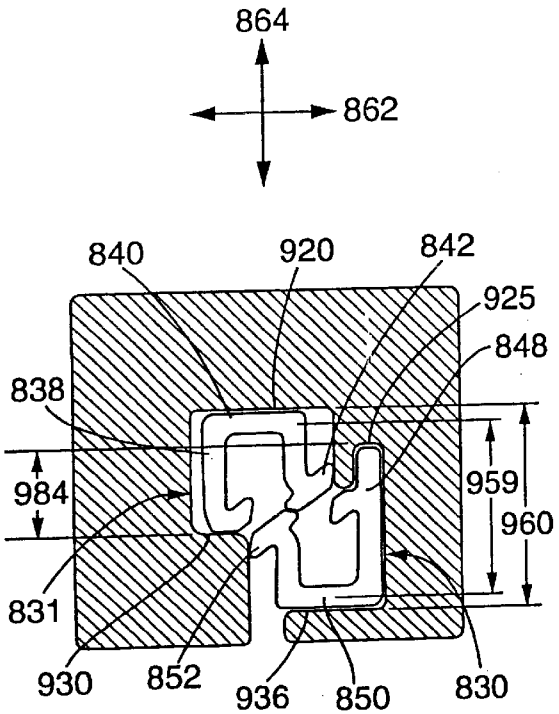
FIG. 44 is a cross-sectional view taken along line 44—44 in FIG. 37.

The occlusion of the fastening strips will be described and then the deocclusion of the fastening strips will be described. The slider 832 facilitates the occlusion of the fastening strips 830, 831 by moving the fastening strips towards each other in a shear direction or Z axis direction and causing the webs to engage. Referring to FIG. 37, the slider 832 is moved in the occlusion direction 980 and the fastening strips 830, 831 enter the slider 832 as shown in FIG. 44. Referring to FIG. 44, the fastening strips 830, 831 are deoccluded and the web 840 and web 850 are separated by a distance 959. In addition, the upper surface 936 of the bottom portion and inner surface 920 of the top portion are separated by a distance 960.

Figure 45:
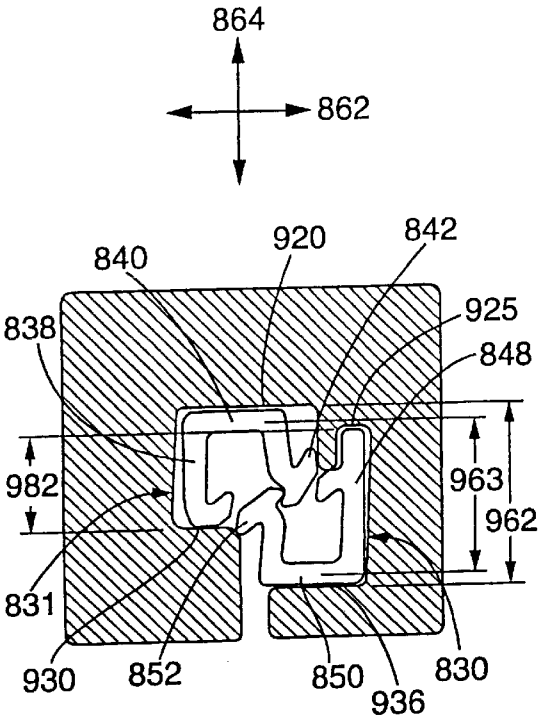
FIG. 45 is a cross-sectional view taken along line 45—45 in FIG. 37.

With respect to FIG. 45, as the slider is moved further along the fastening strips in the occlusion direction 980 as shown in FIG. 37, the slider causes the fastening strips to move closer together in a shear direction or Z axis 864 as shown in FIG. 45. Referring to FIG. 45, the fastening strips 830, 831 are deoccluded. However, the upper surface 936 and the inner surface 920 are closer together than in FIG. 44 and are separated by a distance 962 which is less than distance 960 in FIG. 44. Due to the reduction in distance, the upper surface 936 and the inner surface 920 cause the fastening strips to move closer together in the Z axis 864. Thus, the webs 840, 850 are separated by a distance 963 which is less than the distance 959 in FIG. 44. In addition, the bases 838, 848 begin to deflect in order to allow the hooks to pass each other and engage when the fastening strips are occluded. The distance between the surfaces 940, 948 at some locations is greater to accommodate the deflection of the bases 838, 848. Specifically, the surfaces 940, 948 are at an angle to the Z axis 864 to accommodate the movement of the bases 838, 848.

With respect to FIGS. 44–49, the positions of the fastening strips are effected not only by the forces acting upon them by the slider at that location but are also effected by the position of the fastening strips at locations before and after that location. For example, the positions of the fastening strips in FIG. 45 are effected by the positions of the fastening strips in FIGS. 44 and 46.

The amount of effect that the position of fastening strips from one location has upon the position of the fastening strips in another location depends upon several factors, such as, the structure of the fastening strips and the material from which the fastening strips are made. For example, if the fastening strips are relatively thick, then the effect at other locations would be greater than if the fastening strips were relatively thin. As another example, if the material for the fastening strips is relatively rigid, then the effect at other locations would be greater than if the material was relatively flexible.

Figure 46:
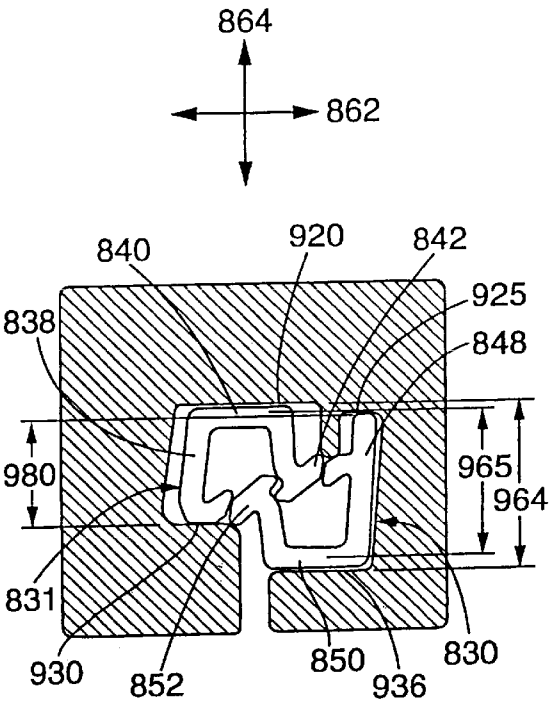
FIG. 46 is a cross-sectional view taken along line 46—46 in FIG. 37.

With respect to FIG. 46, as the slider continues to move along the fastening strips in the occlusion direction 980 as shown in FIG. 37, the slider continues to cause the fastening strips to move closer together in the Z axis 864 as shown in FIG. 46. In FIG. 46, the upper surface 936 and the inner surface 920 are closer together than in FIG. 45 and are separated by a distance 964 which is less than distance 962 in FIG. 45. The surfaces 920, 936 are applying forces to the fastening strips which causes the fastening strips to move closer together in the Z axis 864. The webs 840, 850 are separated by a distance 965 which is less than the distance 963 in FIG. 45. In addition, the bases 838, 848 in FIG. 46 have deflected more in comparison to FIG. 45 in order to allow the hooks to pass each other and engage when the fastening strips are occluded. The distance between the surfaces 940, 948 at some locations is greater to accommodate the deflection of the bases 838, 848. Specifically, the surfaces 940, 948 are at an angle to the Z axis 864 to accommodate the movement of the bases 838, 848. In addition, the hook portions 842, 852 are deflected.

Figure 47:
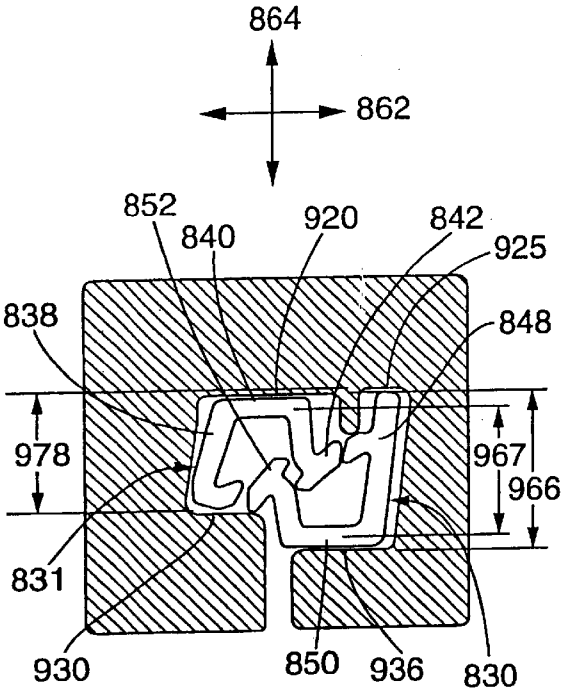
FIG. 47 is a cross-sectional view taken along line 47—47 in FIG. 37.

With respect to FIG. 47, as the slider continues to move along the fastening strips in the occlusion direction 980 as shown in FIG. 37, the slider continues to cause the fastening strips to move closer together in the Z axis 864 as shown in FIG. 47. In FIG. 47, the upper surface 936 and the inner surface 920 are closer together than in FIG. 46 and are separated by a distance 966 which is less than distance 964 in FIG. 46. The surfaces 920, 936 are applying forces to the fastening strips which causes the fastening strips to move closer together in the Z axis 864. The webs 840, 850 are separated by a distance 967 which is less than the distance 965 in FIG. 46. In addition, the bases 838, 848 in FIG. 47 have deflected more in comparison to FIG. 46. The distance between the surfaces 940, 948 at some locations is greater to accommodate the deflection of the bases 838, 848. Specifically, the surfaces 940, 948 are at an angle to the Z axis 864 to accommodate the movement of the bases 838, 848. In addition, the hook portions 842, 852 continue to deflect.

Figure 48:
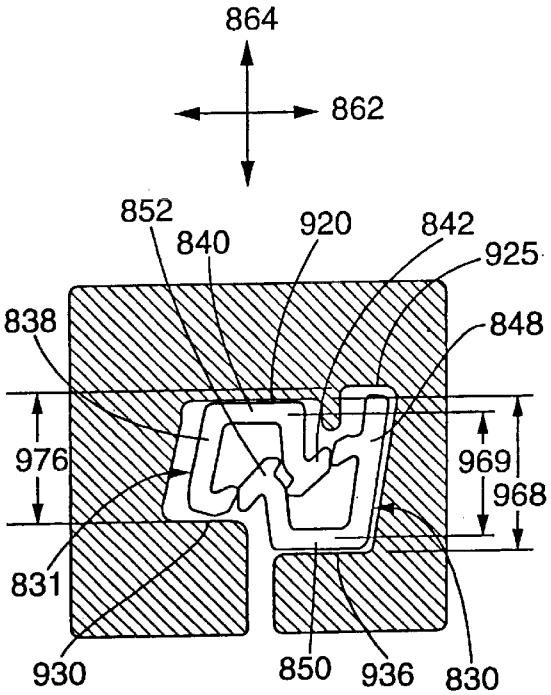
FIG. 48 is a cross-sectional view taken along line 48—48 in FIG. 37.

With respect to FIG. 48, as the slider continues to move along the fastening strips in the occlusion direction 980 as shown in FIG. 37, the slider continues to cause the fastening strips to move closer together in the Z axis 864 as shown in FIG. 48. Tn FIG. 48, the upper surface 936 and the inner surface 920 are closer together than in FIG. 47 and are separated by a distance 968 which is less than distance 966 in FIG. 47. The surfaces 920, 936 are applying forces to the fastening strips which causes the fastening strips to move closer together in the Z axis 864. The webs 840, 850 are separated by a distance 969 which is less than the distance 967 in FIG. 47. In addition, the bases 838, 848 in FIG. 48 have deflected more in comparison to FIG. 47. The distance between the surfaces 940, 948 at some locations to greater to accommodate the deflection of the bases 838, 848. Specifically, the surfaces 940, 948 are at an angle to the Z axis 864 to accommodate the movement of the bases 838, 848. In addition, the hook portions 842, 852 continue to deflect.

Figure 49:
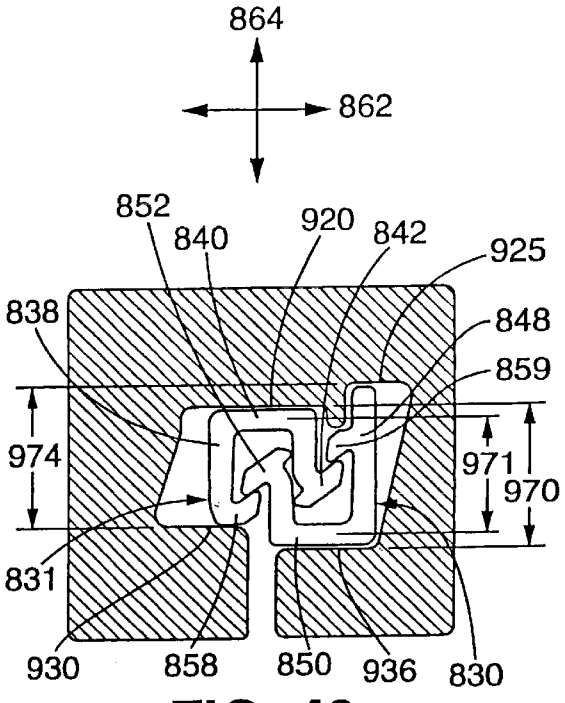
FIG. 49 is a cross-sectional view taken along line 49—49 in FIG. 37.

With respect to FIG. 49, as the slider continues to move along the fastening strips in the occlusion direction 980, the slider continues to cause the fastening strips to move closer together in the Z axis 864 as shown in FIG. 49. Referring to FIG. 49, the fastening strips 830, 831 are occluded. Specifically, the webs 840, 850 are occluded and the hooks 842, 852 have engaged each other. In addition, the hooks have engaged the hooks 858, 859. The surfaces 920, 936 are closer together in FIG. 49 as compared to FIG. 48 and are separated by a distance 970 which is less than distance 968 in FIG. 48. The surfaces 920, 936 apply forces to the fastening strips which causes the fastening strips to move closer together in the Z axis 864. The webs 840, 850 are separated by a distance 971 which is less than the distance 969 in FIG. 48. In addition, the bases 1038, 1048 are not deflected and have returned to their relaxed position. Thus, as shown in FIG. 49, the fastening strips 830, 831 are occluded prior to exiting the slider.

The deocclusion of the fastening strips 830, 831 in FIGS. 44–49 would occur in the reverse order of these figures. Thus, deocclusion is illustrated by beginning at FIG. 49 and moving in reverse order toward FIG. 44. The slider 832 facilitates the deocclusion of the fastening strips 830, 831 by moving the fastening strips away from each other in the Z axis 864 and causing the webs to disengage. Referring to the FIG. 37,, the slider 832 is moved in the deocclusion direction 981 and the fastening strips 830, 831 enter the slider 832 as shown in FIG. 49. Referring to FIG. 49, the fastening strips 830, 831 are occluded as they enter the slider 832. The surfaces 925, 930 are separated by a distance 974 and the webs 840, 850 are separated by a distance 971.

With respect to FIG. 48, as the slider continues to move along the fastening strips in the deocclusion direction 981, the slider causes the fastening strips to move away from each other in the Z axis 864 as shown in FIG. 48. Referring to FIG. 48, the surfaces 925, 930 are separated by a distance 976 which is less than the distance 974 in FIG. 49. Due to the reduction in distance, the surfaces 925, 930 cause the fastening strips to move away from each other in the Z axis 864. In addition, the bases 838, 848 are deflected in order to allow the hooks to pass each other and disengage when the fastening strips are deoccluded. The distance between the surfaces 940, 948 at some locations is greater to accommodate the deflection of the bases 838, 848. Specifically, the surfaces 940, 948 are at an angle to the Z axis 864 to accommodate the movement of the bases 838, 848. In addition, the hook portions 842, 852 are deflected.

Furthermore, as noted above, the positions of the fastening strips are effected not only by the forces acting upon them by the slider at that specific location, but are also effected by the position of the fastening strips at locations before and after that specific location.

With respect to FIG. 47, as the slider continues to move along the fastening strips in the deocclusion direction 981 as shown in FIG. 37, the slider continues to cause the fastening strips to move away from each other in the Z axis 864 as shown in FIG. 47. Referring to FIG. 47, the surfaces 925, 930 are separated by a distance 978 which is less than the distance 976 in FIG. 48. The surfaces 925, 930 are applying shear forces to the fastening strips which causes the fastening strips to move away from each other in the Z axis 864. The fastening strips separate due to the shearing action between the fastening strips. Consequently, the webs 840, 850 are separated by a distance 967 which is greater than the distance 969 in FIG. 48. In addition, the bases 838, 848 continue to deflect in order to allow the hooks to pass each other and disengage. The distance between the surfaces 940, 948 at some locations is greater to accommodate the deflection of the bases 838, 848. Specifically, the surfaces 940, 948 are at an angle to the Z axis 864 to accommodate the movement of the bases 838, 848. In addition, the hook portions 842, 852 continue to deflect.

With respect to FIG. 46, as the slider continues to move along the fastening strips in the deocclusion direction 981 as shown in FIG. 37, the slider continues to cause the fastening strips to move away from each other in the Z axis 864 as shown in FIG. 46. Referring to FIG. 46, the surfaces 925, 930 are separated by a distance 980 which is less than the distance 978 in FIG. 47. The surfaces 925, 930 are applying shear forces to the fastening strips which causes the fastening strips to move away from each other in the Z axis 864. The fastening strips separate due to the shearing action between the fastening strips. Consequently, the webs 840, 850 are separated by a distance 965 which is greater than the distance 967 in FIG. 47. In addition, the webs 840, 850 continue to deflect in order to allow the hooks to pass each other. The distance between the surfaces 940, 948 at some locations is greater to accommodate the deflection of the bases 838, 848. Specifically, the surfaces 940, 948 are at an angle to the Z axis 864 to accommodate the movement of the bases 838, 848. In addition, the hook portions 842, 852 continue to deflect.

With respect to FIG. 45, as the slider continues to move along the fastening strips in the deocclusion direction 981 as shown in FIG. 37, the slider continues to cause the fastening strips to move away from each other in the Z axis 864 as shown in FIG. 45. Referring to FIG. 45, the surfaces 925, 930 are separated by a distance 982 which is less than the distance 980 in FIG. 46. The surfaces 925, 930 are applying shear forces to the fastening strips which causes the fastening strips to move away from each other in the Z axis 864. The fastening strips separate due to the shearing action between the fastening strips. Consequently, the webs 840, 850 are separated by a distance 963 which is greater than the distance 965 in FIG. 46. In addition, the webs 840, 850 continue to deflect in order to allow the hooks to pass each other. The distance between the surfaces 940, 948 at some locations is greater to accommodate the deflection of the bases 838, 848. Specifically, the surfaces 940, 948 are at an angle to the Z axis 864 to accommodate the movement of the bases 838, 848. In addition, the hook portions 842, 852 continue to deflect With respect to FIG. 44, as the slider continues to move along the fastening strips in the deocclusion direction 981, the slider continues to cause the fastening strips to move away from each other in the Z axis 864 as shown in FIG. 44. Referring to FIG. 44, the fastening strips 830, 831, and thus the webs 840, 850 have deoccluded. The surfaces 925, 930 are separated by a distance 984 which is less than the distance 982 in FIG. 45. The surfaces 925, 930 are applying shear forces to the fastening strips which causes the fastening strips to move away from each other in the Z axis 864. The fastening strips deocclude due to the shearing action between the fastening strips. Thus, the webs 840, 850 are separated by a distance 959 which is greater than the distance 963 in FIG. 45. Also, the hooks 842, 852 in FIG. 44 have disengaged. In addition, the bases 938, 948 are not deflected and have returned to their relaxed position. As shown in FIG. 44, the fastening strips 830, 831 are deoccluded when the fastening strips exit the slider 832.

As noted above, the closure device may include other features. For example, the closure device may include a notch near the seam to assist the leak proof seal. The slider may also include an additional seal at the slot. The closure device may also have an end stop. Furthermore, the closure device may have a structure for a home or parking position. In addition, the closure device may include other structures to accommodate the slider at the end of the fastening strips, such as, slits or other means.

FIGS. 50–62 illustrate another embodiment of the invention. This embodiment occludes and deoccludes in the Z axis by using a shearing action similar to other embodiments. In addition, this embodiment rotates and flexes one of the fastening strips during occlusion and deocclusion. The fastening strips include two webs and hook portions. The hook portions are engaged sequentially. The fastening strips may be occluded and deoccluded manually or a slider may be used to facilitate the occlusion and deocclusion of the fastening strips.

Figure 50:
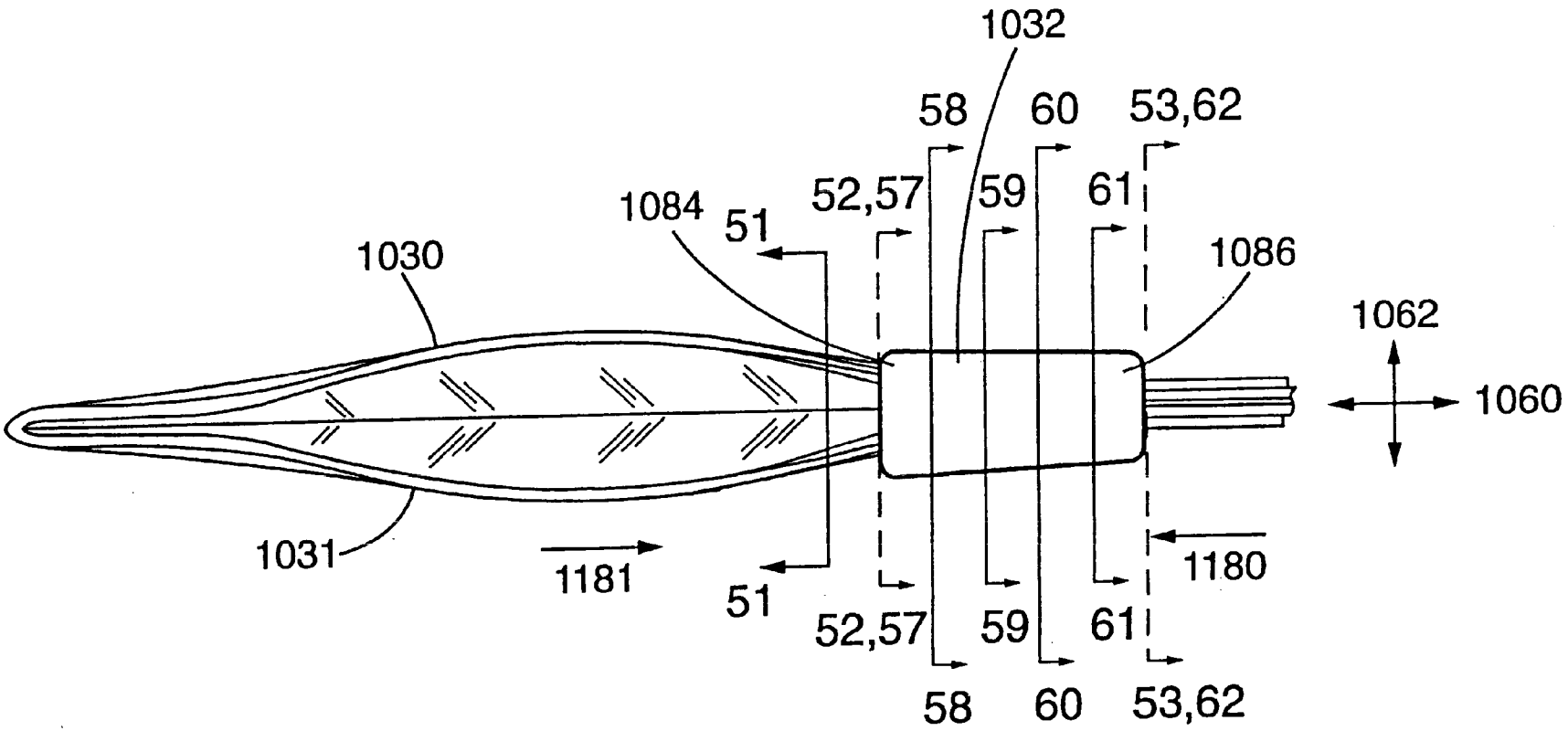
FIG. 50 is a partial top view of another embodiment of the invention.
Figure 51:
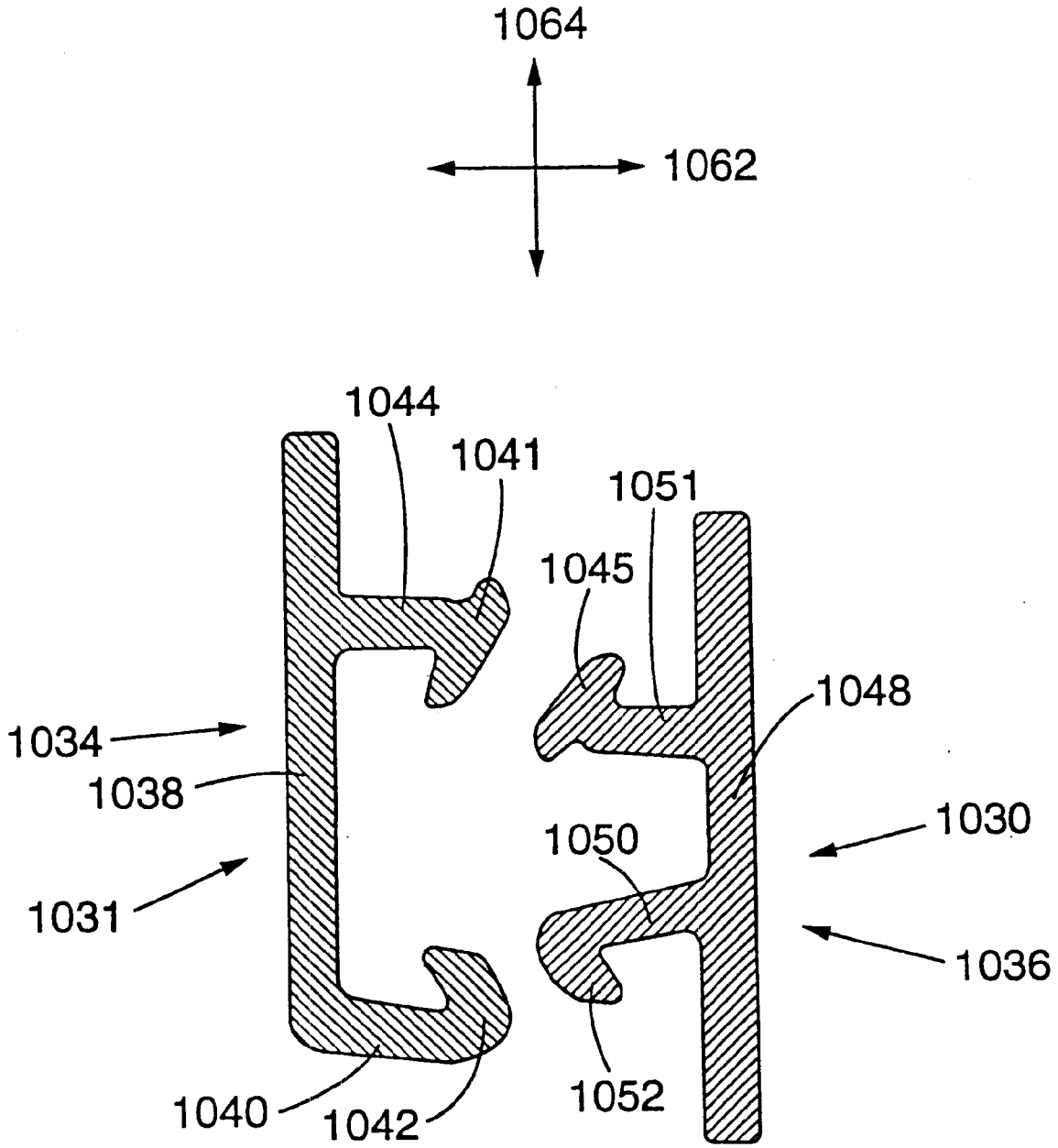
FIG. 51 is an enlarged partial cross-sectional view taken along line 51—51 in FIG. 50 of the fastening strips and without the bag sidewalls.
Figure 53:
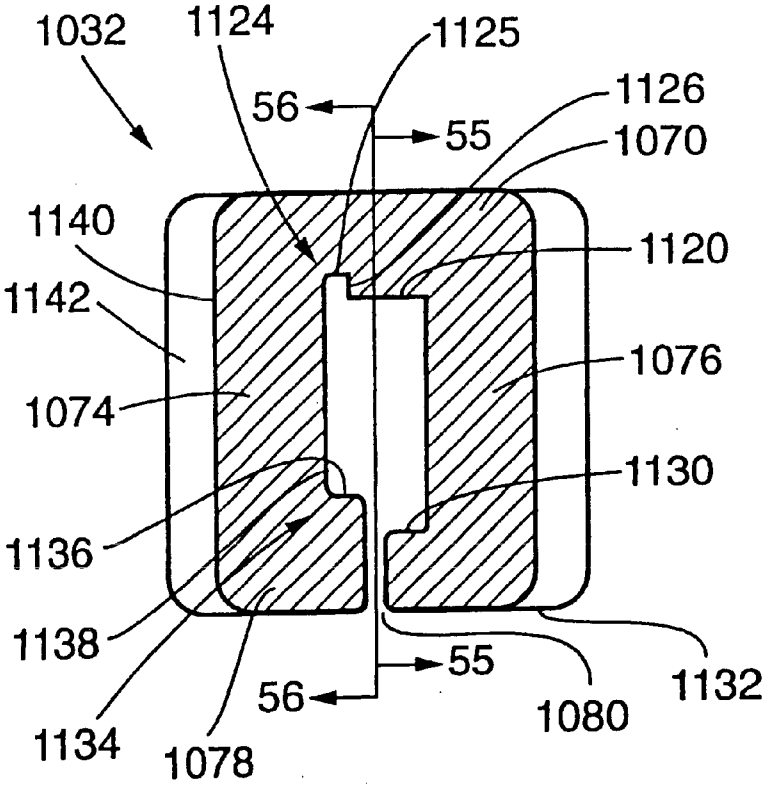
FIG. 53 is a partial cross-sectional view taken along line 53—53 FIG. 50 of the slider and without the fastening strips.
Figure 52:
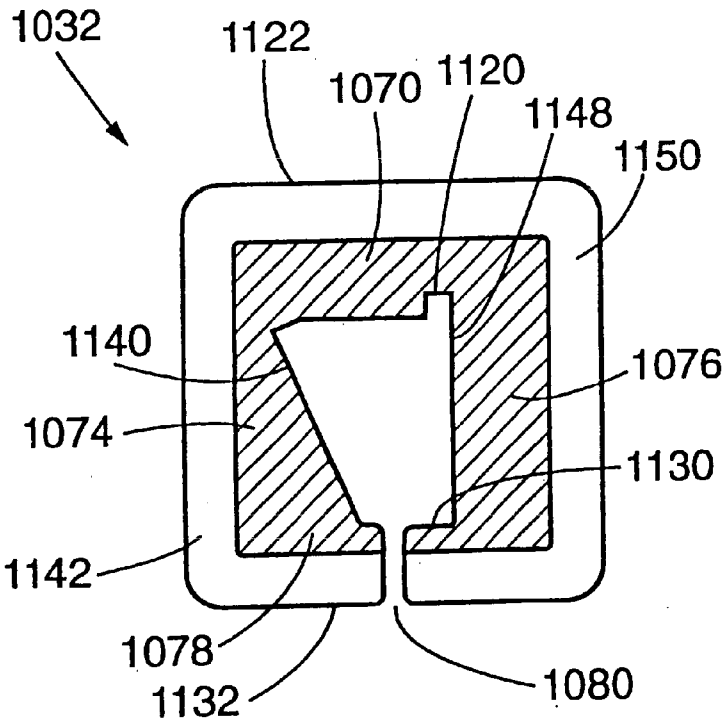
FIG. 52 is a partial cross-sectional view taken along line 52—52 in FIG. 50 of the slider and without the fastening strips.
Figure 54:
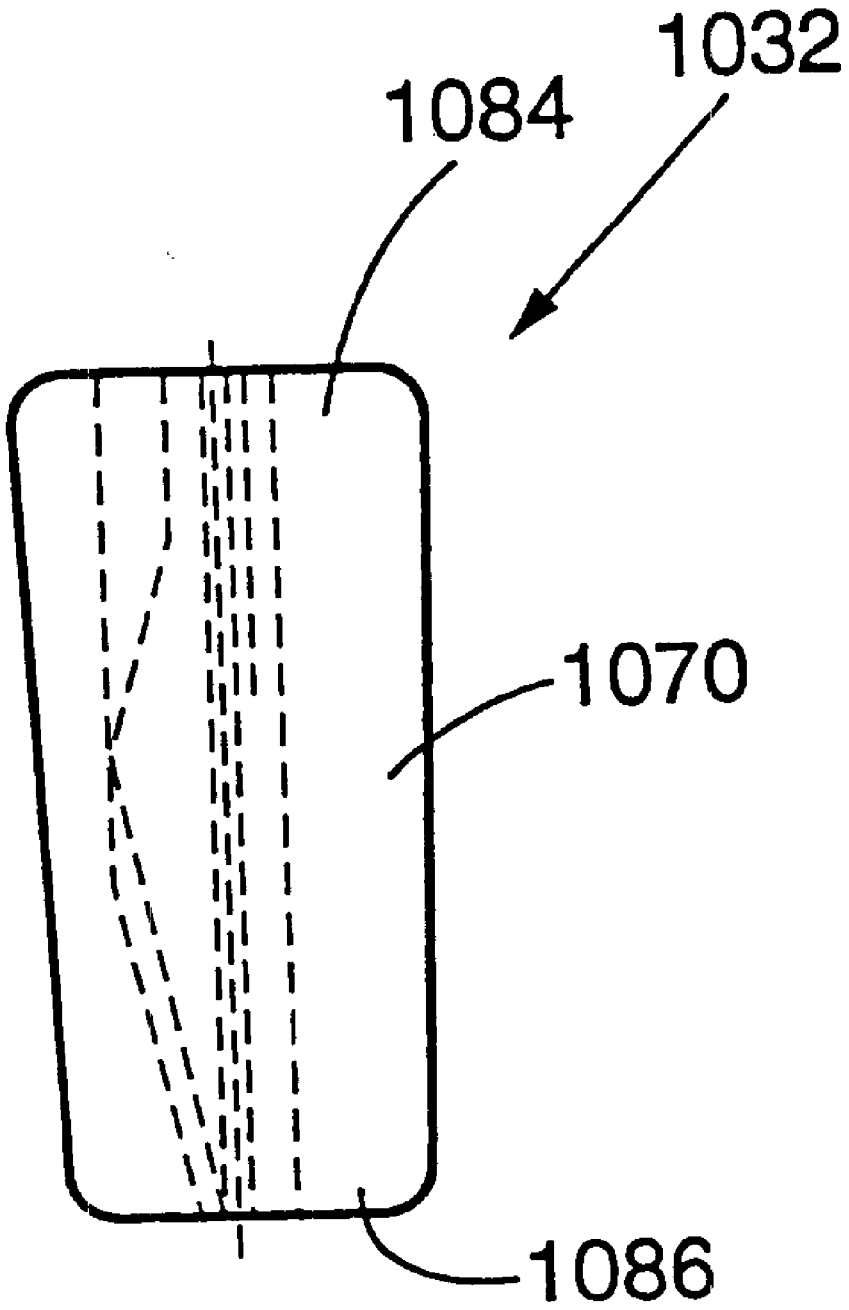
FIG. 54 is a top view of the slider shown in FIGS. 52 and 53.
Figure 56:
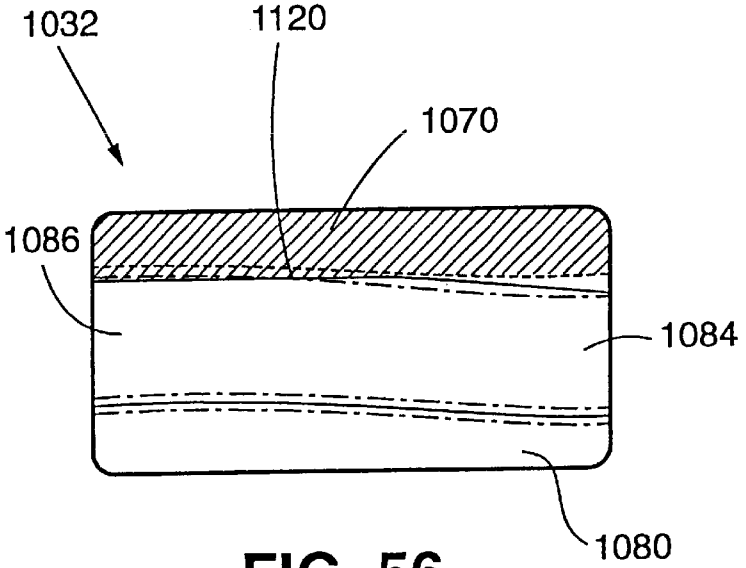
FIG. 56 is a cross-sectional view taken along line 56—56 in FIG. 53.
Figure 55:
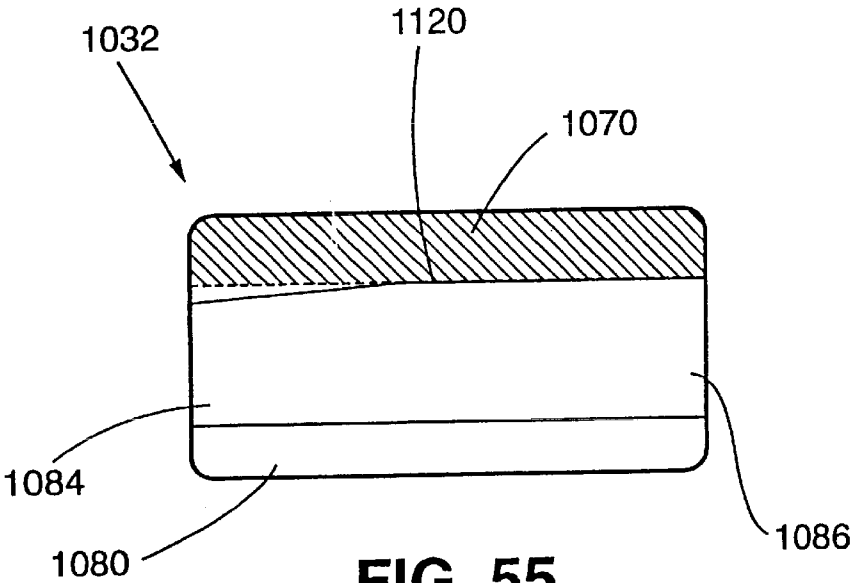
FIG. 55 is a partial cross-sectional view taken along line 55—55 in FIG. 53.

FIG. 50 shows a top view of the closure device. The closure device comprises first and second fastening strips 1030, 1031 and a slider 1032. As shown in FIG. 51, the first fastening strip 1031 includes a first closure element 1034. The second fastening strip 1030 comprises a second closure element 1036 for engaging the first closure element 1034.

The first closure element 1034 comprises a base portion 1038 and a first web 1040 extending from the base portion 1038. The first web 1040 includes a first hook portion 1042 extending from the web 1040. A third web 1041 extends from the base portion 1038 and the web 1041 includes a third hook portion 1044.

The second closure element 1036 comprises a base portion 1048 and a second web 1050 extending from the base portion 1048. The web 1050 includes a second hook portion 1052 extending from the web 1050. The second hook portion 1052 engages the first hook portion 1042. A fourth web 1051 extends from the base portion 1048. The fourth web 1051 includes a fourth hook portion 1045 which engages the third hook portion 1044.

Referring to FIGS. 50–51 the closure device and the fastening strips have an X axis 1060, a Y axis 1062 and a Z axis 1064. The X axis 1060 is the longitudinal axis of the closure device, the Y axis 1062 is the lateral axis which is perpendicular to the X axis 1060 and the Z axis 1064 is the vertical axis which is perpendicular to the X axis 1060 and the Y axis 1062.

Referring to FIGS. 52–56, the slider 1032 includes a top portion 1070, a first side portion 1074, a second side portion 1076, a bottom portion 1078 and a slot 1080. Referring to FIG. 50, the slider 1032 has a first end 1084 and a second end 1086.

Returning to FIGS. 52 and 53, the top portion 1070 has an inner surface 1120 and an outer surface 1122. The inner surface 1120 includes an offset portion 1124 which includes an upper surface 1125 and an offset side surface 1126. The offset portion 1124 begins at the second end 1186 and slopes downwards towards the first end 1084.

The bottom portion 1078 has an inner surface 1130 and an outer surface 1132. The inner surface 1130 includes an offset portion 1134 which includes an upper surface 1136 and an offset side surface 1138. The offset portion 1134 begins at the second end 1086 and slopes downward towards the first end 1084.

The first side portion 1074 has an inner surface 1140 and an outer surface 1142. The second side portion 1076 has an inner surface 1148 and an outer surface 1150. The bottom portion 1078 has a slot 1080 which extends from the outer surface 1132 to the inner surface 1130. In addition, the slot extends from the first end 1084 to the second end 1086 of the slider. The slot has substantially the same width from the first end 1084 to the second end 1086 of the slider.

The slider may be a one piece construction or may include several separate pieces which are assembled in several different ways.

FIGS. 57–62 illustrate occlusion and deocclusion of the closure device. When FIGS. 57–62 are viewed in numerical sequence, FIGS. 57–62 illustrate occlusion of the fastening strips. When FIGS. 57–62 are viewed in reverse numerical sequence (i.e. viewed from FIG. 62 backwards to FIG. 57), FIGS. 57–62 illustrate deocclusion of the fastening strips.

Figure 57:
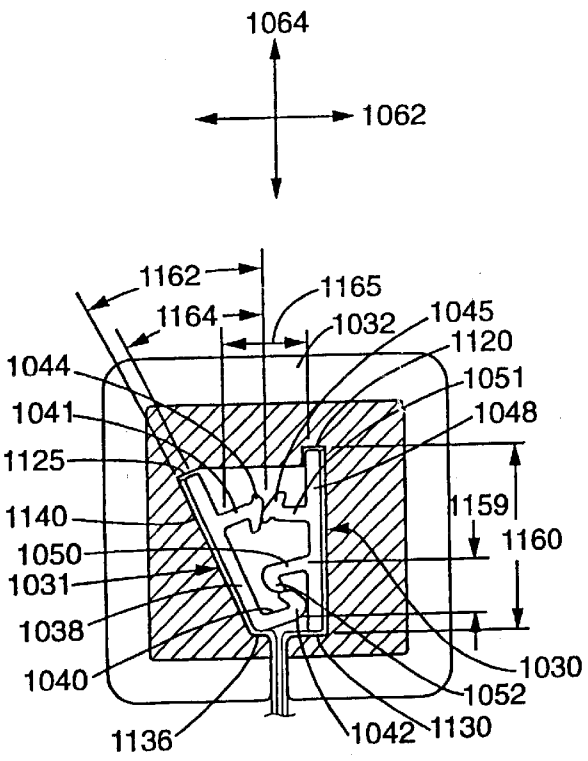
FIG. 57 is a partial cross-sectional view taken along line 57—57 in FIG. 50.

The occlusion of the fastening strips will be described and then the deocclusion of the fastening strips will be described. The slider 1032 facilitates the occlusion of the fastening strips 1030, 1031 by moving the fastening strips towards each other in the Y axis and the Z axis and causing the webs to engage. Referring to FIG. 50, the slider 1032 is moved in the occlusion direction 1180 and the fastening strips 1030, 1031 enter the slider 1032 as shown in FIG. 57. Referring to FIG. 57, the fastening strips 1030, 1031 are deoccluded and the web 1040 and web 1050 are separated by a distance 1159. In addition, the upper surface 1136 of the bottom portion and inner surface 1120 of the top portion are separated by a distance 1160. Furthermore, the surface 1140, is at an angle 1162 to the Z axis 1064. The surface 1140 causes the fastening strip 1031 to rotate. Prior to entering the slider 1032, the fastening strip 1031 was substantially parallel to the Z axis 1064 as shown in FIG. 51. Due to the rotation, the base 1038 is at an angle 1164 to the Z axis 1064. The rotation begins the process of occluding the hooks 1042, 1052.

Figure 58:
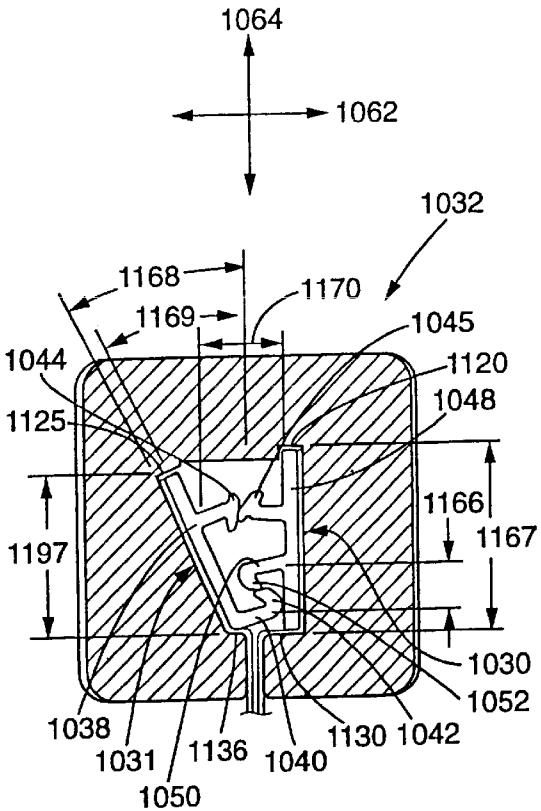
FIG. 58 is a partial cross-sectional view taken along line 58—58 in FIG. 50.

With respect to FIG. 58, as the slider is moved further along the fastening strips in the occlusion direction 1180 as shown in FIG. 50, the position of the fastening strips is relatively unchanged from FIG. 57. The webs 1040, 1050 are separated by a distance 1166 which is approximately the same as the distance 1159 in FIG. 57. The surfaces 1120, 1136 are separated by a distance 1167 which is approximately the same as the distance 1160 in FIG. 57. The angles 1168, 1169 are approximately the same as the angles 1162, 1164 in FIG. 57. Finally the distance between the hooks 1044, 1045 which is represented by the distance 1170 between the bases 1038, 1048 is approximately the same as the distance 1165 in FIG. 57.

Figure 59:
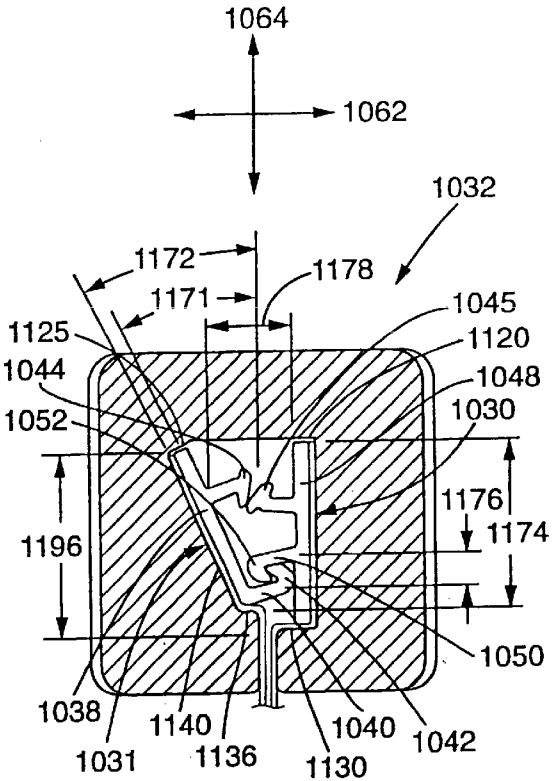
FIG. 59 is a partial cross-sectional view taken along line 59—59 in FIG. 50.

With respect to FIGS. 57–62, the positions of the fastening strips are effected not only by the forces acting upon them by the slider at that location but are also effected by the position of the fastening strips at locations before and after that location. For example, the positions of the fastening strips in FIG. 59 are effected by the positions of the fastening strips in FIGS. 58 and 60.

The amount of effect that the position of fastening strips from one location has upon the position of the fastening strips in another location depends upon several factors, such as, the structure of the fastening strips and the material from which the fastening strips are made. For example, if the fastening strips are relatively thick, then the effect at other locations would be greater than if the fastening strips were relatively thin. As another example, if the material for the fastening strips is relatively rigid, then the effect at other locations would be greater than if the material was relatively flexible.

With respect to FIG. 59, as the slider continues to move along the fastening strips in the occlusion direction 1180 as shown in FIG. 50, the slider causes the fastening strips to move closer together in the Z axis 1064 as shown in FIG. 59. In FIG. 59, the surface 1120 and the surface 1136 are closer together than in FIG. 58 and are separated by a distance 1174 which is less than distance 1167 in FIG. 58. The surfaces 1120, 1136 are applying forces to the fastening strips which causes the fastening strips to move closer together in the Z axis 1064. The webs 1040, 1050 are closer together than in FIG. 58 and are separated by a distance 1176 which is less than the distance 1166 in FIG. 58. The webs 1040, 1050 including the hooks 1042, 1052 are occluded. The base 1038 is at an angle 1171 to the Z axis 1064 in order to allow the hooks 1042, 1052 to engage. The angle 1171 is approximately the same as angle 1169 in FIG. 58. In addition, the surface 1140 is at angle 1172 to the Z axis 1064 which is approximately the same as angle 1168 in FIG. 58. Also, the hooks 1044, 1045 are separated by a distance which is represented by the distance 1178 between the bases 1038, 1048 and which is approximately the same as the distance 1170 in FIG. 58.

Figure 60:
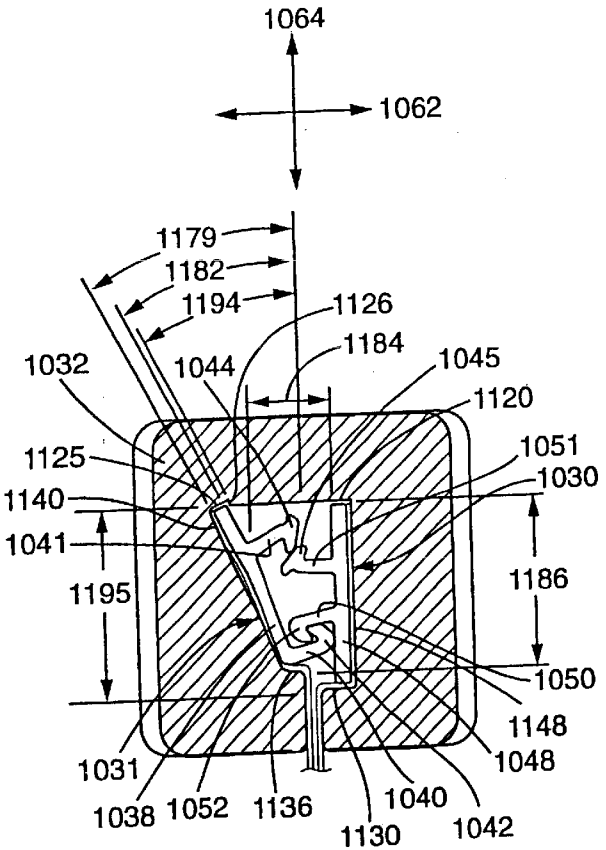
FIG. 60 is a partial cross-sectional view taken along line 60—60 in FIG. 50.

With respect to FIG. 60 as the slider continues to move along the fastening strips in the occlusion direction 1180 as shown in FIG. 50, the base 1138 begins to deflect and causes the web 1041 and hook 1044 to move in the Y axis 1062 as shown in FIG. 60. In FIG. 60, the surface 1140 is at an angle 1179 to the Z axis 1264 which is approximately the same as the angle 1172 in FIG. 59. The surfaces 1140, 1148 are applying forces to the fastening strips which causes the fastening strips to move in the Y axis 1062. The base 1038 is at angle 1182 which is approximately the same as the angle 1171 in FIG. 59. The base 1038 begins to deflect or flex and causes the web 1041 and the hook 1044 to move in the Y axis 1062.

The base 1038 flexes due to effect caused by the position of the fastening strips at later locations. Specifically, the base 1038 flexes due to the engagement of the hooks 1044, 1045 and a restraining force applied by surface 1126 at locations between FIGS. 61. 62. As the base 1038 flexes, the hooks 1044, 1045 move closer together and are separated by a distance which is represented by the distance 1184 between the bases 1038, 1048. The distance 1184 is less than the distance 1178 in FIG. 59.

In addition, the fastening strips are moving relative to each other in the Z axis 1064 as shown in FIG. 60. The surfaces 1120, 1136 are separated by a distance 1186 which is less than the distance 1174 in FIG. 59. Due to reduction in distance, the surfaces 1120, 1136 are applying forces to the fastening strips and causing them to move relative to each other in the Z axis 1064. This movement in the Z axis 1064 assists the hooks 1044, 1045 in passing each other and occluding. Specifically, the forces cause the webs 1040, 1050 and the hooks 1042, 1052 to deflect which permits the movement in the Z axis 1064.

Figure 61:
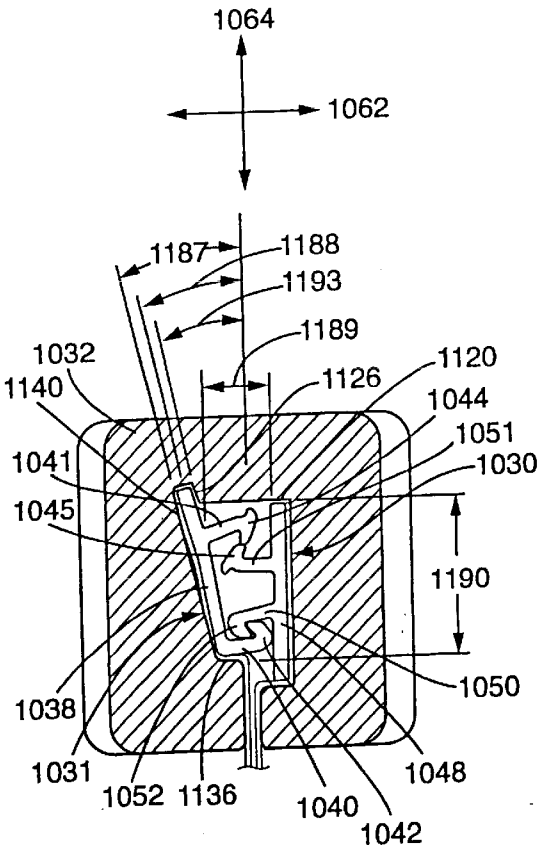
FIG. 61 is a partial cross-sectional view taken along line 61—61 in FIG. 53.

With respect to FIG. 61, as the slider continues to move along the fastening strips in the occlusion direction 1180 as shown in FIG. 50, the slider continues to cause the base portion 1038 to move in the Y axis 1062 as shown in FIG. 61. In FIG. 61, the surface 1140 is at an angle 1187 to the Z axis 1064 which is smaller than the angle 1179 in FIG. 60. The surfaces 1140, 1148 are applying forces to the fastening strips which causes the fastening strips to move closer together in the Y axis 1062. Thus, the base 1038 is at angle 1188 which is smaller than the angle 1182 in FIG. 60. The base continues to flex as noted above and causes the web 1041 and the hook 1044 to move in the Y axis 1062. As the base 1038 flexes, the hooks 1044, 1045 move closer together and are separated by a distance which is represented by the distance 1189 between the bases 1038, 1048. The distance 1189 is less than the distance 1184 in FIG. 60.

In addition, the fastening strips are moving relative to each other in the Z axis 1064 as shown in FIG. 61. The surfaces 1120, 1136 are separated by a distance 1190 which is less than the distance 1186 in FIG. 60. Due to the reduction in distance, the surfaces 1120, 1136 are applying forces to the fastening strips and causing them to move relative to each other in the Z axis 1064. This movement in the Z axis 1064 assists the hooks 1044, 1045 in passing each other and occluding. The forces cause the webs 1040, 1050 and hooks 1042, 1052 to deflect which permits movement in Z axis 1064.

Figure 62:
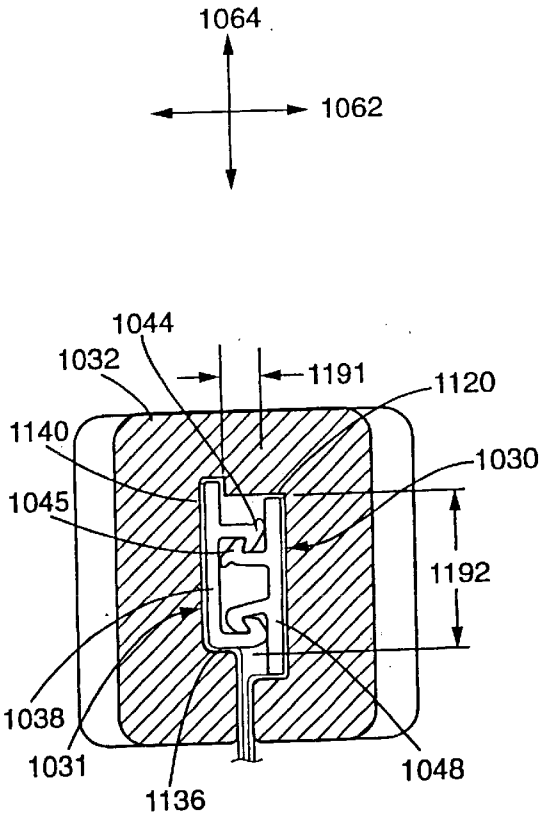
FIG. 62 is a partial cross-sectional view taken along line 62—62 in FIG. 50.

With respect to FIG. 62, as the slider continues to move along the fastening strips in the occlusion direction 1180 as shown in FIG. 50, the slider continues to cause the base portion 1038 to move in the Y axis 1062 as shown in FIG. 62. In FIG. 62, the surface 1140 is no longer at an angle to the Z axis 1064. Thus, the base 1038 is not at an angle to the Z axis. In addition, the hooks 1044, 1045 are closer together and have engaged. The hooks 1044, 1045 are separated by a distance which is represented by the distance 1191 between the bases 1038, 1048. The distance 1191 is less than the distance 1189 in FIG. 61.

In addition, the fastening strips are moving relative to each other in the Z axis 1064 as shown in FIG. 62. The surfaces 1120, 1136 are separated by a distance 1192 which is less than the distance 1190 in FIG. 61. Due to the reduction in distance, the surfaces 1120, 1136 are applying forces to the fastening strips and causing them to move relative to each other in the Z axis 1064. This movement in the Z axis 1064 assists the hooks 1044, 1045 in passing each other and occluding. Specifically, the forces cause the webs 1040, 1050 and the hooks 1042, 1052 to deflect which permits the movement in the Z axis 1064. As shown in FIG. 62, the fastening strips 1030, 1031 are occluded prior to exiting the slider.

The deocclusion of the fastening strips 1030, 1031 in FIGS. 57–62 would occur in the reverse order of these figures. Thus, deocclusion is illustrated by beginning at FIG. 62 and moving in reverse order toward FIG. 57. The deocclusion of the fastening strips 1030, 1031 occurs by moving the fastening strips away from each other in the Z axis 1064. Also, one of the fastening strips rotates and flexes during deocclusion. The hook portions are disengaged sequentially. The slider facilitates the deocclusion of the fastening strips.

Referring to the FIG. 50, the slider 1032 is moved in the deocclusion direction 1181 and the fastening strips 1030, 1031 enter the slider 1032 as shown in FIG. 62. Referring to FIG. 62, the fastening strips 1030, 1031 are occluded as they enter the slider 1032. The surface 1140 is parallel to the Z axis 1064. Thus, the base 1038 is also parallel to the Z axis. In addition, the hooks 1044, 1045 are engaged and the distance between the hooks is represented by the distance 1191 between the bases 1038, 1048.

With respect to FIG. 61, as the slider continues to move along the fastening strips in the deocclusion direction 1081, the slider causes the base 1038 to move in the Y axis 1062 as shown in FIG. 61. Referring to FIG. 61, the surface 1126 is at an angle 1193 to the Z axis 1064. The surface 1126 causes the base 1038 to flex and rotate. The base 1038 flexes and rotates relative to the Z axis 1064 in order to allow the hooks 1044, 1045 to disengage and pass each other when the fastening strips deocclude. The base 1038 is at an angle 1188 to the Z axis 1064. The hooks 1044, 1045 are further apart than in FIG. 62. Specifically, the hooks 1044, 1045 are separated by a distance in the Y axis 1062 which is represented by the distance 1189 between the bases 1038, 1048.

Furthermore, as noted above, the positions of the fastening strips are effected not only by the forces acting upon them by the slider at that specific location, but are also effected by the position of the fastening strips at locations before and after that specific location. For example, the positions of fastening strips 1030, 1031 in FIG. 61 are effected by the positions of the fastening strips in FIGS. 60 and 62.

With respect to FIG. 60, as the slider continues to move along the fastening strips in the deocclusion direction 1181 as shown in FIG. 50, the slider continues to cause the base 1038 to move in the Y axis 1062 as shown in FIG. 60. Referring to FIG. 60, the surface 1126 is at an angle 1194 to the Z axis 1064 which is greater than the angle 1193 in FIG. 61. Due to the increase in angle and thus distance, the surface 1126 causes the base 1038 to flex and rotate. The base 1038 flexes and rotates relative to the Z axis 1064 in order to allow the hooks 1044, 1045 to move in the Y axis 1062 and disengage. The base 1038 is at an angle 1182 to the Z axis 1064 which is greater than the angle 1188 in FIG. 61. Consequently, the hooks 1044, 1045 are further apart than in FIG. 61 and have disengaged. Specifically, the hooks 1044, 1045 are separated by a distance in the Y axis 1062 which is represented by the distance 1184 between the bases 1038, 1048 and which is greater than the distance 1189 in FIG. 61. In addition, the surfaces 1125, 1130 are separated by a distance 1195.

With respect to FIG. 59, as the slider continues to move along the fastening strips in the deocclusion direction 1181 as shown in FIG. 50, the slider continues to cause the base 1038 to move in the Y axis 1062 as shown in FIG. 59. Referring to FIG. 59, the surface 1140 is at an angle 1172 to the Z axis 1064 which is approximately the same as the angle 1179 in FIG. 60. The base 1038 is at an angle 1171 to the Z axis 1064 which is approximately the same as angle 1182 in FIG. 60. However, the base 1038 is no longer flexed and has returned to the relaxed position. Consequently, the hooks 1044, 1045 are further apart than in FIG. 60. Specifically, the hooks 1044, 1045 are separated by a distance in the Y axis 1062 which is represented by the distance 1178 between the bases 1038, 1048. The distance 1178 is greater than the distance 1184 in FIG. 60.

The fastening strips also move closer together in the Z axis 1064 as shown in FIG. 59. In FIG. 59 the surfaces 1125, 1130 are closer together than in FIG. 60 and are separated by a distance 1196 which is less than the distance 1195 in FIG. 60. The surfaces 1125, 1136 are applying forces to the fastening strips which causes the fastening strips to move closer together in the Z axis 1064. The webs 1040, 1050 are separated by a distance 1176.

With respect to FIG. 58, as the slider continues to move along the fastening strips in the deocclusion direction 1181 as shown in FIG. 50, the slider causes the fastening strips to move away from each other in the Z axis 1064 as shown in FIG. 58. Referring to FIG. 58, the surfaces 1125, 1130 are separated by a distance 1197 which is less than the distance 1196 in FIG. 59. The surfaces 1125, 1130 are applying shear forces to the fastening strips which causes the fastening strips, to move away from each other in the Z axis 1064. The fastening strips separate due to the shearing action between the fastening strips. Consequently, the webs 1040, 1050 are separated by a distance 1166 which is greater than the distance 1176 in FIG. 59. In addition, the hooks 1042, 1052 have disengaged and are further apart in the Z axis 1064 than in FIG. 59.

The angles 1168, 1169 are approximately the same as the angles 1172, 1171 in FIG. 59. In addition, the distance between the hooks 1044, 1045 which is represented by the distance 1170 between the bases 1038, 1048 is approximately the same as the distance 1178 in FIG. 59.

With respect to FIG. 57, as the slider continues to move along the fastening strips in the deocclusion direction 1181 as shown in FIG. 50, the position of the fastening strips is relatively unchanged from FIG. 58. The webs 1040, 1050 are separated by a distance 1159 which is approximately the same as the distance 1166 in FIG. 58. The surfaces 1120, 1136 are separated by a distance which is approximately the same as the distance 1197 in FIG. 58. The angles 1162, 1164 are approximately the same as the angles 1168, 1169 in FIG. 58. Finally, the distance between the hooks 1044, 1045 which is represented by the distance 1165 between the bases 1038, 1048 is approximately the same as the distance 1170 in FIG. 58. As shown in FIG. 57, the fastening strips 1030, 1031 are deoccluded when the fastening strips exit the slider 1032.

As noted above, the closure device may include other features. For example, the closure device may include a notch near the seam to assist the leak proof seal. The slider may also include an additional seal at the slot. The closure device may also have an end stop. Furthermore, the closure device may have a structure for a home or parking position. In addition, the closure device may include other structures to accommodate the slider at the end of the fastening strips, such as, slits or other means.

FIGS. 63–72 illustrate another embodiment of the invention. This embodiment occludes and deoccludes in the Z axis by using a shearing action similar to other embodiments. In addition, this embodiment includes a locking feature which assists in preventing unintentional deocclusion of the closure device. Specifically, the fastening strips prevent deocclusion of the closure device by not permitting movement in the Z axis until the locking feature is released. The locking feature includes engagement portions which disengage in substantially the Y axis. The disengagement is substantially 90 degrees relative to the disengagement of the closure device. Thus, an unintentional force acting in the Z axis will not be able to deocclude the closure device. This embodiment achieves the locking feature by moving or pivoting the engagement portions in the Y axis to unlock the fastening strips. Then, the fastening strips may be deoccluded by moving or shearing the fastening strips relative to each other in the Z axis. The fastening strips may be operated manually or a slider may be used to facilitate the engagement and disengagement of the locking feature and also the occlusion and deocclusion of the fastening strips.

Figure 63:
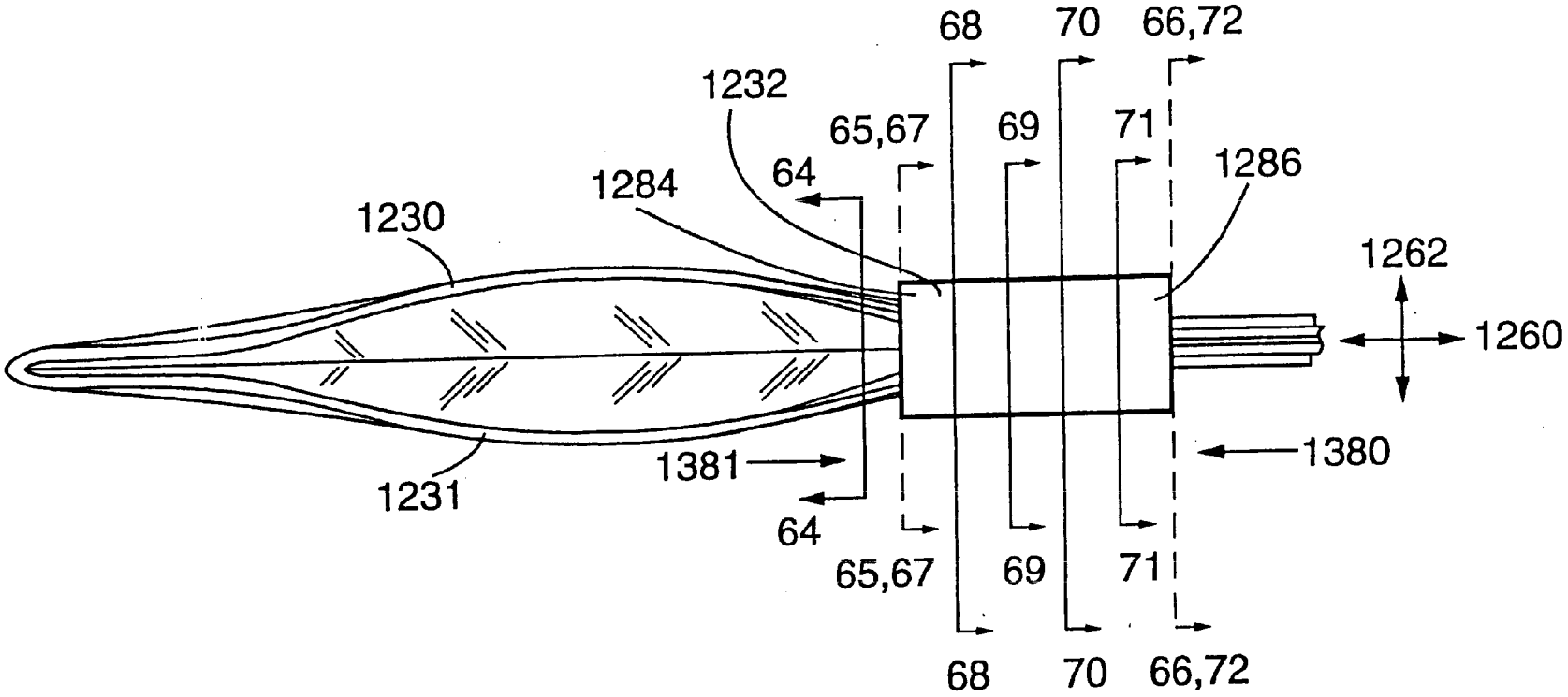
FIG. 63 is a top view of another embodiment of this invention.
Figure 64:
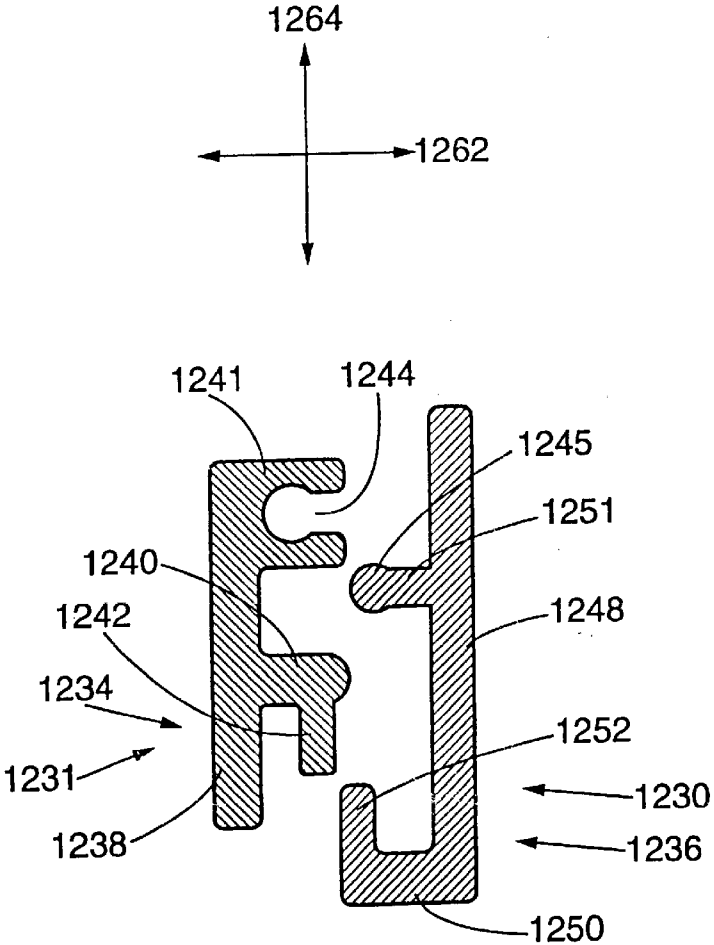
FIG. 64 is an enlarged cross-sectional view taken along line 64—64 in FIG. 63 of the fastening strips and without the bag sidewalls.

FIG. 63 shows a top view of the closure device. The closure device comprises first and second fastening strips 1230, 1231 and a slider 1232. As shown in FIG. 64, the first fastening strip 1231 includes a first closure element 1234. The second fastening strip 1230 comprises a second closure element 1236 for engaging the first closure element 1234.

The first closure element 1234 comprises a base portion 1238 and a web 1240 extending from the base portion 1238. The web 1240 includes a hook portion 1242 extending from the web 1240. A second web 1241 extends from the base portion 1238 and the web 1241 includes a first engagement portion 1244.

The second closure element 1236 comprises a base portion 1248 and a web 1250 extending from the base portion 1248. The web 1250 includes hook portion 1252 extending from the web 1250. A second web 1251 extends from the base portion 1248. The second web 1251 includes a second engagement portion 1245 which engages the first engagement portion 1244.

Referring to FIGS. 63–64 the closure device and the fastening strips have an X axis 1260, a Y axis 1262 and a Z axis 1264. The X axis 1260 is the longitudinal axis of the closure device, the Y axis 1262 is the lateral axis which is perpendicular to the X axis 1260 and the Z axis 1264 is the vertical axis which is perpendicular to the X axis 1260 and the Y axis 1262.

Figure 66:
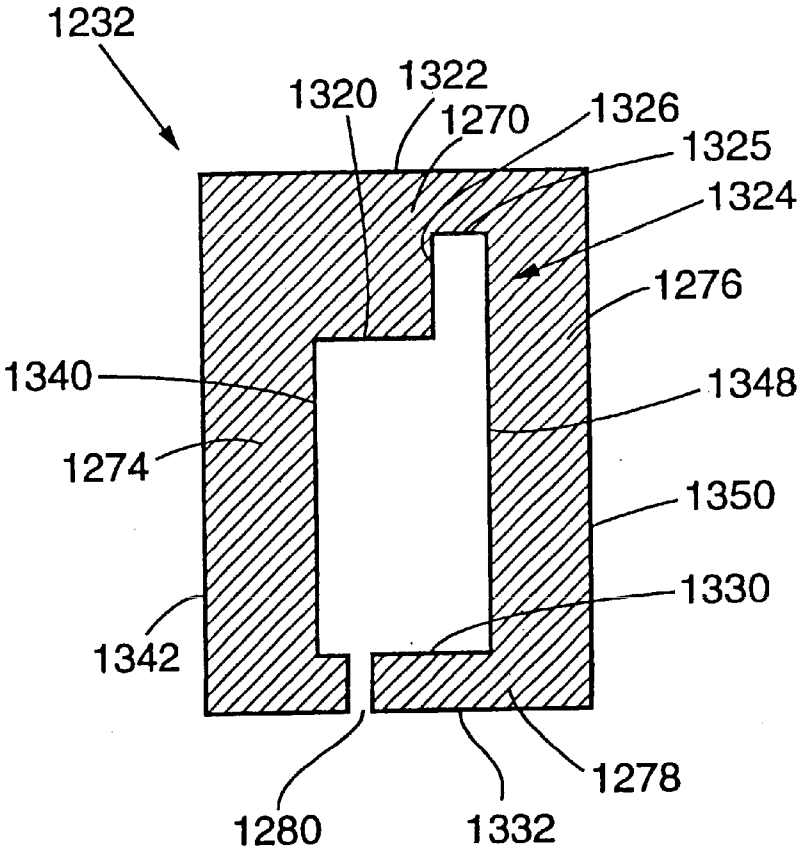
FIG. 66 is a cross-sectional view taken along line 66—66 in FIG. 63 of the slider and without the fastening strips.
Figure 65:
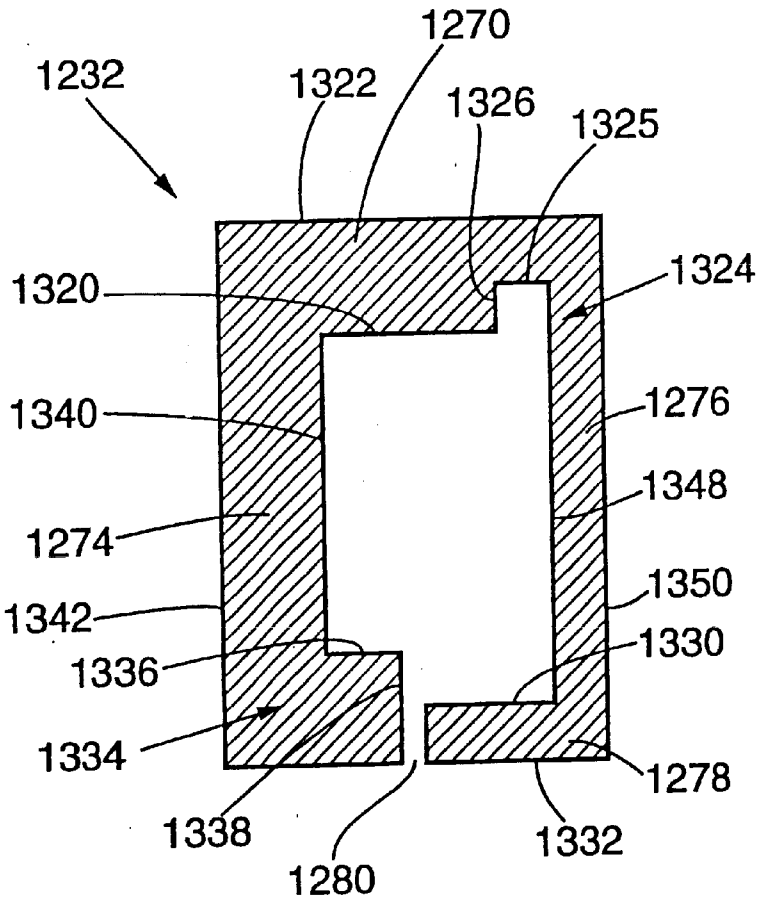
FIG. 65 is a cross-sectional view taken along line 65—65 in FIG. 63 of the slider and without the fastening strips.

Referring to FIGS. 65–66, the slider 1232 includes a top portion 1270, a first side portion 1274, a second side portion 1276, a bottom portion 1278 and a slot 1280. Referring to FIG. 63, the slider 1232 has a first end 1284 and a second end 1286.

Returning to FIGS. 65 and 66, the top portion 1270 has an inner surface 1320 and an outer surface 1322. The inner surface 1320 includes an offset portion 1324 which includes an upper surface 1325 and an offset side surface 1326. The offset portion 1324 begins at the second end 1286 and slopes downwards towards the first end 1284.

The bottom portion 1278 has an inner surface 1330 and an outer surface 1332. The inner surface 1330 includes an offset portion 1334 which includes an upper surface 1336 and an offset side surface 1338. The offset portion 1334 begins at the first end 1284 and slopes downward towards the second end 1286.

The first side portion 1274 has an inner surface 1340 and an outer surface 1342. The second side portion 1276 has an inner surface 1348 and an outer surface 1350. The bottom portion 1278 has a slot 1280 which extends from the outer surface 1332 to the inner surface 1330. In addition, the slot extends from the first end 1284 to the second end 1286 of the slider. The slot has substantially the same width from the first end 1284 to the second end 1286 of the slider.

The slider may be a one piece construction or may include several separate pieces which are assembled in several different ways.

FIGS. 67–72 illustrate occlusion and deocclusion of the closure device. When FIGS. 67–72 are viewed in numerical sequence, FIGS. 67–72 illustrate occlusion of the fastening strips. When FIGS. 67–72 are viewed in reverse numerical sequence (i.e. viewed from FIG. 72 backwards to FIG. 67), FIGS. 67–72 illustrate deocclusion of the fastening strips.

Figure 67:
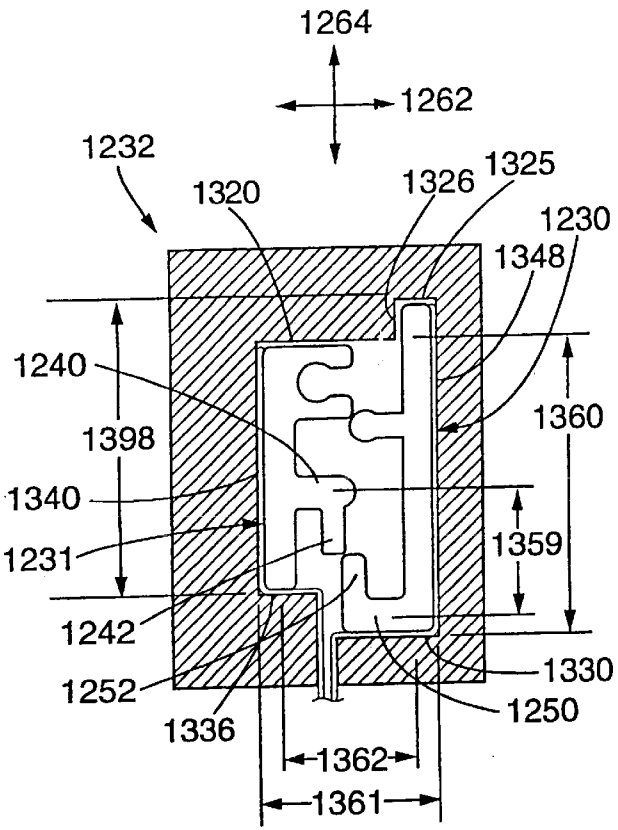
FIG. 67 is a partial cross-sectional view taken along line 67—67 in FIG. 63.

The occlusion of the fastening strips will be described and then the deocclusion of the fastening strips will be described. The slider 1232 facilitates the occlusion of the fastening strips 1230, 1231 by moving the fastening strips towards each other in a shear direction or Z axis direction and causing the webs to engage. The slider also facilitates the engagement of the engagement portions. Referring to FIG. 63, the slider 1232 is moved in the occlusion direction 1380 and the fastening strips 1230, 1231 enter the slider 1232 as shown in FIG. 67. Referring to FIG. 67, the fastening strips 1230, 1231 are deoccluded and the web 1240 and web 1250 are separated by a distance 1359. In addition, the upper surface 1330 of the bottom portion and inner surface 1320 of the top portion are separated by a distance 1360. In addition, the surfaces 1340, 1348 are separated by a distance 1361 and the bases 1238, 1248 are separated by a distance 1362.

Figure 68:
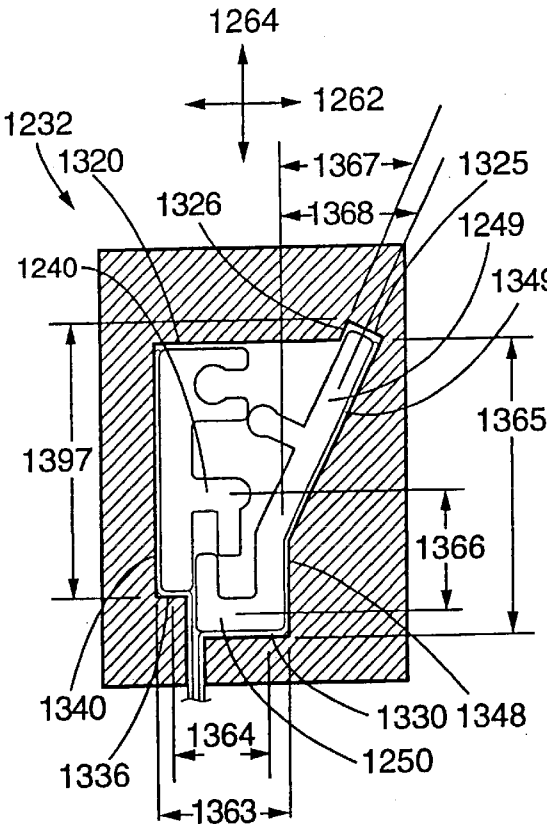
FIG. 68 is a partial cross-sectional view taken along line 68—68 in FIG. 63.

With respect to FIG. 68, as the slider is moved further along the fastening strips in the occlusion direction 1380 as shown in FIG. 63, the slider causes the fastening strips to move closer together in Y axis 1262 as shown in FIG. 68. Referring to FIG. 68, the fastening strips 1230, 1231 are deoccluded. However, the surface 1340 and the surface 1348 are closer together than in FIG. 67 and are separated by a distance 1363 which is less than distance 1361 in FIG. 67. Due to the reduction in distance, the surface 1340 and the surface 1348 cause the fastening strips to move closer together in the Y axis 1262. Thus, the bases 1238, 1248 are separated by a distance 1364 which is less than the distance 1362 in FIG. 67. The surface 1326 is at an angle 1367 to the Z axis 1264. This surface 1326 causes a portion of the fastening strips to deflect or rotate. Specifically, a portion 1249 of the base 1248 deflects or rotates relative to the Z axis 1264 in order to allow the engagement portions 1244, 1245 to pass each other and engage when the fastening strips are occluded. This portion 1249 is at an angle 1368 to the Z axis 1264. Furthermore the surfaces 1320, 1330 are separated by a distance 1365 which is approximately the same as distance 1360 in FIG. 67. Thus, the webs 1240, 1250 are separated by a distance 1366 which is approximately the same as the distance 1359 in FIG. 67.

With respect to FIGS. 67–72, the positions of the fastening strips are effected not only by the forces acting upon them by the slider at that location but are also effected by the position of the fastening strips at locations before and after that location. For example, the positions of the fastening strips in FIG. 68 are effected by the positions of the fastening strips in FIGS. 67 and 69.

The amount of effect that the position of fastening strips from one location has upon the position of the fastening strips in another location depends upon several factors, such as, the structure of the fastening strips and the material from which the fastening strips are made. For example, if the fastening strips are relatively thick, then the effect at other locations would be greater than if the fastening strips were relatively thin. As another example, if the material for the fastening strips is relatively rigid, then the effect at other locations would be greater than if the material was relatively flexible.

Figure 69:
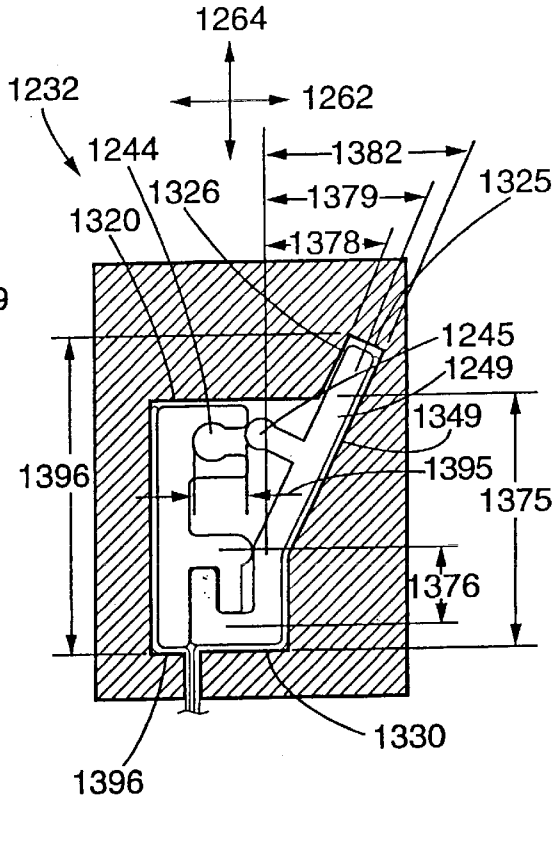
FIG. 69 is a partial cross-sectional view taken along line 69—69 in FIG. 63.

With respect to FIG. 69, as the slider continues to move along the fastening strips in the occlusion direction 1380 as shown in FIG. 63, the slider causes the fastening strips to move closer together in the Z axis 1264 as shown in FIG. 69. In FIG. 69, the surface 1320 and the surface 1330 are closer together than in FIG. 68 and are separated by a distance 1375 which is less than distance 1365 in FIG. 68. The surfaces 1320, 1330 are applying forces to the fastening strips which causes the fastening strips to move closer together in the Z axis 1264. The webs 1240, 1250 are closer together than in FIG. 68 and are separated by a distance 1376 which is less than the distance 1366 in FIG. 68. The webs 1240, 1250 are occluded. The surface 1326 is at an angle 1378 to the Z axis 1264. This surface 1326 continues to cause a portion of the fastening strips to deflect or rotate. Specifically, the portion 1249 of the base is at an angle 1379 to the Z axis 1264 in order to allow the engagement portions 1244, 1245 to pass each other and engage when the fastening strips are occluded. The angle 1379 is approximately the same as angle 1367 in FIG. 68. In addition, the surface 1349 is at angle 1382 to the Z axis 1264.

Figure 70:
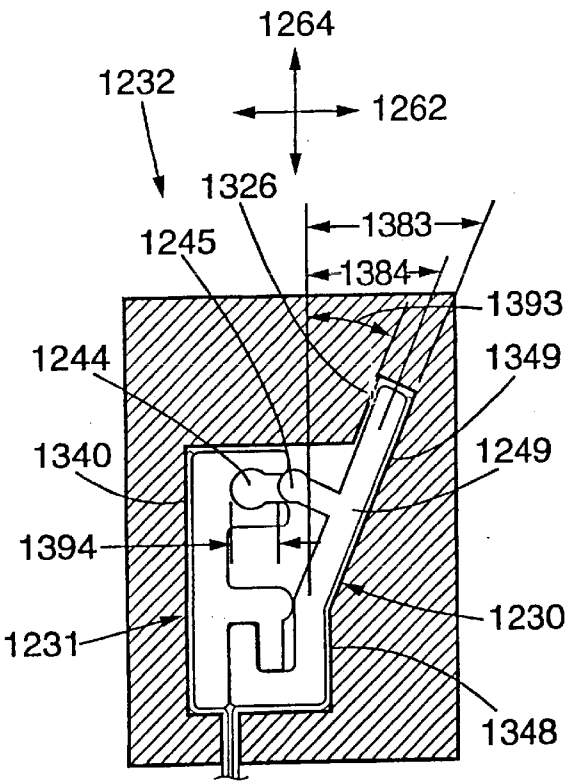
FIG. 70 is a partial cross-sectional view taken along line 70—70 in FIG. 63.

With respect to FIG. 70 as the slider continues to move along the fastening strips in the occlusion direction 1380 as shown in FIG. 63, the slider causes the portion 1249 to move in the Y axis 1262 as shown in FIG. 70. In FIG. 70, the surface 1349 is at an angle 1383 to the Z axis 1264 which is smaller than the angle 1382 in FIG. 69. The surfaces 1340, 1349 are applying forces to the fastening strips which causes the fastening strips to move closer together in the Y axis 1262. Thus, the portion 1249 is at angle 1384 which is smaller than the angle 1379 in FIG. 69. In addition, the engagement portions 1244, 1245 are closer together than in FIG. 69.

Figure 71:
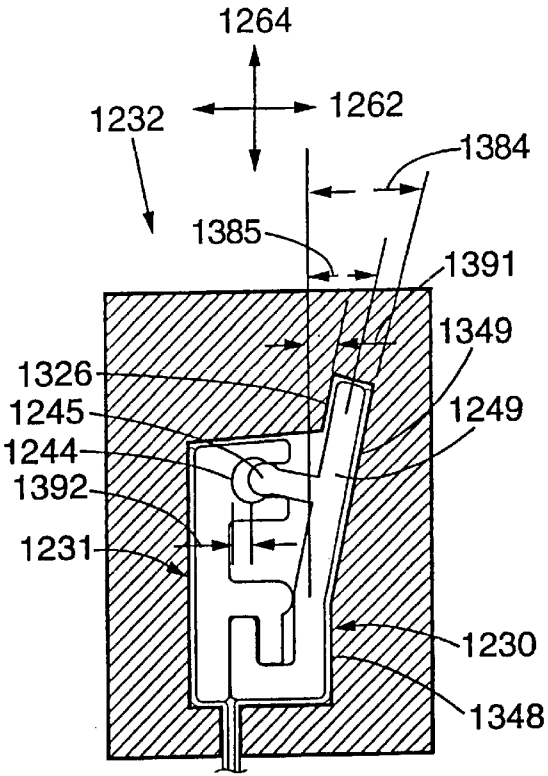
FIG. 71 is a partial cross-sectional view taken along line 71—71 in FIG. 63.

With respect to FIG. 71, as the slider continues to move along the fastening strips in the occlusion direction 1380 as shown in FIG. 63, the slider continues to cause the base portion 1249 to move in the Y axis 1262 as shown in FIG. 71. In FIG. 71, the surface 1349 is at an angle 1384 to the Z axis 1264 which is smaller than the angle 1383 in FIG. 70. The surfaces 1340, 1349 are applying forces to the fastening strips which causes the fastening strips to move closer together in the Y axis 1262. Thus, the portion 1249 is at angle 1385 which is smaller than the angle 1384 in FIG. 70. In addition, the engagement portions 1244, 1245 are closer together than in FIG. 70.

Figure 72:
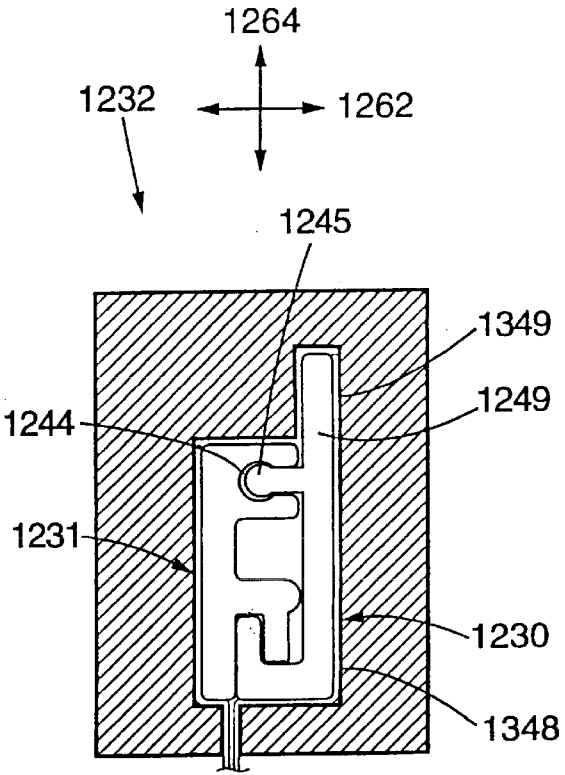
FIG. 72 is a partial cross-sectional view taken along line 72—72 in FIG. 63.

With respect to FIG. 72, as the slider continues to move along the fastening strips in the occlusion direction 1380 as shown in FIG. 63, the slider continues to cause the base portion 1249 to move in the Y axis 1262 as shown in FIG. 72. In FIG. 72, the surface 1349 is no longer at an angle tc the Z axis 1264. Thus, the portion 1249 is not at an angle to the Z axis. In addition, the engagement portions 1244 1245 have engaged. As shown in FIG. 72, the fastening strips 1230, 1231 are occluded prior to exiting the slider.

The deocclusion of the fastening strips 1230, 1231 in FIG. 67–72 would occur in the reverse order of these figures. Thus, deocclusion is illustrated by beginning at FIG. 72 and moving in reverse order toward FIG. 67. The slider 1232 facilitates the deocclusion of the fastening strips 1230, 1231 by moving the fastening strips away from each other in the Z axis 1264 and causing the webs to disengage. The slider also facilitates the disengagement of the engagement portions. Referring to the FIG. 63, the slider 1232 is moved in the deocclusion direction 1381 and the fastening strips 1230, 1231 enter the slider 1232 as shown in FIG. 72. Referring to FIG. 72, the fastening strips 1230, 1231 are occluded as they enter the slider 1232. The surface 1349 is parallel to the Z axis 1264. Thus, the portion 1249 is also parallel to the Z axis. In addition, the engagement portions 1244, 1245 are engaged.

With respect to FIG. 71, as the slider continues to move along the fastening strips in the deocclusion direction 1381, the slider causes the portion 1249 to move in the Y axis 1262 as shown in FIG. 71. Referring to FIG. 71, the surface 1326 is at an angle 1391 to the Z axis 1264. The surface 1326 causes the portion 1249 to deflect or rotate. The portion 1249 deflects or rotates relative to the Z axis 1264 in order to allow the engagement portions to disengage and pass each other when the fastening strips deocclude. The portion 1249 is at an angle 1385 to the Z axis 1264. The engagement portions 1244, 1245 are further apart than in FIG. 72. Specifically, the engagement portions 1244, 1245 are separated by a distance 1392 in the Y axis 1262.

Furthermore, as noted above, the positions of the fastening strips are effected not only by the forces acting upon them by the slider at that specific location, but are also effected by the position of the fastening strips at locations before and after that specific location. For example, the positions of fastening strips 1230, 1231 in FIG. 71 are effected by the positions of the fastening strips in FIGS. 70 and 72.

With respect to FIG. 70, as the slider continues to move along the fastening strips in the deocclusion direction 1381 as shown in FIG. 63, the slider continues to cause the portion 1249 to move in the Y axis 1262 as shown in FIG. 70. Referring to FIG. 70, the surface 1326 is at an angle 1393 to the Z axis 1264 which is greater than the angle 1391 in FIG. 71. Due to the increase in angle and thus distance, the surface 1326 causes the portion 1249 to deflect or rotate. The portion 1249 deflects or rotates relative to the Z axis 1264 in order to allow the engagement portions to move in the Y axis 1262 and disengage. The portion 1249 is at an angle 1384 to the Z axis 1264 which is greater than the angle 1385 in FIG. 71. Consequently, the engagement portions 1244, 1245 are further apart than in FIG. 71. Specifically, the engagement portions 1244, 1245 are separated by a distance 1394 in the Y axis 1262 which is greater than the distance 1392 in FIG. 71.

With respect to FIG. 69, as the slider continues to move along the fastening strips in the deocclusion direction 1381 as shown in FIG. 63, the slider continues to cause the portion 1249 to move in the Y axis 1262 as shown in FIG. 69. Referring to FIG. 69, the surface 1326 is at an angle 1378 to the Z axis 1264 which is greater than the angle 1393 in FIG. 70. Due to the increase in angle and thus the distance, the surface 1326 causes the portion 1249 to deflect or rotate. The portion 1249 deflects or rotates relative to the Z axis 1264 in order to allow the engagement portions to move in the Y axis 1262 and disengage as in FIG. 69. The portion 1249 is at an angle 1379 to the Z axis 1264 which is greater than the angle 1384 in FIG. 70. Consequently, the engagement portions 1244, 1245 are further apart than in FIG. 70. Specifically, the engagement portions 1244, 1245 are separated by a distance 1395 in the Y axis 1262 which is greater than the distance 1394 in FIG. 70.

With respect to FIG. 68, as the slider continues to move along the fastening strips in the deocclusion direction 1381 as shown in FIG. 63, the slider causes the fastening strips to move away from each other in the Z axis 1264 as shown in FIG. 68. Referring to FIG. 68, the surfaces 1325, 1336 are separated by a distance 1398 which is less than the distance 1397 in FIG. 69. The surfaces 1325, 1336 are applying shear forces to the fastening strips which causes the fastening strips to move away from each other in the Z axis 1264. The fastening strips separate due to the shearing action between the fastening strips. Consequently, the webs 1240, 1250 are separated by a distance 1366 which is greater than the distance 1367 in FIG. 69.

With respect to FIG. 67, as the slider continues to move along the fastening strips in the deocclusion direction 1381 as shown in FIG. 63, the slider continues to cause the fastening strips to move away from each other in the Z axis 1264 as shown in FIG. 67. Referring to FIG. 67, the surfaces 1325, 1336 are separated by a distance 1398. The surfaces 1325, 1336 are applying shear forces to the fastening strips which causes the fastening strips to move away from each other in the Z axis 1264. The fastening strips separate due to the shearing action between the fastening strips. Consequently, the webs 1240, 1250 are separated by a distance 1359 which is greater than the distance 1366 in FIG. 68.

In addition, the fastening strips 1230, 1231 move away from each other in the Y axis 1262 as shown in FIG. 67. The surfaces 1340, 1348 are further apart than in FIG. 68 and are separated by a distance 1361 which is greater than the distance 1363 in FIG. 68. Due to the increase in distance, the surfaces 1340, 1348 permit the fastening strips to move away from each other in the Y axis 1262. The surface 1326 assists in moving the fastening strips away from each other in the Y axis 1262. The bases 1238, 1248 are separated by a distance 1362 which is greater than the distance 1364 in FIG. 68. Thus, the webs 1240, 1250 including the hooks 1242, 1252 have disengaged and are deoccluded. Furthermore, the surface 1349 is no longer at an angle to the Z axis 1264. Thus, the portion 1249 is not at an angle to the Z axis. As shown in FIG. 67, the fastening strips 1230, 1231 are deoccluded when the fastening strips exit the slider 1232.

As noted above, the closure device may include other features. For example, the closure device may include a notch near the seam to assist the leak proof seal. The slider may also include an additional seal at the slot. The closure device may also have an end stop. Furthermore, the closure device may have a structure for a home or parking position. In addition, the closure device may include other structures to accommodate the slider at the end of the fastening strips, such as, slits or other means.

The slider may be manufactured by injection molding or any other method. The slider may be formed from thermoplastic materials such as, nylon, polypropylene, polystyrene, acetal, toughened acetal, polyketone, polybutylene terephthalate, high density polyethylene, polycarbonate, or ABS. The slider can be clear, opaque, or colored.

The fastening strips may be manufactured by extrusion through a die that has the approximate dimensions given above, although the die should be made somewhat larger than the desired final dimensions of the fastening strip, inasmuch as shrinkage of the extruded fastening strip is likely upon cooling. The fastening strips of the closure device should be manufactured to have approximately uniform cross-sections. This not only simplifies the manufacturing of a device, but also contributes to the physical flexibility of the device, which may be a desirable property.

Generally, the closure elements of this invention may be formed from thermoplastic materials such as, for example, polyethylene, polypropylene, nylon, or the like, or from a combination thereof. Thus, resins or mixtures of resins such as high density polyethylene, medium density polyethylene and low density polyethylene may be employed to prepare the novel fastener of this invention. Preferably, the closure element is made from low density polyethylene. The selection of the thermoplastic material will be related to the closure design and its Young's Modulus and desired elasticity and flexibility correlated to provide the functionality of the closure as herein claimed.

When the fastener of the present invention is used in a sealable bag, the fastener and the films that form the body of the bag can be made from heat sealable material. The bag thus can be formed economically by heat sealing the aforementioned components to form the bag using thermoplastics of a type aforementioned for formation of the closure elements. Preferably, the bag is made from a mixture of high pressure, low density polyethylene and linear low density polyethylene.

The closure elements of the invention may be manufactured by extrusion or other known methods. The closure device can be manufactured as individual fastening strips for later attachment to a film, or the fastening strips can be manufactured integrally with a film. In addition, the closure elements can be manufactured with or without flange portions on one or both of the closure elements depending upon the intended use or expected additional manufacturing operations.

Generally, the closure device of this invention can be manufactured in a variety of forms to suit the intended use. In the practice of the instant invention, the closure device may be integrally formed with the sidewalls of a container, or connected to a container, by the use of any of many known methods. For example, a thermoelectric device can be applied to a film in contact with a flange portion of a closure element or the thermoelectric device can be applied to a film in contact with the base portion of a closure element having no flange portion, to cause a transfer of heat through the film to produce melting at the interface of the film and a flange portion or base portion of the closure element. The thermoelectric device can be heated rotary discs, traveling heater bands, resistance-heated slide wires, or the like. The connection between the film and the closure element can also be established by the use of hot melt adhesives, hot jets of air to the interface, ultrasonic heating, or other known methods. The bonding of the closure element to the film stock may be carried out either before or after the film is U-folded to form a bag. In any event, such bonding is done prior to side sealing the bags at the edges by conventional thermal cutting. In addition, the male and female closure elements can be positioned on opposite sides of a film. Such an embodiment would be suited for wrapping an object or a collection of objects such as wires. The male and female closure elements on a film generally should be parallel to each other, but this will depend on the intended use.

Thus, the present invention provides a closure device that overcomes the drawbacks inherent in the prior art.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references and copending applications cited herein are hereby incorporated by reference in their entireties.

What is claimed is:

1. A closure device comprising first and second interlocking fastening strips arranged to be interlocked over a predetermined length, said fastening strips have a longitudinal X axis, said fastening strips have a transverse Y axis, said transverse Y axis is perpendicular to said longitudinal X axis, said fastening strips have a vertical Z axis, said vertical Z axis is perpendicular to said longitudinal X axis, said vertical Z axis is perpendicular to said transverse Y axis, said fastening strips are occluded and deoccluded by moving said first fastening strip relative to said second fastening strip in said vertical Z axis, wherein said first fastening strip comprises a first web, said first web extending from said first fastening strip, said first web terminating in a first closure portion, said second fastening strip comprises a second web, said second web extending from said second fastening strip, said second web terminating in a second closure portion which engages said first closure portion when said fastening strips are occluded.

2. The invention as in claim 1 wherein said first fastening strip includes a first base, said first web is attached to said first base, said second fastening strip includes a second base, said second web is attached to said second base.

3. The invention as in claim 1 wherein said first closure portion engages said second web and said second closure portion engages said first web when said fastening strips are occluded.

4. The invention as in claim 1 wherein said first closure portion deflects during occlusion of said fastening strips.

5. The invention as in claim 4 wherein said first web is relatively rigid during occlusion of said fastening strips.

6. The invention as in claim 1 wherein said first closure portion includes a first portion which extends from said first web in the Z axis towards said second web and a second portion which extends from said first portion in the Y axis away from the second fastening strip.

7. The invention as in claim 6 wherein said second closure portion includes a third portion which extends from said second web in the Z axis towards said first web and a fourth portion which extends from said third portion in the Y axis away from the first fastening strip.

8. The invention as in claim 7 wherein a fifth portion extends from said first portion toward the second fastening strip and a sixth portion extends from said third portion toward the first fastening strip.

9. The invention as in claim 1 wherein said first web deflects during occlusion of said fastening strips.

10. The invention as in claim 9 wherein said first closure portion is relatively rigid during occlusion of said fastening strips.

11. The invention as in claim 1 wherein said first closure portion includes a first portion which extends from said first web in the Z axis towards said second web and a second portion which extends from said first portion in the Y axis towards the second fastening strip.

12. The invention as in claim 11 wherein said second closure portion includes a third portion which extends from said second web in the Z axis towards said first web and a fourth portion which extends from said third portion in the Y axis toward the first fastening strip.

13. The invention as in claim 11 wherein said second fastening strip includes a second base, said second web is attached to said second base, said second base has a first recessed portion, said second portion engages said recessed portion.

14. The invention as in claim 13 wherein said first fastening strip includes a first base, said first web is attached to said first base, said first base has a second recessed portion, said fourth portion engages said recessed portion.

15. The invention as in claim 1 wherein said first web deflects during occlusion of said fastening strips and said first fastening strip moves in the transverse Y axis relative to the second fastening strip during occlusion of said fastening strips.

16. The invention as in claim 15 wherein said first closure portion is relatively rigid during occlusion of said fastening strips.

17. The invention as in claim 15 wherein said first closure portion includes a first portion which extends from said first web in the Z axis towards said second web and a second portion which extends from said first portion in the Y axis away from second fastening strip.

18. The invention as in claim 17 wherein said second closure portion includes a third portion which extends from said second web in the Z axis towards said first web and a fourth portion which extends from said third portion in the Y axis away from the first fastening strip.

19. The invention as in claim 2 wherein said first base deflects during occlusion of said fastening strips.

20. The invention as in claim 19 wherein said first web is relatively rigid during occlusion of said fastening strips.

21. The invention as in claim 20 wherein said first closure portion is relatively rigid during occlusion of said fastening strips.

22. The invention as in claim 2 wherein said first closure portion includes a first portion which extends from said first web in the Z axis towards said second web and a second portion which extends from said first portion in the Y axis toward the second fastening strip.

23. The invention as in claim 22 wherein said second closure portion includes a third portion which extends from said second web in the Z axis towards said first web and a fourth portion which extends from said third portion in the Y axis toward the first fastening strip.

24. The invention as in claim 2 wherein said first base has a third closure portion which engages the second closure portion when the fastening strips are occluded and said second base has a fourth closure portion which engages the first closure portion when the fastening strips are occluded.

25. The invention as in claim 24 wherein said first base has a third closure portion which engages said fourth portion of said second closure portion when the fastening strips are occluded and said second base has a fourth closure portion which engages said second portion of said first closure portion when the fastening strips are occluded.

26. The invention as in claim 2 wherein the first base rotates during occlusion of said fastening strips.

27. The invention as in claim 26 wherein the first web deflects during occlusion of said fastening strips.

28. The invention as in claim 27 wherein the first closure portion deflects during occlusion of said fastening strips.

29. The invention as in claim 2 wherein said first fastening strip includes a third web, said third web spaced from said first web, said first web and said third web extending from said first base, said third web includes a third closure portion, said second fastening strip includes a fourth web, said fourth web spaced from said second web, said second web and said fourth web extending from said second base, and said fourth web includes a fourth closure portion which engages the third closure portion.

30. The invention as in claim 29 wherein said first closure portion is a first hook, said third closure portion is a third hook facing toward said first hook, said second closure portion is a second hook, and said fourth closure portion is a fourth hook facing away from said fourth hook.

31. The invention as in claim 30 wherein said first and second hooks include guide surfaces to guide said first and second hooks with said third and fourth hooks.

32. The invention as in claim 30 wherein said third and fourth hooks include guide surfaces to guide said third and fourth hooks with said first and second hooks.

33. The invention as in claim 29 wherein during occlusion of the fastening strips, said third closure portion occludes with said fourth closure portion, said first fastening strip rotates toward said second fastening strip and said first closure portion occludes with said second closure portion.

34. The invention as in claim 1 wherein said first closure portion includes a first portion which extends from said first web in the Z axis towards the second web and said second closure portion includes a second portion which extends from said second web in the Z axis toward the first web.

35. The invention as in claim 34 wherein said first fastening strip moves in the transverse Y axis relative to the second fastening strip during occlusion of said fastening strips.

36. The invention as in claim 1 wherein said first fastening strip includes a first locking portion and said second fastening strip includes a second locking portion which engages said first locking portion.

37. The invention as in claim 36 wherein said first locking portion includes a third web and a first engagement portion and said second locking portion includes a fourth web and a second engagement portion which engages said first engagement portion.

38. The invention as in claim 37 wherein said second engagement portion fits within said first engagement portion.

39. The invention as in claim 36 wherein said second locking portion moves in the Y axis relative to the first locking portion during engagement of said locking portions.

40. The invention as in claim 36 wherein when said locking portions are engaged, said locking portions prevent movement of said fastening strips relative to each other in the Z axis.

41. The invention as in claim 39 wherein said second locking portion rotates toward said first locking portion.

42. The invention as in claim 36 wherein said first locking portion engages said second locking portion after said first closure portion engages said second closure portion.

43. The invention as in claim 42 wherein said second locking portion moves in the Y axis relative to the first locking portion during engagement of said locking portions.

44. The invention as in claim 42 wherein when said locking portions are engaged, said locking portions prevent movement of said fastening strips relative to each other in the Z axis.

45. The invention as in claim 43 wherein said second locking portion rotates toward said first locking portion.

46. The invention as in claim 1 wherein a portion of one of said fastening strips deflects during occlusion and deocclusion of said fastening strips.

47. The invention as in claim 1 wherein said first fastening strip moves in the transverse Y axis relative to the second fastening strip during occlusion and deocclusion of said fastening strips.

48. The invention as in claim 1 wherein said first fastening strip includes a color different than said second fastening strip.

49. The invention as in claim 48 wherein at least a portion of one of said fastening strips is translucent.

50. The invention as in claim 48 wherein said first fastening strip includes a first color and said second fastening strip includes a second color and said fastening strips provide a third color when said fastening strips are occluded.

51. A container comprising first and second sidewalls, said first and second sidewalls including first and second fastening strips respectively, said first and second fastening strips arranged to be interlocked over a predetermined length, said fastening strips have a longitudinal X axis, said fastening strips have a transverse Y axis, said transverse Y axis is perpendicular to said longitudinal X axis, said fastening strips have a vertical Z axis, said vertical Z axis is perpendicular to said longitudinal X axis, said vertical Z axis is perpendicular to said transverse Y axis, said fastening strips are occluded and deoccluded by moving said first fastening strip relative to said second fastening strip in said vertical Z axis, wherein said first fastening strip comprises a first web, said first web extending from said first fastening strip, said first web terminating in a first closure portion, said second fastening strip comprises a second web, said second web extending from said second fastening strip, said second web terminating in a second closure portion which engages said first closure portion when said fastening strips are occluded.

52. The invention as in claim 51 wherein said first fastening strip includes a first base, said first web is attached to said first base, said second fastening strip includes a second base, said second web is attached to said second base.

53. The invention as in claim 51 wherein said first closure portion engages said second web and said second closure portion engages said first web when said fastening strips are occluded.

54. The invention as in claim 51 wherein a portion of one of said fastening strips deflects during occlusion and deocclusion of said fastening strips.

55. The invention as in claim 51 wherein said first fastening strip moves in the transverse Y axis relative to the second fastening strip during occlusion and deocclusion of said fastening strips.

56. A method for using a closure device comprising the steps of:

providing a first interlocking fastening strip, providing a second interlocking fastening strip, said fastening strips have a longitudinal X axis, said fastening strips have a transverse Y axis, said transverse Y axis is perpendicular to said longitudinal X axis, said fastening strips have a vertical Z axis, said vertical Z axis is perpendicular to said longitudinal X axis, said vertical Z axis is perpendicular to said transverse Y axis, wherein said first fastening strip comprises a first web, said first web extending from said first fastening strip, said first web terminating in a first closure portion, said second fastening strip comprises a second web, said second web extending from said second fastening strip, said second web terminating in a second closure portion which engages said first closure portion when said fastening strips are occluded, occluding said fastening strips by moving said first fastening strip relative to said second fastening strip in said vertical Z axis.

57. The invention as in claim 56 wherein said first fastening strip includes a first base, said first web is attached to said first base, said second fastening strip includes a second base, said second web is attached to said second base.

58. The invention as in claim 56 wherein said first closure portion engages said second web and said second closure portion engages said first web when said fastening strips are occluded.

59. The invention as in claim 56 wherein a portion of one of said fastening strips deflects during occlusion and deocclusion of said fastening strips.

60. The invention as in claim 56 wherein said first fastening strip moves in the transverse Y axis relative to the second fastening strip during occlusion and deocclusion of said fastening strips.

* * * * *